US012137812B2

(12) United States Patent
Alletto, Jr.

(10) Patent No.: US 12,137,812 B2
(45) **Date of Patent: *Nov. 12, 2024**

(54) MATTRESS ASSEMBLY AND METHOD

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 123 days.

This patent is subject to a terminal disclaimer.

(21) Appl. No.: 17/563,311

(22) Filed: Dec. 28, 2021

(65) Prior Publication Data

US 2022/0117404 A1 Apr. 21, 2022

Related U.S. Application Data

(63) Continuation of application No. 16/293,029, filed on Mar. 5, 2019, now Pat. No. 11,246,426.
(Continued)

(51) Int. Cl.
*A47C 23/043* (2006.01)
*A47C 23/00* (2006.01)
(Continued)

(52) U.S. Cl.
CPC ..... *A47C 23/0433* (2013.01); *A47C 23/005* (2013.01); *A47C 23/007* (2013.01);
(Continued)

(58) Field of Classification Search
CPC ..... A47C 23/0433; A47C 23/005; A47C 23/007; A47C 23/043; A47C 23/05;
(Continued)

(56) References Cited

U.S. PATENT DOCUMENTS 149,758 A 4/1874 Junge
1,671,363 A * 5/1928 Gail ..... A47C 27/04 5/720
(Continued)

FOREIGN PATENT DOCUMENTS

CN 106539655 A 3/2017
CN 106539665 A 3/2017
(Continued)

OTHER PUBLICATIONS

Australian Government, IP Australia, http://www.ipaustralia.gov.au/ Examination report No. 1 for standard patent application, Application No. 2020230275, Date of this report: Jul. 30, 2021.
(Continued)

*Primary Examiner* — David R Hare
*Assistant Examiner* — Luke Hall
(74) *Attorney, Agent, or Firm* — Sorell, Lenna & Schmidt, LLP

(57) ABSTRACT

A mattress assembly includes a chassis having top and bottom walls and first and second sidewalls that each extend from the top wall to the bottom wall. Inner surfaces of the walls and the sidewalls define an interior cavity. The top and bottom walls each include a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. A spring assembly is configured to be positioned within the interior cavity.

19 Claims, 45 Drawing Sheets

Related U.S. Application Data

(60) Provisional application No. 62/639,223, filed on Mar. 6, 2018.

(51) Int. Cl.

| | |
|---|---|
| ***A47C 23/05*** | (2006.01) |
| ***A47C 27/00*** | (2006.01) |
| ***A47C 27/04*** | (2006.01) |
| ***A47C 27/05*** | (2006.01) |
| ***A47C 27/06*** | (2006.01) |

(52) U.S. Cl.
CPC ..... *A47C 23/043* (2013.01); *A47C 23/05* (2013.01); *A47C 27/001* (2013.01); *A47C 27/002* (2013.01); *A47C 27/04* (2013.01); *A47C 27/05* (2013.01); *A47C 27/062* (2013.01)

(58) Field of Classification Search
CPC ..... A47C 27/001; A47C 27/002; A47C 27/04; A47C 27/05; A47C 27/062
USPC ..... 5/400
See application file for complete search history.

(56) References Cited

U.S. PATENT DOCUMENTS

| | | | | | |
|---|---|---|---|---|---|
| 1,915,659 | A * | 6/1933 | Gail | A47C 27/05 | 5/717 |
| 1,986,255 | A * | 1/1935 | Durfey | A47C 27/064 | 5/717 |
| 2,870,824 | A * | 1/1959 | Le Barre | A47C 31/105 | 5/482 |
| 3,083,381 | A * | 4/1963 | Bailey | A47C 27/088 | 219/217 |
| 3,142,848 | A | 8/1964 | Blecker | | |
| 4,449,261 | A * | 5/1984 | Magnusson | A47C 27/066 | 5/722 |
| 4,788,727 | A * | 12/1988 | Liu | A47C 27/085 | 5/177 |
| 4,955,095 | A * | 9/1990 | Gerrick | A47C 31/105 | 5/691 |
| 5,557,813 | A * | 9/1996 | Steed | A47C 27/081 | 5/717 |
| 5,740,574 | A * | 4/1998 | Piraino | A47C 27/001 | 5/727 |
| 5,819,349 | A * | 10/1998 | Schwartz | A47C 27/146 | 5/722 |
| 6,088,857 | A | 7/2000 | Ogle | | |
| 6,398,199 | B1 | 6/2002 | Barber | | |
| 6,886,197 | B1 * | 5/2005 | Madigan | A47G 9/02 | 5/493 |
| 8,561,235 | B2 * | 10/2013 | Oh | A47G 9/0246 | 5/722 |
| 2008/0098533 | A1 * | 5/2008 | Erdman | A47C 27/001 | 5/722 |
| 2008/0201856 | A1 * | 8/2008 | Howard | A47C 31/123 | 5/690 |
| 2009/0100606 | A1 * | 4/2009 | An | A47C 27/15 | 5/690 |
| 2011/0247144 | A1 * | 10/2011 | Oh | A47C 20/041 | 5/737 |
| 2015/0359349 | A1 * | 12/2015 | Eigenmann | A47C 21/042 | 5/655.8 |
| 2016/0192786 | A1 * | 7/2016 | Holbrook | A47C 27/085 | 5/691 |
| 2016/0353907 | A1 * | 12/2016 | Lava | A47C 27/002 | |
| 2016/0367042 | A1 * | 12/2016 | Fisher | A47C 21/046 | |

FOREIGN PATENT DOCUMENTS

| | | | |
|---|---|---|---|
| EP | 2422656 | A1 | 2/2012 |
| EP | 2853177 | A1 | 4/2015 |
| FR | 2489124 | A1 | 5/1984 |
| WO | 2006043825 | A1 | 4/2006 |

OTHER PUBLICATIONS

IP Australia, Examination report No. 1 for standard patent application, Application No. 2020230275, Applicant name Bedgear, LLC, mailed Jul. 30, 2021.

International Search Report and Written Opinion of the International Searching Authority, European Patent Office, PCT/US2019/020707, mailed Jun. 3, 2019.

Korean Intellectual Property Office—KIPO, Preliminary Notice of Grounds for Rejection, Korean Patent Application No. 2020-7026850, Dated: Jul. 27, 2023.

Canada Office Action: Canadian Appl No. 3093216: 4 pgs: Jan. 3, 2024.

CN106539655A—Google Patents English Translation.

* cited by examiner

MATTRESS ASSEMBLY AND METHOD

CROSS-REFERENCE TO RELATED APPLICATIONS

This application is a continuation application of U.S. patent application Ser. No. 16/293,029, filed on Mar. 5, 2019, which claims priority to U.S. Provisional Patent Application Ser. No. 62/639,223, filed on Mar. 6, 2018. These applications are expressly incorporated by reference herein, in their entireties.

TECHNICAL FIELD

The present disclosure generally relates to bedding, and more particularly to mattress assemblies that are modular and configured to be shipped in one or a plurality of boxes by ground delivery and that can be easily assembled upon delivery.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

Typically, mattresses are shipped to a destination as freight due to the size of the mattress. That is, most mattresses cannot be shipped by ground delivery because the mattresses each exceed the size permitted for ground delivery. Freight shipping is typically much more expensive than shipping by ground delivery. As such, shipping mattresses as freight increases costs associated with purchasing a mattress. This disclosure describes an improvement over these prior art technologies.

SUMMARY

In one embodiment, in accordance with the principles of the present disclosure, a mattress assembly is provided. The mattress assembly includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. A spring assembly is positioned within the interior cavity.

In one embodiment, in accordance with the principles of the present disclosure, a mattress assembly is provided that includes a chassis comprising top and bottom walls and first and second sidewalls that each extend from the top wall to the bottom wall, inner surfaces of the walls and the sidewalls defining an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The chassis comprises a base layer that extends from the top wall to the bottom wall and from the first sidewall to the second sidewall. A cover is coupled to outer surfaces of the walls and the sidewalls. A tambor is positioned on top of the base layer. A spring assembly is positioned on top of the tambor. The spring assembly comprises a first spring assembly and a second spring assembly that is removeably coupled to the first spring assembly. The first spring assembly has a firmness that is different from a firmness of the second spring assembly. A topper is coupled to the cover such that the topper is positioned on top of the spring assembly, the topper being removeably coupled to the cover by a zipper. The chassis is movable between a first configuration in which the sections each extend transverse to the sidewalls and a second configuration in which the sections each extend parallel to the sidewalls.

In one embodiment, in accordance with the principles of the present disclosure, a kit is provided that includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The chassis comprises a base layer that extends from the top wall to the bottom wall and from the first sidewall to the second sidewall. The kit includes a tambor positioned configured to be positioned on top of the base layer, a cover configured to be coupled to outer surfaces of the walls and the sidewalls and a topper configured to be coupled to the cover.

In one embodiment, in accordance with the principles of the present disclosure, a method of assembling a mattress is provided that includes providing a mattress assembly that includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The mattress assembly includes a spring assembly configured to be positioned within the interior cavity. The method includes moving the chassis from a first configuration in which the sections each extend parallel to the sidewalls and a second configuration in which the sections each extend transverse to the sidewalls. A tambor is positioned within the interior cavity. A spring assembly is positioned within the interior cavity such that the spring assembly is positioned on top of the tambor. A topper is attached to the cover such that the topper is positioned on top of the spring assembly.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
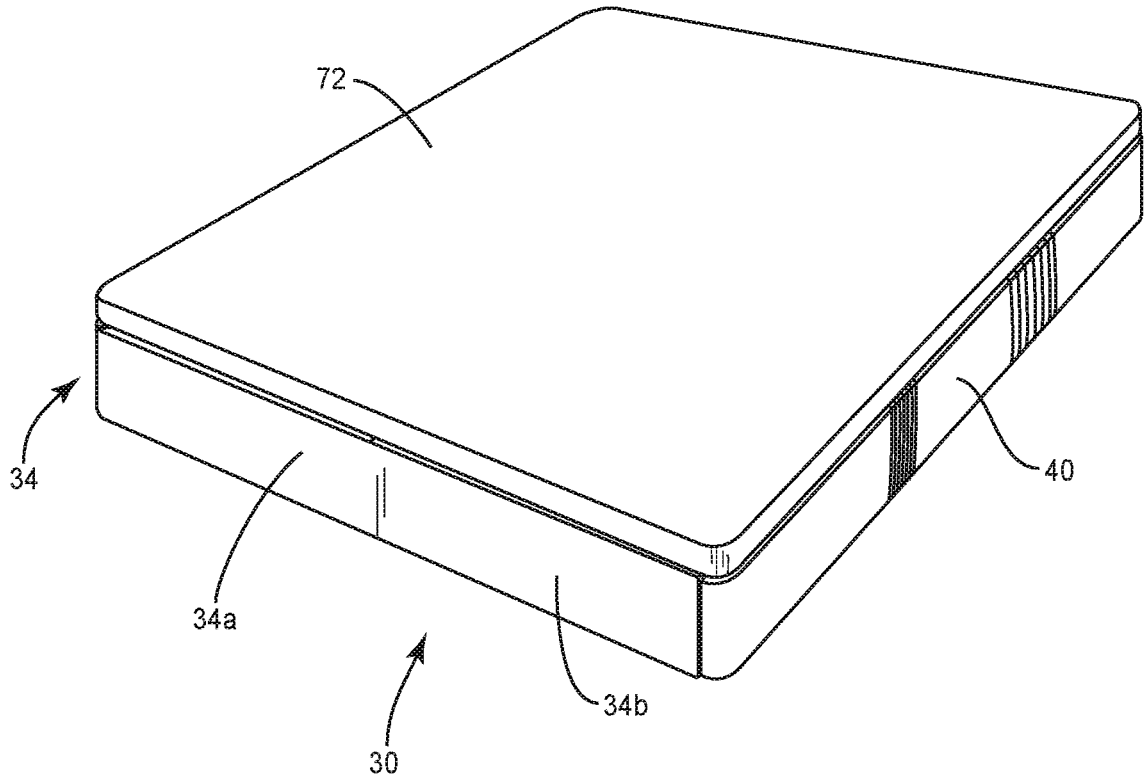
FIG. 1 is a perspective view of a mattress assembly in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

In addition, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a mattress topper in accordance with the principles of the present disclosure. Alternate embodiments are also disclosed. Reference will now be made in detail to the exemplary embodiments of the present disclosure, which are illustrated in the accompanying figures. Turning to FIGS. 1-45, there are illustrated components of an air multiplier pad, such as, for example, a mattress assembly 30.

Mattress assembly 30 is configured to lie on top of a box spring. In some embodiments, mattress assembly 30 is configured to cover all or a portion of a top surface of the box spring. In some embodiments, mattress assembly 30 is configured to be larger than the top surface of the box spring. In some embodiments, mattress assembly 30 has substantially the same size and shape as the top surface of the box spring. In some embodiments, mattress assembly 30 is a standard size mattress, such as, for example, a twin mattress, a full mattress, a queen mattress, a king mattress, or a California king mattress. In some embodiments, mattress assembly 30 is a crib mattress.

Mattress assembly 30 includes a chassis 32 comprising a top wall 34 and a bottom wall 36 positioned opposite top wall 34. Chassis 32 includes a first sidewall 38 and a second sidewall 40 positioned opposite first sidewall 38. Sidewalls 38, 40 each extend from top wall 34 to bottom wall 36. Inner surfaces of top and bottom walls 34, 36 and sidewalls 38, 40 define an interior cavity 42 configured for disposal of a tambor and one or more spring packs, as discussed herein. In some embodiments, chassis is made from a rigid material, such as, for example, PVC to provide strength and rigidity to chassis 32.

Top wall 34 comprises a first section 34*a* that is connected to sidewall 38 and a second section 34*b* that is connected to sidewall 40. Section 34*a* is connected to sidewall 38 by a mechanical bearing, such as, for example a hinge 44 (FIGS. 3 and 3A) to allow section 34*a* to pivot relative to sidewall 38. The hinge 44 that connects section 34*a* to sidewall 38 is configured to move section 34*a* between a first orientation in which section 34*a* extends at an acute angle relative to sidewall 38 and a second orientation in which section 34*a* extends perpendicular relative to sidewall 38. Section 34*b* is connected to sidewall 40 by a hinge 44 to allow section 34*b* to pivot relative to sidewall 40. The hinge 44 that connects section 34*b* to sidewall 40 is configured to move section 34*b* between a first orientation in which section 34*b* extends at an acute angle relative to sidewall 40 and a second orientation in which section 34*b* extends perpendicular relative to sidewall 40. Bottom wall 36 comprises a first section 36*a* that is connected to sidewall 38 and a second section 36*b* that is connected to sidewall 40. Section 36*a* is connected to sidewall 38 by a hinge 44 to allow section 36*b* to pivot relative to sidewall 38. The hinge 44 that connects section 36*a* to sidewall 38 is configured to move section 36*a* between a first orientation in which section 36*a* extends at an acute angle relative to sidewall 38 and a second orientation in which section 36*a* extends perpendicular relative to sidewall 38. Section 36*b* is connected to sidewall 40 by a hinge 44 to allow section 36*b* to pivot relative to sidewall 40. The hinge 44 that connects section 36*b* to sidewall 40 is configured to move section 36*b* between a first orientation in which section 36*b* extends at an acute angle relative to sidewall 40 and a second orientation in which section 36*b* extends perpendicular relative to sidewall 40.

Figure 3:
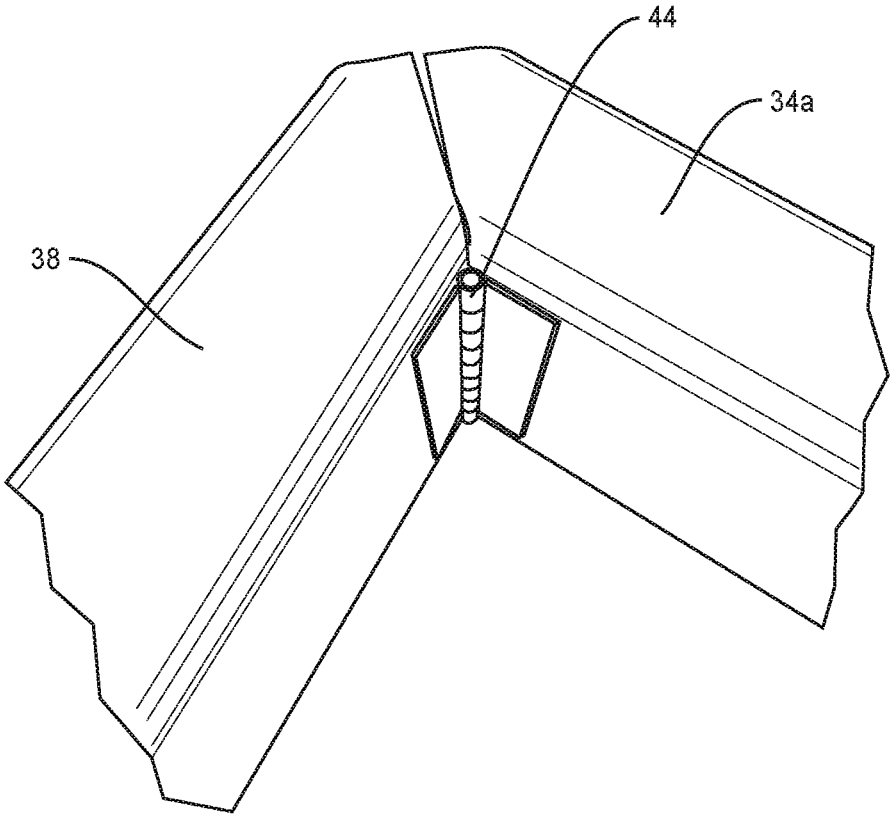
FIG. 3 is a perspective view of components of the mattress assembly shown in FIG. 1.
Figure 7:
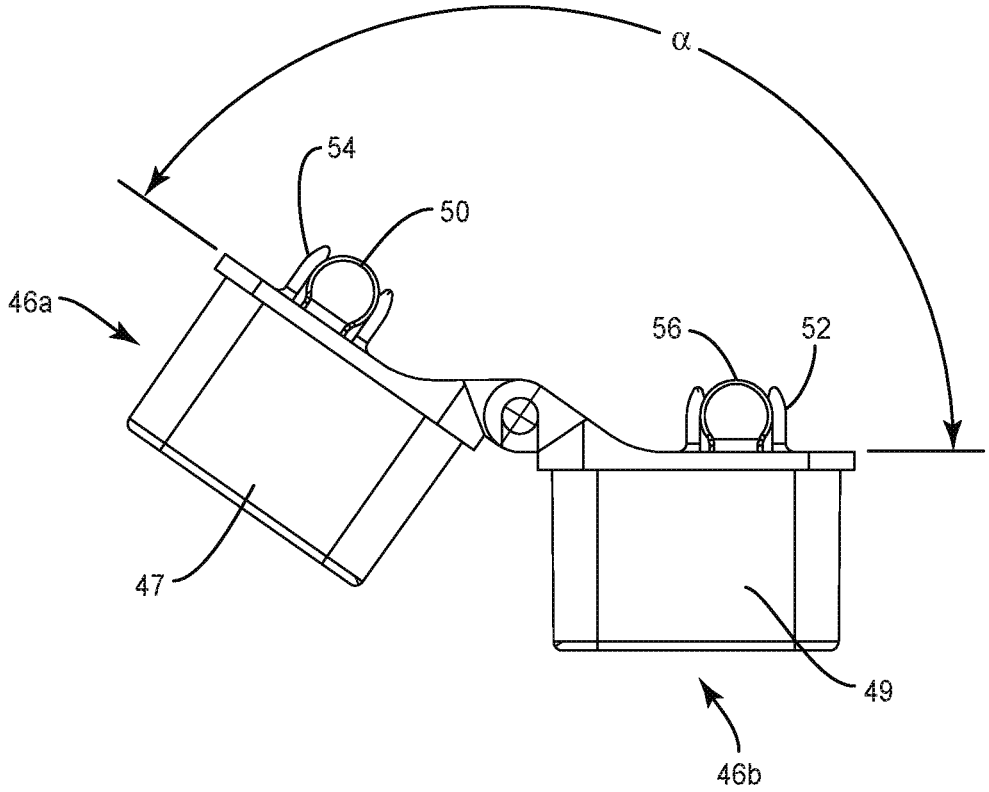
FIG. 7 is an end view of the component shown in FIG. 4.

In some embodiments, hinges 44 are coupled to inner surfaces of walls 34, 36 and sidewalls 38, 40, as shown in FIG. 3, for example. For example, a first portion of the hinge 44 that connects section 34*a* of wall 34 to sidewall 38 is fixed to the inner surface of sidewall 38 and a second portion of the hinge 44 that connects section 34*a* of wall 34 to sidewall 38 is fixed to the inner surface of top wall 34, as shown in FIG. 7. The hinges 44 that connect sections 34*b*, 36*a*, and 36*b* with sidewalls 38, 40 can be similarly positioned, as would be understood by one of ordinary skill in the art. In some embodiments, chassis 32 is monolithic and hinges 44 are living hinges. In such embodiments, interfaces between walls 34, 36 and sidewalls 38, 40 have a reduced thickness to allow walls 34, 36 to pivot relative to sidewalls 38, 40. In some embodiments, at least one of hinges 44 may include a barrel hinge, a pivot hinge, a mortise hinge, a case hinge, a piano hinge, a concealed hinge, a butterfly hinge, a flag hinge, a strap hinge, an H hinge, an HL hinge, a counter flap hinge, a flush hinge, a coach hinge, a rising butt hinge, a double action spring hinge, a tee hinge, a friction hinge, a security hinge, a cranked hinge, a lift-off hinge, or a self-closing hinge. In some embodiments, at least one of hinges 44 may include a hinge that is embedded within at least one of walls 34,36 and sidewalls 38,40. In some embodiments, at least one of hinges 44 may include a seatbelt like snap and release. In such embodiments, hinge 44 includes a male buckle end that snaps into a female buckle end.

Figure 3A:
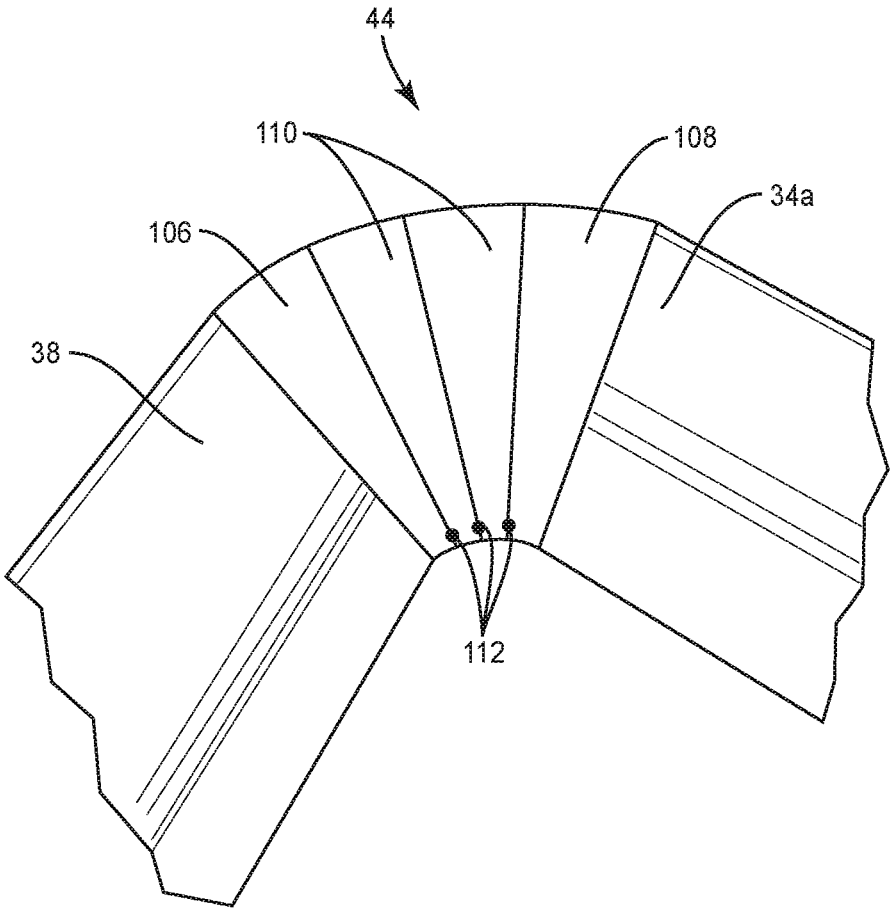
FIG. 3A is a perspective view of components of the mattress assembly shown in FIG. 1.

In some embodiments, as shown in FIG. 3A, one or more of hinges 44 may include a section 106 and a section 108. In some embodiments, section 106 is coupled to sidewall 38 and section 108 is coupled to section 34*a* of wall 34. In some embodiments, section 106 is coupled to sidewall 40 and section 108 is coupled to section 34*b* of wall 34. In some embodiments, section 106 is coupled to sidewall 38 and section 108 is coupled to section 36*a* of wall 36. In some embodiments, section 106 is coupled to sidewall 40 and section 108 is coupled to section 36*b* of wall 36. In some embodiments, section 106 is directly coupled to section 108. In some embodiments, hinge 44 includes one or a plurality of sections 110 that are positioned between section 106 and section 108. A pin 112 extends through sections 106 and 110 to allow section 106 to pivot relative to section 110. Likewise, a pin 112 extends through sections 108 and 110 to allow section 108 to pivot relative to section 110. In embodiments that include a plurality of sections 110, a pin 112 also extends through adjacent sections 110 to allow the adjacent sections 110 to pivot relative to one another. In some embodiments, as section 106 pivots relative to section 110, a portion of section 106 rotates within a cavity in section 110 and/or a portion of section 110 rotates within a cavity in section 106. In some embodiments, as section 108 pivots relative to section 110, a portion of section 108 rotates within a cavity in section 110 and/or a portion of section 110 rotates within a cavity in section 108. In some embodiments, as one of sections 110 pivots relative to another one of sections 110, a portion of one of sections 110 rotates within a cavity in another one of sections 110.

Section 34*a* of wall 34 is connected to section 34*b* of wall 34 by a mechanical bearing, such as, for example, a hinge 46 such that section 34*a* is pivotable relative to section 34*b*. Section 36*a* of wall 36 is connected to section 36*b* of wall 36 by a hinge 46 such that section 36*a* is pivotable relative to section 36*b*. In some embodiments, hinges 46 are identical or similar to hinges 44. In some embodiments, hinges 46 are different from hinges 44. In some embodiments, at least one of hinges 46 may include a barrel hinge, a pivot hinge, a mortise hinge, a case hinge, a piano hinge, a concealed hinge, a butterfly hinge, a flag hinge, a strap hinge, an H hinge, an HL hinge, a counter flap hinge, a flush hinge, a coach hinge, a rising butt hinge, a double action spring hinge, a tee hinge, a friction hinge, a security hinge, a cranked hinge, a lift-off hinge, or a self-closing hinge.

Figure 9:
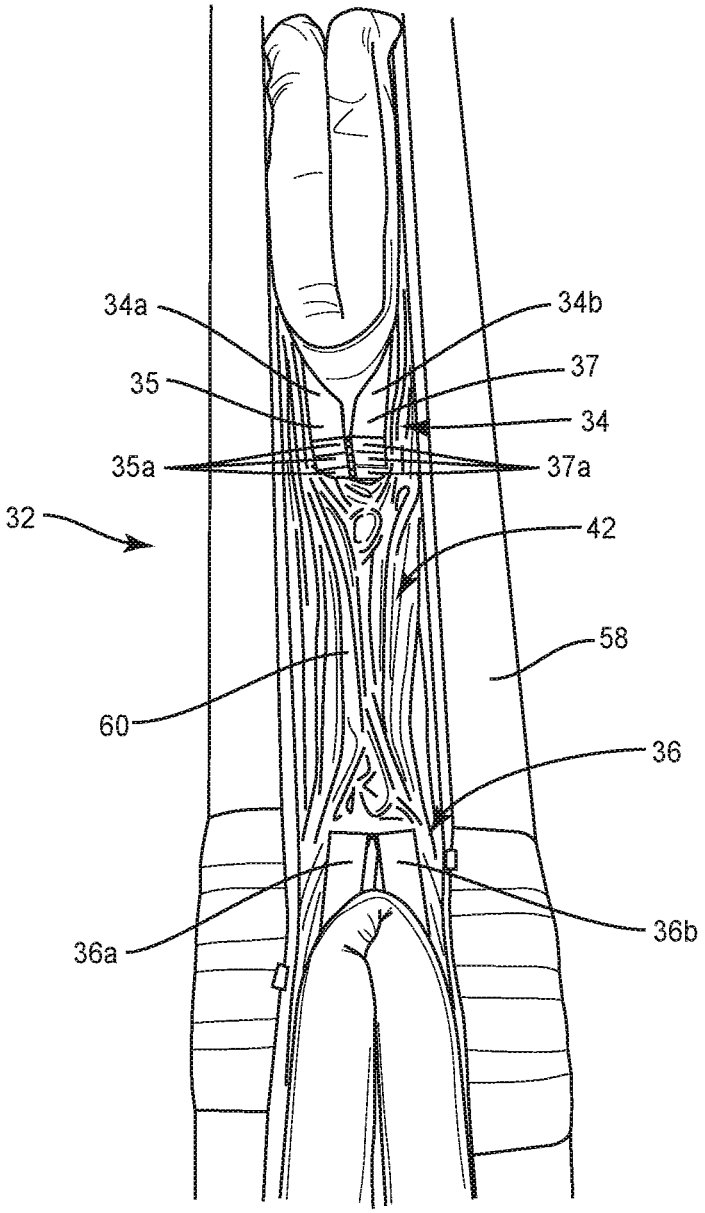
FIG. 9 is a perspective view of components of the mattress assembly shown in FIG. 1.

In some embodiments, an end 35 of section 34*a* includes a cavity 35*a* and an end 37 of section 34*b* include a cavity 37*a* (FIG. 9). Cavities 35*a*, 37*a* are each configured for disposal of a portion of one of hinges 46. In some embodiments, cavities 35*a*, 37*a* each include a single cavity. In some embodiments, cavities 35*a*, 37*a* each include a plurality of cavities. For example, in one embodiment, cavities 35*a*, 37*a* each include three cavities that are spaced apart from one another by a wall, as shown in FIG. 9.

Figure 4:
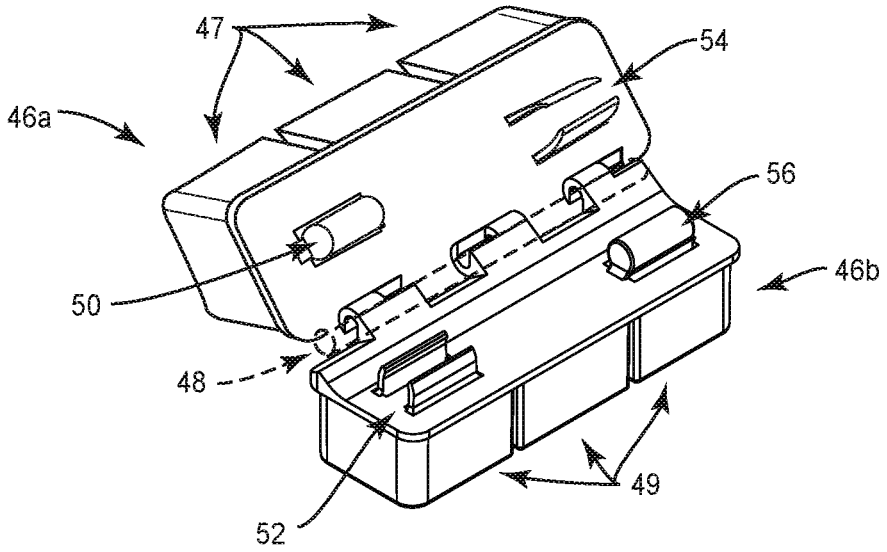
FIG. 4 is a perspective view, in part phantom, of a component of the mattress assembly shown in FIG. 1.
Figure 5:
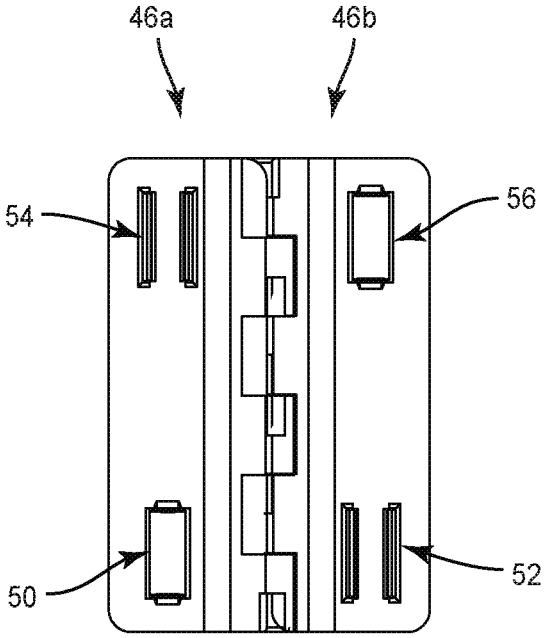
FIG. 5 is a top view of the component shown in FIG. 4.
Figure 6:
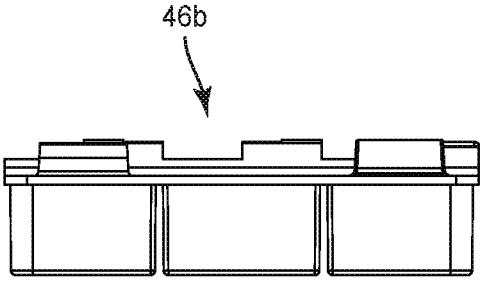
FIG. 6 is a side view of the component shown in FIG. 4.

In some embodiments, hinge 46 includes a first section 46*a* and a second section 46*b*, as shown in FIG. 4. A rod 48 extends through sections 46*a*, 46*b* to connect section 46*a* with section 46*b*. Section 46*a* is pivotable relative to section 46*b* about rod 48. Section 46*a* includes a plurality of spaced apart projections 47 that are configured for disposal in cavities 35*a* or cavities 37*a* and section 46*b* includes a plurality of spaced apart projections 49 that are configured for disposal in the other ones of cavities 35*a* or cavities 37*a*. Section 46*a* is pivotable relative to section 46*b* about rod 48 over a range $\alpha$, as shown in FIG. 7. In some embodiments, range $\alpha$ is between 0 and about 180 degrees, between 0 and about 175 degrees, between 0 and about 170 degrees, between 0 and about 165 degrees, between 0 and about 160 degrees, between 0 and about 155 degrees, between 0 and about 150 degrees, between 0 and about 145 degrees, between 0 and about 140 degrees, between 0 and about 135 degrees, between 0 and about 130 degrees, between 0 and about 125 degrees, between 0 and about 120 degrees, between 0 and about 115 degrees, between 0 and about 110 degrees, between 0 and about 105 degrees, between 0 and about 100 degrees, between 0 and about 95 degrees, or between 0 and about 90 degrees. When section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, section 34*a* of wall 34 extends parallel to section 34*b* of wall 34. When section 46*a* of hinge 46 that connects section 34*a* of wall 34 with section 34*b* of wall 34 is disposed at an angle greater than 0 degrees relative to section 46*b* of hinge 46 that connects section 34*a* of wall 34 with section 34*b* of wall 34, section 34*a* of wall 34 extends transverse to section 34*b* of wall 34.

In some embodiments, when section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, a planar surface of section 46*a* engages a planar surface of section 46*b*. In some embodiments, when section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, a locking element 50 of section 46*a* engages a locking element 52 of section 46*b* and a locking element 54 of section 46*a* engages a locking element 56 of section 46*b*. Locking element 50 comprises a cylindrical component that is positioned between spaced apart arms of locking element 52 and locking element 56 comprises a cylindrical component that is positioned between spaced apart arms of locking element 54. The arms of locking element 52 are resilient such that the arms of locking element 52 move apart from one another as the cylindrical component of locking element 50 is inserted between the arms of locking element 52. The arms of locking element 52 move towards one another when the cylindrical component of locking element 50 is inserted between the arms of locking element 52 to prevent the cylindrical component of locking element 50 from moving out of the space between the arms of locking element 52. Likewise, the arms of locking element 54 are resilient such that the arms of locking element 54 move apart from one another as the cylindrical component of locking element 56 is inserted between the arms of locking element 54. The arms of locking element 54 move towards one another when the cylindrical component of locking element 56 is inserted between the arms of locking element 54 to prevent the cylindrical component of locking element 56 from moving out of the space between the arms of locking element 54. This configuration provisionally fixes section 46*a* of hinge 46 that connects section 34*a* of wall 34 with section 34*b* of wall 34 relative to section 46*b* of hinge 46 that connects section 34*a* of wall 34 with section 34*b* of wall 34 when section 46*a* is disposed at an angle of 0 degrees relative to section 46*b*. That is, a force is required to pivot section 46*a* relative to section 46*b* to move the cylindrical portion of locking element 50 out of the space between the arms of locking element 52 and to move the cylindrical portion of locking element 56 out of the space between the arms of locking element 54. As the cylindrical portion of locking element 50 moves out of the space between the arms of locking element 52, the arms of locking element 52 move apart from one another and then snap back after the cylindrical portion of locking element 50 is removed from the space between the arms of locking element 52. As the cylindrical portion of locking element 56 moves out of the space between the arms of locking element 54, the arms of locking element 54 move apart from one another and then snap back after the cylindrical portion of locking element 56 is removed from the space between the arms of locking element 54. In some embodiments, second 46*a* includes only one locking element, such as, for example, locking element 50 and section 46*b* includes only one locking element, such as, for example, locking element 52.

In some embodiments, an end 39 of section 36*a* includes a cavity similar or identical to cavity 35*a* and an end 41 of section 36*b* include a cavity similar or identical to cavity 37*a*. The cavities in ends 39, 41 are each configured for disposal of a portion of hinge 46. In some embodiments, the cavities in ends 39, 41 each include a single cavity. In some embodiments, the cavities in ends 39, 41 each include a plurality of cavities. For example, in one embodiment, the cavities in ends 39, 41 each include three cavities that are spaced apart from one another by a wall.

Projections 47 of one of hinges 46 are configured for disposal in the cavities in end 39 or the cavities in end 41 and projections 49 of one of hinges 46 are configured for disposal in the other ones of the cavities in end 39 or the cavities in end 41. When section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, section 36*a* of wall 36 extends parallel to section 36*b* of wall 36. When section 46*a* of hinge 46 that connects section 36*a* of wall 36 with section 36*b* of wall 36 is disposed at an angle greater than 0 degrees relative to section 46*b* of hinge 46 that connects section 36*a* of wall 36 with section 36*b* of wall 36, section 36*a* of wall 36 extends transverse to section 36*b* of wall 36.

In some embodiments, when section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, a planar surface of section 46*a* engages a planar surface of section 46*b*. In some embodiments, when section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, locking element 50 of section 46*a* engages locking element 52 of section 46*b* and locking element 54 of section 46*a* engages locking element 56 of section 46*b*.

The configuration of hinge 46 that connects section 36*a* of wall 36 with section 36*b* of wall 36 provisionally fixes section 46*a* relative to section 46*b* when section 46*a* is disposed at an angle of 0 degrees relative to section 46*b*. That is, a force is required to pivot section 46*a* relative to section 46*b* to move the cylindrical portion of locking element 50 out of the space between the arms of locking element 52 and to move the cylindrical portion of locking element 56 out of the space between the arms of locking element 54. As the cylindrical portion of locking element 50 moves out of the space between the arms of locking element 52, the arms of locking element 52 move apart from one another and then snap back after the cylindrical portion of locking element 50 is removed from the space between the arms of locking element 52. As the cylindrical portion of locking element 56 moves out of the space between the arms of locking element 54, the arms of locking element 54 move apart from one another and then snap back after the cylindrical portion of locking element 56 is removed from the space between the arms of locking element 54.

Figure 7A:
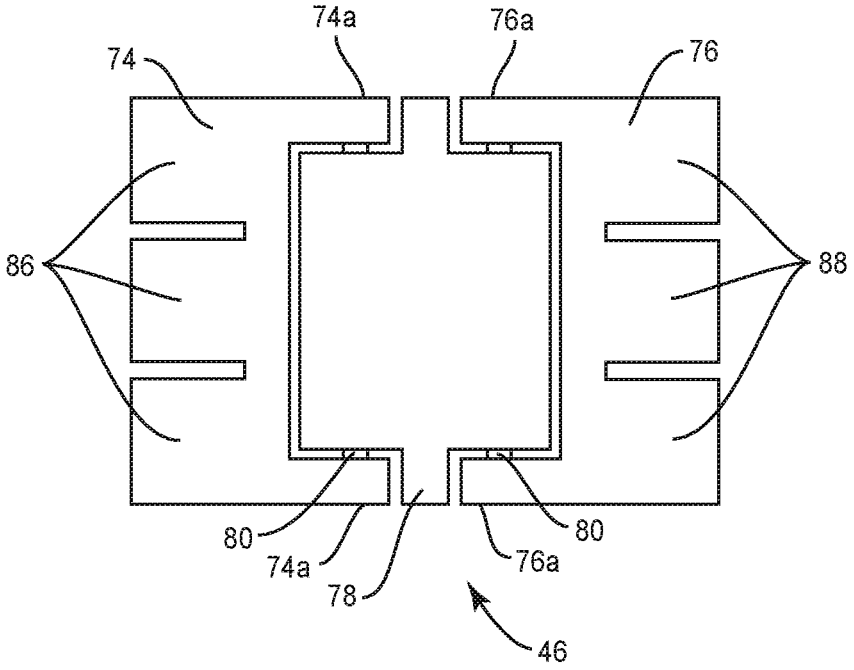
FIG. 7A is a side view of one embodiment of a component of the mattress assembly shown in FIG. 1.
Figure 7B:
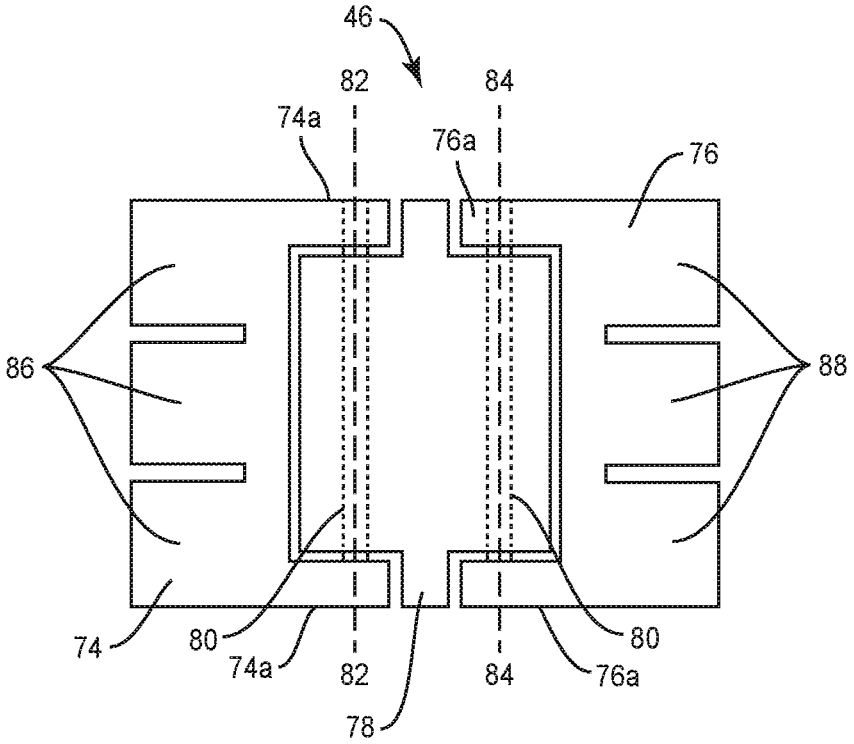
FIG. 7B is a side view, in part phantom, of the component shown in FIG. 7A.
Figure 8:
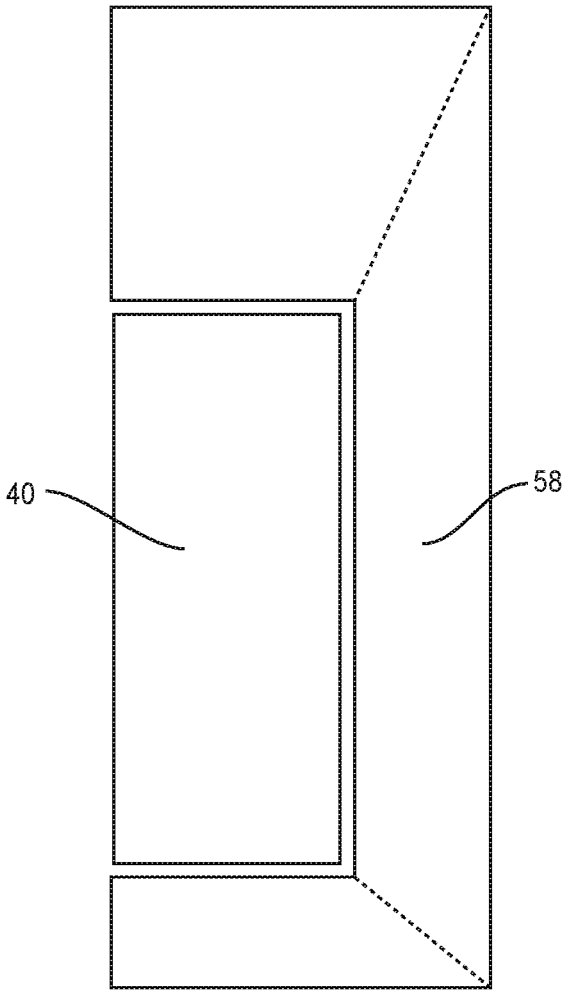
FIG. 8 is a side, cross sectional view of components of the mattress assembly shown in FIG. 1.

In some embodiments, shown in FIGS. 7A and 7B, hinge 46 includes a first section 74, a second section 76 and a middle section 78 between sections 74, 76. Section 74 includes a pair of spaced apart flanges 74*a* and section 76 includes a pair of spaced apart flanges 76*a*. A pin 80 extends through flanges 74*a* and section 78 such that section 74 is pivotable relative to section 78 about a pivot axis 82 defined by pin 80. Likewise, a pin 80 extends through flanges 76*a* and section 78 such that section 76 is pivotable relative to section 78 about a pivot axis 84 defined by the pin 80 that extends through flanges 76*a* and section 78. Section 74 includes a plurality of spaced apart projections 86 that are configured for disposal in cavities 35*a* or cavities 37*a* and section 76 includes a plurality of spaced apart projections 88 that are configured for disposal in the other ones of cavities 35*a* or cavities 37*a*.

In some embodiments, an end 39 of section 36*a* includes a cavity similar or identical to cavity 35*a* and an end 41 of section 36*b* include a cavity similar or identical to cavity 37*a*. The cavities in ends 39, 41 are each configured for disposal of a portion of hinge 46. In some embodiments, the cavities in ends 39, 41 each include a single cavity. In some embodiments, the cavities in ends 39, 41 each include a plurality of cavities. For example, in one embodiment, the cavities in ends 39, 41 each include three cavities that are spaced apart from one another by a wall.

Projections 47 of one of hinges 46 are configured for disposal in the cavities in end 39 or the cavities in end 41 and projections 49 of one of hinges 46 are configured for disposal in the other ones of the cavities in end 39 or the cavities in end 41. When section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, section 36*a* of wall 36 extends parallel to section 36*b* of wall 36. When section 46*a* of hinge 46 that connects section 36*a* of wall 36 with section 36*b* of wall 36 is disposed at an angle greater than 0 degrees relative to section 46*b* of hinge 46 that connects section 36*a* of wall 36 with section 36*b* of wall 36, section 36*a* of wall 36 extends transverse to section 36*b* of wall 36.

In some embodiments, mattress assembly 30 does not include a cover or any material that is applied to the outer surfaces of walls 34, 36 and sidewalls 38, 40. In such embodiments, the outer surfaces of walls 34, 36 and sidewalls 38, 40 define an outermost surface of mattress assembly 30. In some embodiments, chassis 32 comprises a cover 58 that covers at least the outer surfaces of walls 34, 36 and sidewalls 38, 40 such that cover 58 defines an outermost surface of mattress assembly 30. In some embodiments, cover 58 may also cover the upper and lower surfaces of walls 34, 36 and sidewalls 38, 40. For example, cover 58 covers the upper and lower surfaces of sidewall 40 in FIG. 8. As would be apparent to one of ordinary skill in the art, cover 58 can also be configured to cover the upper and lower surfaces of walls 34, 36 and sidewall 38 in the same manner that cover 58 covers the upper and lower surfaces of sidewall 40 in FIG. 8. Walls 34, 36 and sidewalls 38, 40 will thus be spaced apart from the box spring by cover 58 when mattress assembly 30 is positioned on top of the box spring. Chassis 32 is shown in FIGS. 1-3, 12, 16 and 19 without cover, for clarity. Cover 58 is shown in FIGS. 8-11 and 13 to show how cover 58 is positioned on walls 34, 36 and sidewalls 38, 40. In some embodiments, cover 58 covers at least one of hinges 44 and/or hinges 46. In some embodiments, cover 58 comprises a fabric, such as, for example, stretch fabric.

Figure 10:
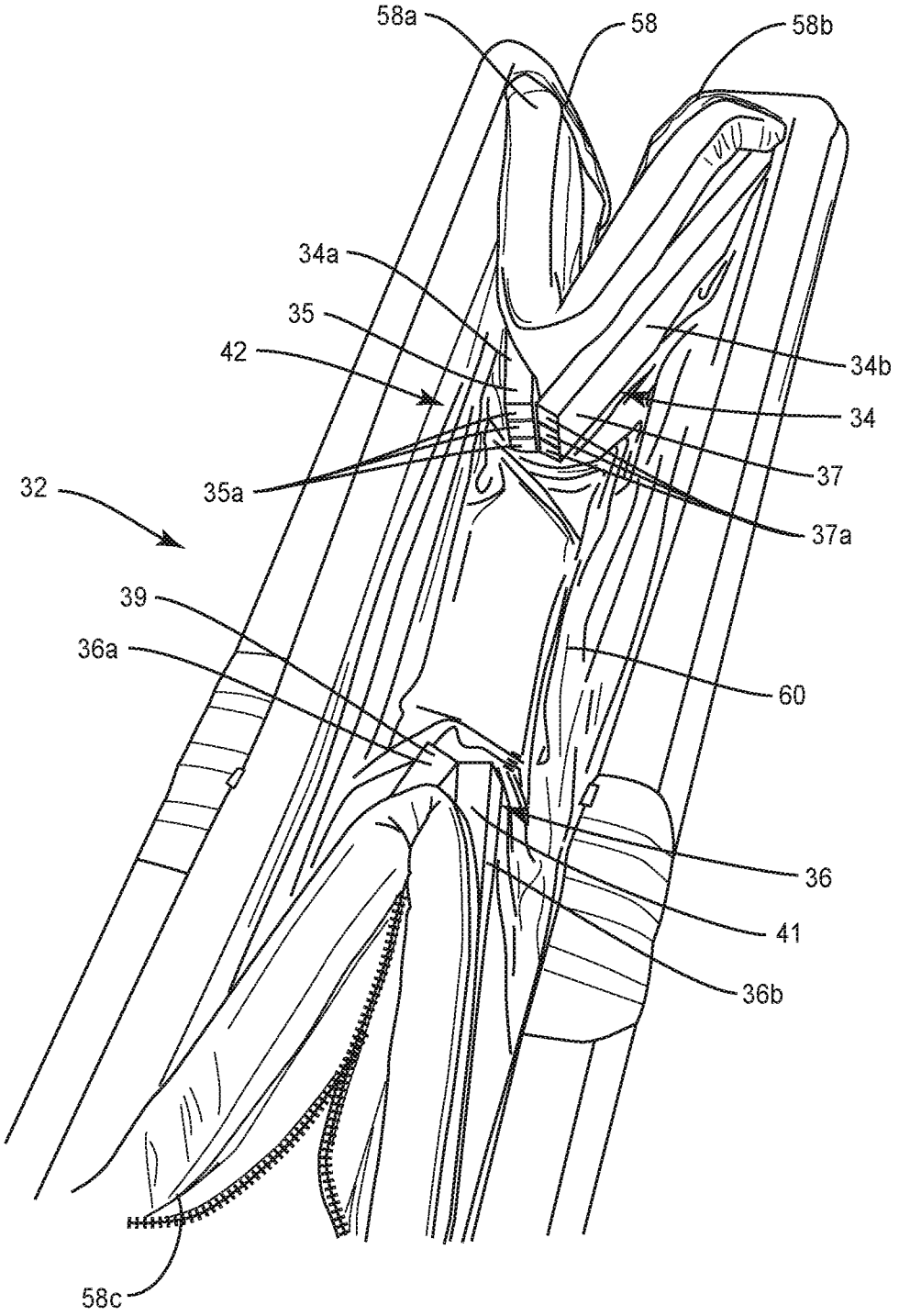
FIG. 10 is a perspective view of components of the mattress assembly shown in FIG. 1.

In some embodiments, cover 58 comprises a cushioning material 58*a* within a fabric pocket, as shown in FIG. 10, for example. In some embodiments, cushioning material 58*a* is a fiber foam-cushioning layer that is disposed about the inner, upper and lower surfaces of walls 34, 36 and sidewalls 38, 40. Cushioning material 58*a* is disposed in a fabric pocket 58*b*. In some embodiments, cover 58 is permanently fixed to walls 34, 36 and sidewalls 38, 40 such that cover 58 cannot be removed from walls 34, 36 and sidewalls 38, 40 without destroying or otherwise damaging cover 58. In some embodiments, cover 58 is removeably coupled to walls 34, 36 and sidewalls 38, 40 to allow cover 58 to be removed from walls 34, 36 and sidewalls 38, 40 in order to clean cover 58, for example.

In some embodiments, interior cavity 42 extends continuously through opposite upper and lower surfaces of walls 34, 36 and sidewalls 38, 40. In some embodiments, chassis 32 comprises a base layer 60 that extends from the lower surfaces of walls 34, 36 and sidewalls 38, 40 to define a lower limit of interior cavity 42. Base layer 60 extends continuously from wall 34 to wall 36 and from sidewall 38 to sidewall 40. Walls 34, 36 and sidewalls 38, 40 define a perimeter of chassis 32. Base layer 60 perimetrically bounds chassis 32. Base layer 60 is permanently fixed to walls 34, 36 and sidewalls 38, 40 such that base layer cannot be removed from walls 34, 36 and sidewalls 38, 40 without destroying or otherwise damaging base layer 60. This allows base layer 60 to move with walls 34, 36 and/or sidewalls 38, 40 as sections 34*a*, 34*b* of wall 34 move relative to one another and sections 36*a*, 36*b* of wall 36 move relative to one another and/or sidewalls 38, 40 move relative to walls 34, 36, as discussed herein.

In some embodiments, base layer 60 includes a plurality of zones wherein each of the zones has a different permeability. For example, base layer 60 may include a first zone 60*a*, a second zone 60*b* and a third zone 60*c*, as shown in FIG. 11A. Zone 60*a* is more or less permeable than zone 60*b* and zone 60*b* is more or less permeable than zone 60*c*. This configuration allows air to move more quickly through certain portions of base layer 60 than other portions of base layer 60. This may facilitate moving air away from a sleep surface defined by a mattress topper to prevent heat from building up on the sleep surface. That is, the permeability of at least one of zones 60*a*, 60*b*, 60*c* will allow air to move downward from the sleep surface and to exit mattress assembly 30 through base layer 60.

Figure 2:
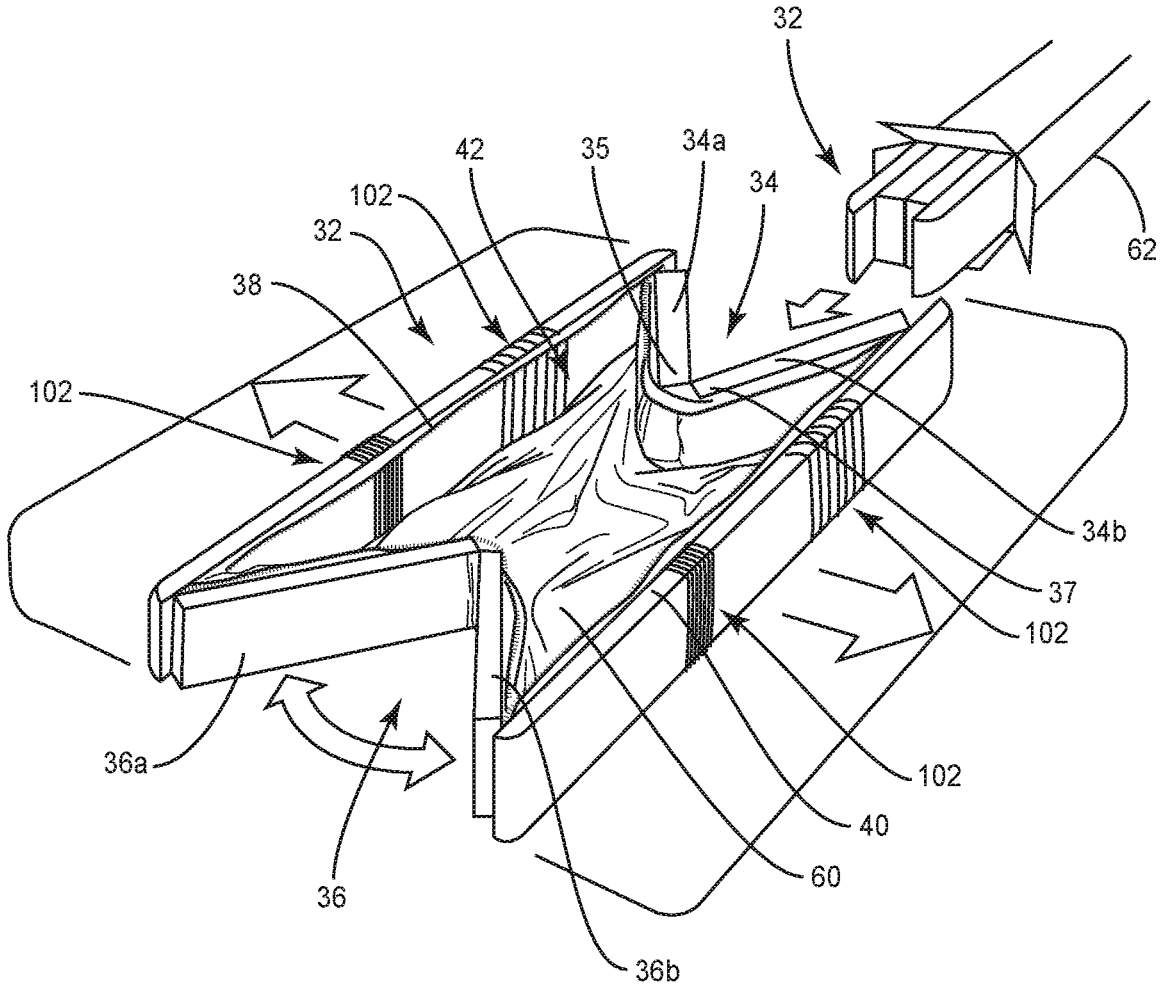
FIG. 2 is a perspective view of components of the mattress assembly shown in FIG. 1.

Chassis 32 is configured to be packaged in a container, such as, for example, a box 62 shown in FIG. 2. Box 62 has a size that permits box 62 to be shipped via ground shipping. That is, box 62 does not need to be shipped as freight. For example, box 62 may be less than 165 inches in length and girth combined. In some embodiments, box 62 is less than 108 inches in length. In some embodiments, box 62 is about 12"×12"×80" and weighs less than 125 when chassis 32 is packaged within box 62. This allows box 62 to be shipped as a United Parcel Service (UPS) small pack, for example.

When chassis 32 is packaged within box 62, chassis 32 is in a compacted configuration such that sections 34*a*, 34*b* of wall 34 and sections 36*a*, 36*b* of wall 36 each extend parallel to sidewalls 38, 40 and sidewalls 38, 40 extend parallel to one another, as shown in FIG. 2. Chassis 32 may be positioned on top of the box spring and moved from the compacted configuration to an expanded configuration. To move chassis 32 from the compacted configuration to the expanded configuration, sections 34*a*, 36*a* of walls 34, 36 are pivoted about hinges 44 to pivot sections 34*a*, 36*a* relative to sidewall 38 and sections 34*b*, 36*b* of walls 34, 36 are pivoted about hinges 44 to pivot sections 34*b*, 36*b* relative to sidewall 40 such that sections 34*a*, 34*b*, 36*a*, 36*b* each extend at an acute angle relative to sidewalls 38, 40, as shown in FIGS. 2, 9 and 10. As sections 34*a*, 34*b*, 36*a*, 36*b* pivot relative to sidewalls 38, 40, section 34*a* of wall 34 pivots relative to section 34*b* of wall 34 about hinge 46 that connects sections 34*a*, 34*b* and section 36*a* of wall 36 pivots relative to section 36*b* of wall 36 about hinge 46 that connects sections 36*a*, 36*b* such that section 34*a* extends transverse to section 34*b* and section 36*a* extends transverse to section 36*b*, as also shown in FIGS. 2, 9 and 10.

Figure 11:
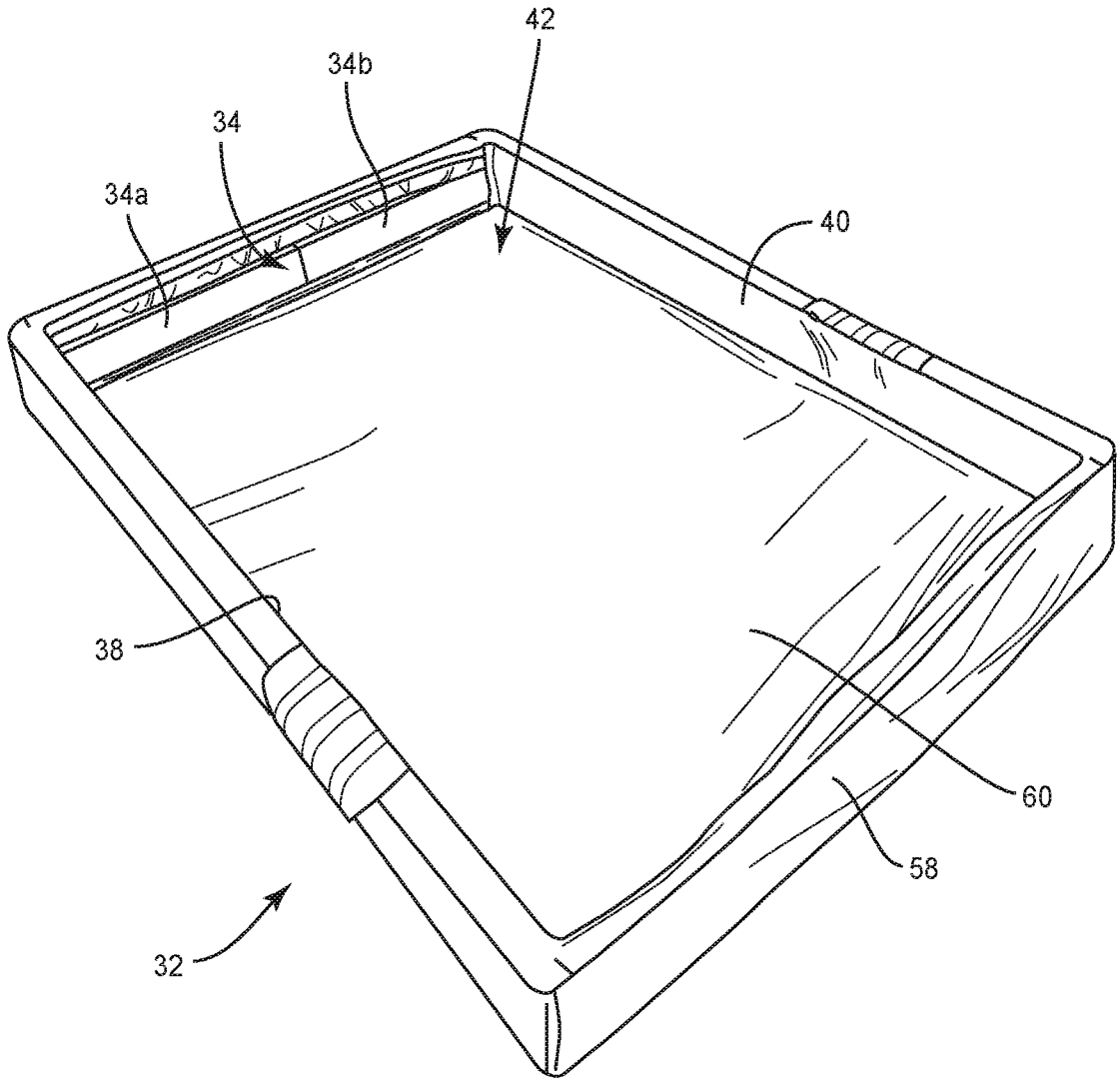
FIG. 11 is a perspective view of components of the mattress assembly shown in FIG. 1.
Figure 11A:
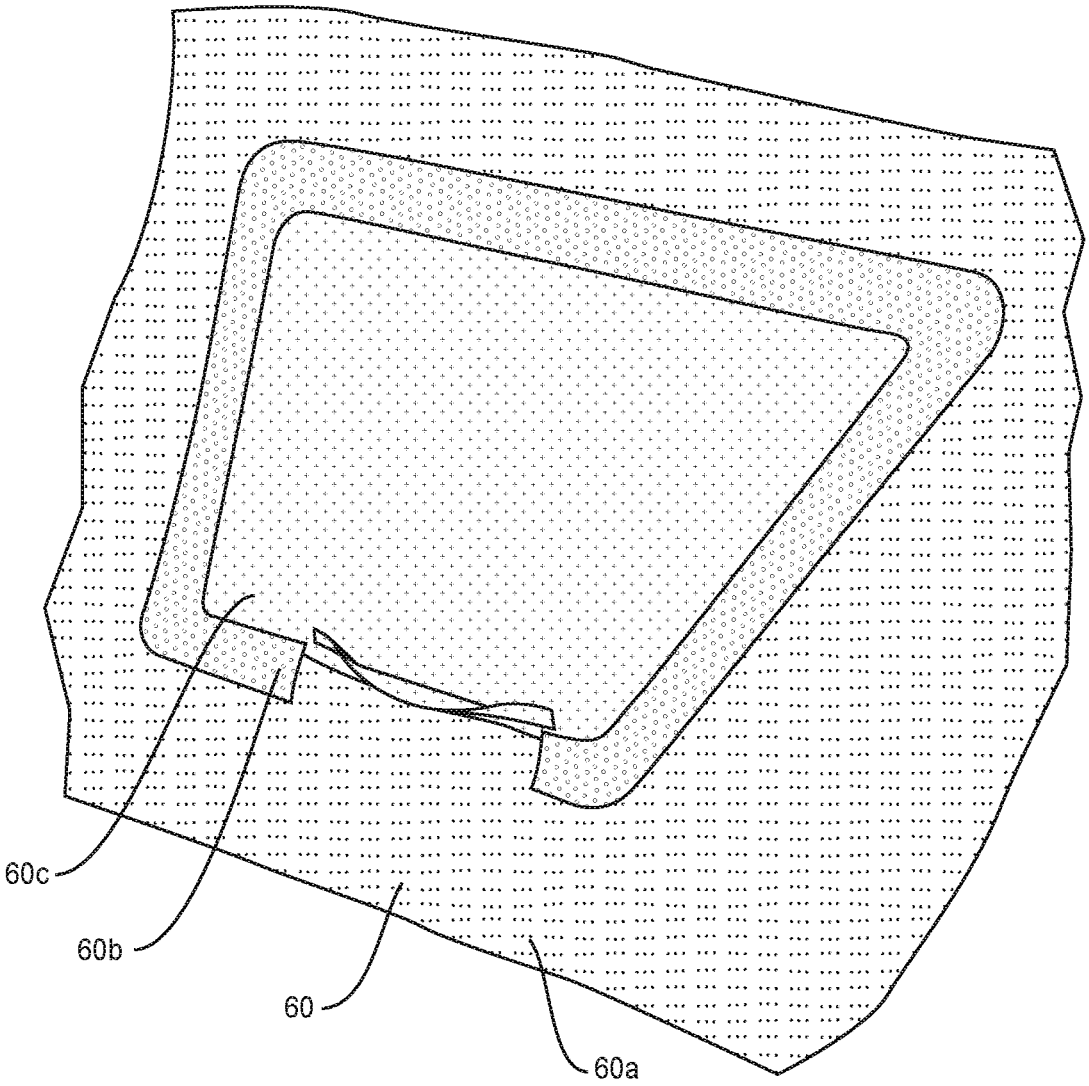
FIG. 11A is a top view of one embodiment of a component of the mattress assembly shown in FIG. 1.
Figure 12:
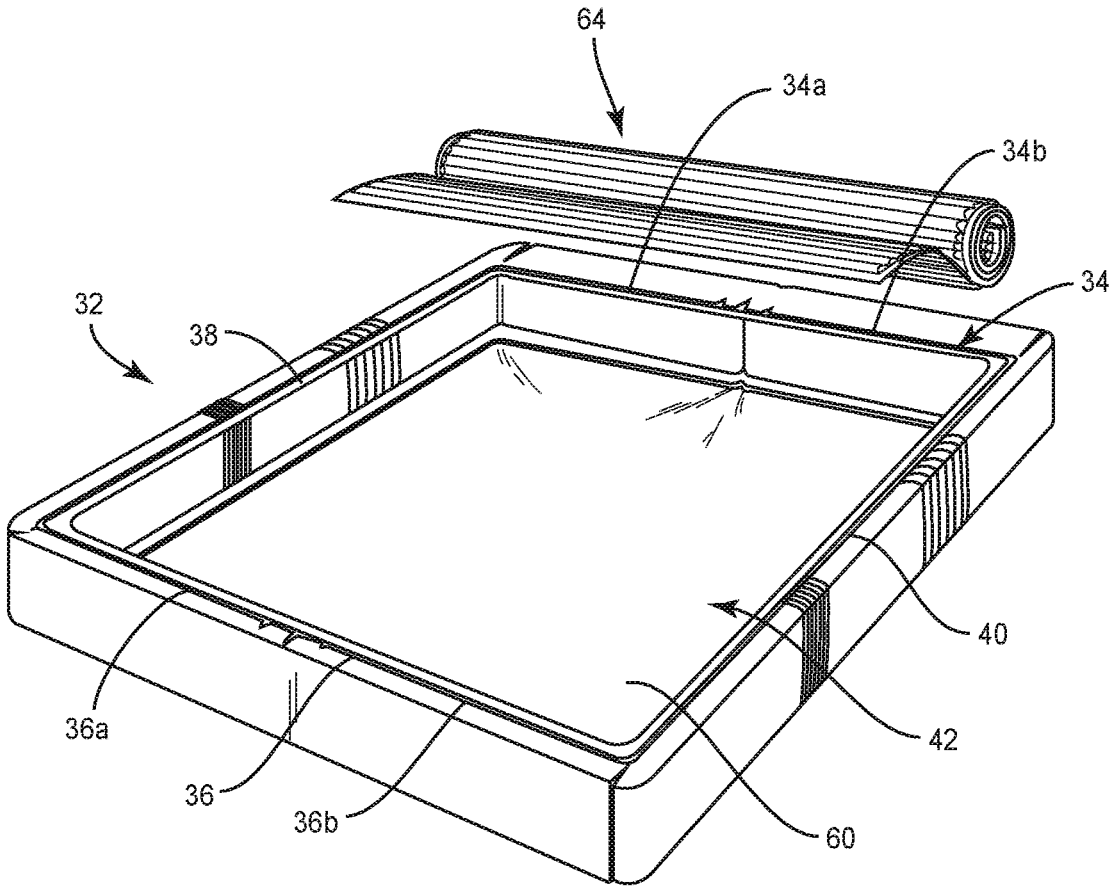
FIG. 12 is a perspective view of components of the mattress assembly shown in FIG. 1.
Figure 13:
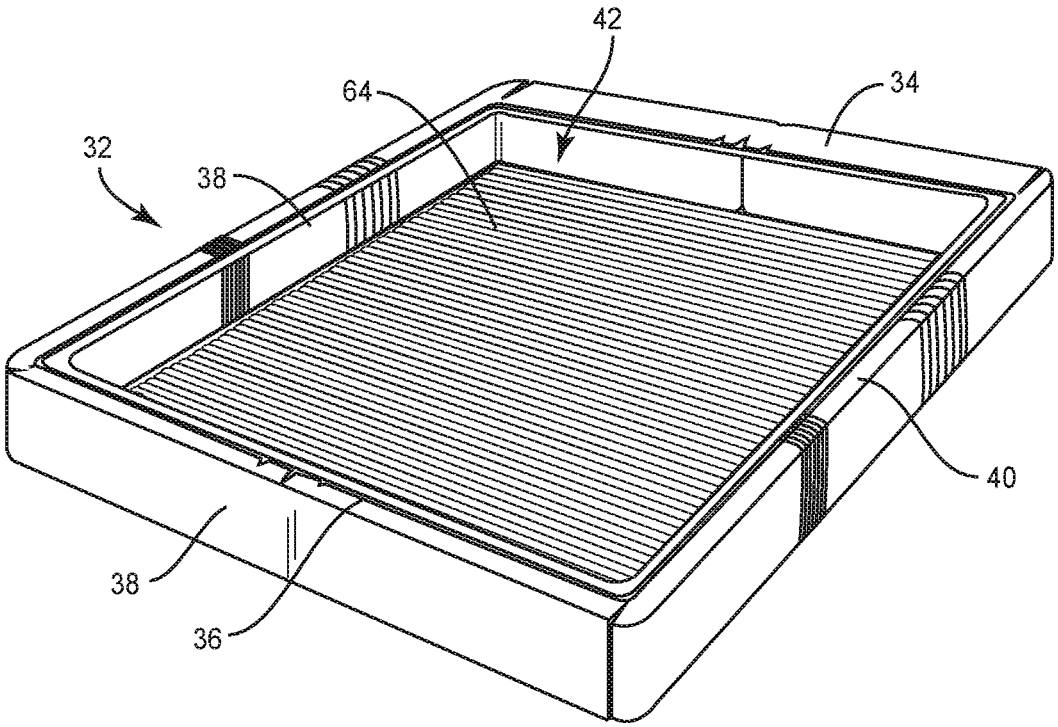
FIG. 13 is a perspective view of components of the mattress assembly shown in FIG. 1.

Sections 34*a*, 34*b*, 36*a*, 36*b* are pivoted relative to sidewalls 38, 40 about hinges 44, section 34*a* is pivoted relative to section 34*b* about hinge 46 that connects sections 34*a*, 34*b* and section 36*a* is pivoted relative to section 36*b* about hinge 46 that connects section 36*a*, 36*b* until sections 34*a*, 34*b* extend parallel to one another, sections 36*a*, 36*b* extend parallel to one another and sections 34*a*, 34*b*, 36*a*, 36*b* extend perpendicular to sidewalls 38, 40, as shown in FIGS. 11-13. When sections 34*a*, 34*b* extend parallel to one another, sections 36*a*, 36*b* extend parallel to one another and sections 34*a*, 34*b*, 36*a*, 36*b* extend perpendicular to sidewalls 38, 40, chassis 32 is in the expanded configuration.

In some embodiments, one or a plurality of spring packs are positioned on top of base layer 60 such that bottom surfaces of the spring packs engage a top surface of base layer 60. In some embodiments, chassis 32 includes a tambor 64 that is removeably positioned within interior cavity 42 when chassis 32 is in the expanded configuration. Tambor 64 is movable between a rolled configuration, shown in FIG. 12 and an unrolled configuration, shown in FIG. 13. In some embodiments, tambor 64 may be packaged in box 62 with the other components of chassis 32 (e.g., walls 34, 36, sidewalls 38, 40, cover 58 and base layer 60). Including tambor 64 in box 62 will not increase the size of box from that discussed above and will not cause box 62 to weigh more than 125 pounds. Tambor 64 is packaged within box 62 when tambor 64 is in the rolled configuration. Tambor 64 may be positioned within interior cavity 42 on top of base layer 60 in the rolled configuration and then moved from the rolled configuration to the unrolled configuration, as shown in FIG. 13.

Figure 14:
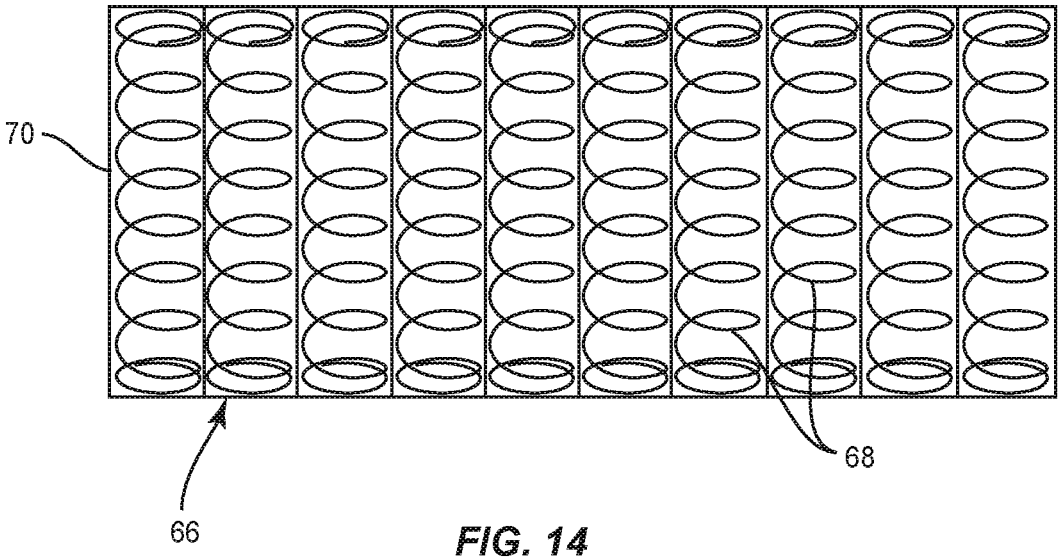
FIG. 14 is a side view, in part phantom, of one embodiment of a component of the mattress assembly shown in FIG. 1, in accordance with the principles of the present disclosure.
Figure 15:
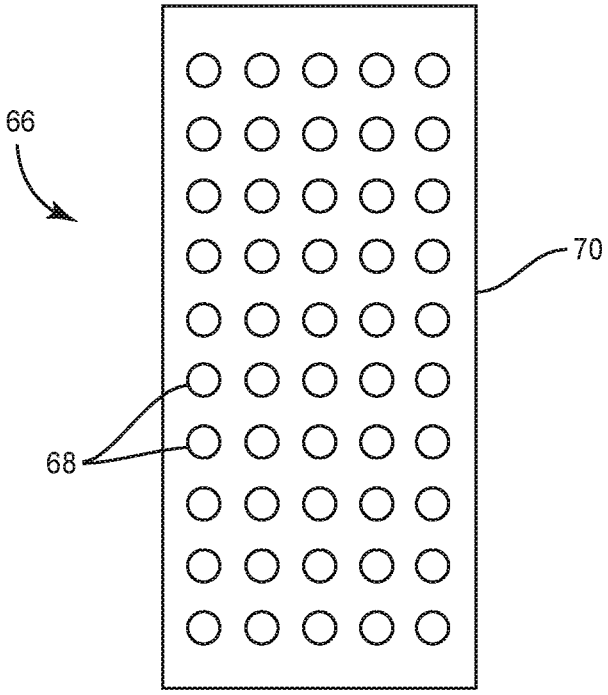
FIG. 15 is a top view, in part phantom, of the component of the mattress assembly shown in FIG. 14.
Figure 16:
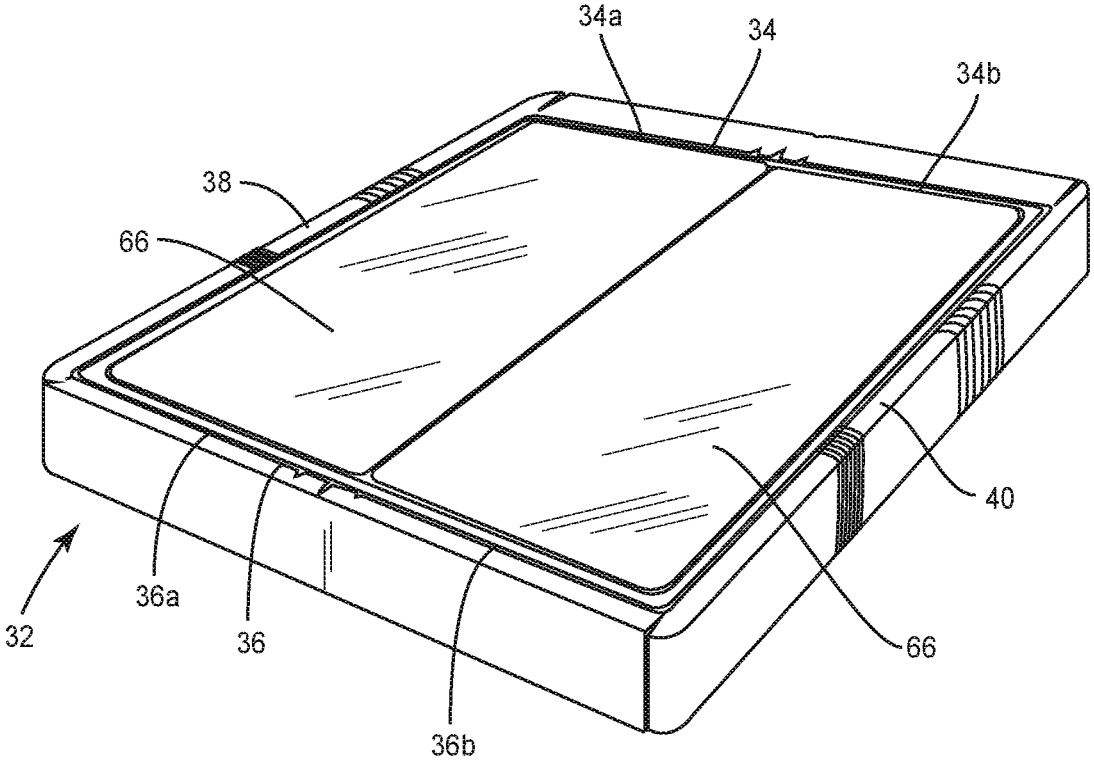
FIG. 16 is a perspective view of components of the mattress assembly shown in FIG. 1.

As shown in FIGS. 14-16, one or a plurality of spring packs, such as, for example, spring pack 66 is/are positioned within interior cavity 42. In embodiments that do not include tambor 64 or base layer 60, spring pack 66 is positioned directly on top of the box spring such that a bottom surface of spring pack 66 engages the top surface of the box spring. In embodiments that do not include tambor 64, spring pack 66 is positioned directly on top of base layer 60 such that the bottom surface of spring pack 66 engages the top surface of base layer 60. In embodiments that include tambor 64, spring pack 66 is positioned directly on top of tambor 64 such that the bottom surface of spring pack 66 engages the top surface of tambor 64. When spring pack 66 is positioned within interior cavity 42, side surfaces of spring pack 66 engage the inner surfaces of walls 34, 36 and sidewalls 38, 40 that define interior cavity 42.

In some embodiments, spring pack 66 comprises a plurality of springs 68 positioned within a pouch 70. Springs 68 are enclosed within pouch 70. Spring pack 66 comprises one or a plurality of rows of springs 68 and one or a plurality of columns of springs 68. As shown in FIG. 15, spring pack includes a plurality of rows of springs 68 and a plurality of columns of springs 68. In some embodiments, spring pack 66 includes a plurality of strings of springs, as described in U.S. Patent Application No. 62/347,199 to the inventor of the current application, which is incorporated by reference herein, in its entirety. In some embodiments, springs 68 are each positioned within a pocket, such as, for example, a fabric pocket. The pockets may be coupled to one another to form a string of pockets that each include one of springs 68 therein. In some embodiments, the sting of pockets includes one or more slits between adjacent pockets to allow springs 68 to move independently of one another. In some embodiments, the sting of pockets includes one or more slits that extend through a top surface of the string of pockets between adjacent pockets and/or one or more slits that extend through a bottom surface of the string of pockets between adjacent pockets.

In some embodiments, spring pack 66 includes two spring packs 66*a*, 66*b*, as shown in FIG. 16. Spring pack 66*a* is positioned on one side of mattress assembly 30 and spring pack 66*b* is positioned on an opposite side of mattress assembly 30. In some embodiments, spring pack 66*a* is identical to spring pack 66*b*. In some embodiments, spring pack 66*a* includes springs 68 that are different from springs 68 of spring pack 66*b* such that spring pack 66*a* is more or less firm than spring pack 66*b*. In some embodiments, springs 68 of spring pack 66*a* may include more or less coils than springs 68 of spring pack 66*b*. In some embodiments, springs 68 of spring pack 66*a* may include coils having a different gauge than the coils of springs 68 of spring pack 66*b*. In some embodiments, springs 68 of spring pack 66*a* may include different coils than the coils of springs 68 of spring pack 66*b*. For example, springs 68 of spring pack 66*a* may include continuous coils, bonnell coils, offset coils and marshall coils and spring pack 66*b* may include springs 68 having coils that are different than the coils of springs 68 of spring pack 66*a*. Using different springs 68 in spring pack 66*a* than spring pack 66*b* allows mattress assembly 30 to be customized based on preference. For example, if a sleeper that sleeps on the side of mattress assembly 30 adjacent sidewall 38 desires a firmer sleep surface than a sleeper that sleeps on the side of mattress assembly 30 adjacent sidewall 40, spring pack 66*a* can be configured to be firmer than spring pack 66*b*. Likewise, if the sleeper that sleeps on the side of mattress assembly 30 adjacent sidewall 38 desires a sleep surface that is less firm than the sleeper that sleeps on the side of mattress assembly 30 adjacent sidewall 40, spring pack 66*a* can be configured to be less firm than spring pack 66*b*.

Figure 17:
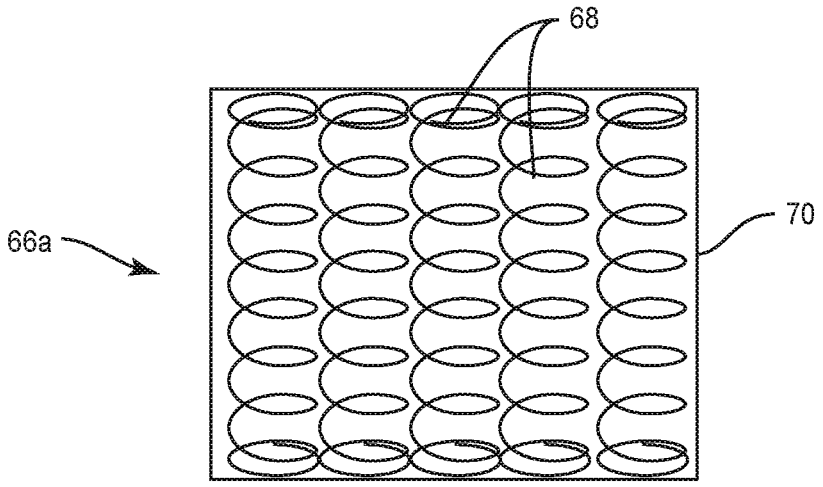
FIG. 17 is a side view, in part phantom, of one embodiment of a component of the mattress assembly shown in FIG. 1, in accordance with the principles of the present disclosure.
Figure 18:
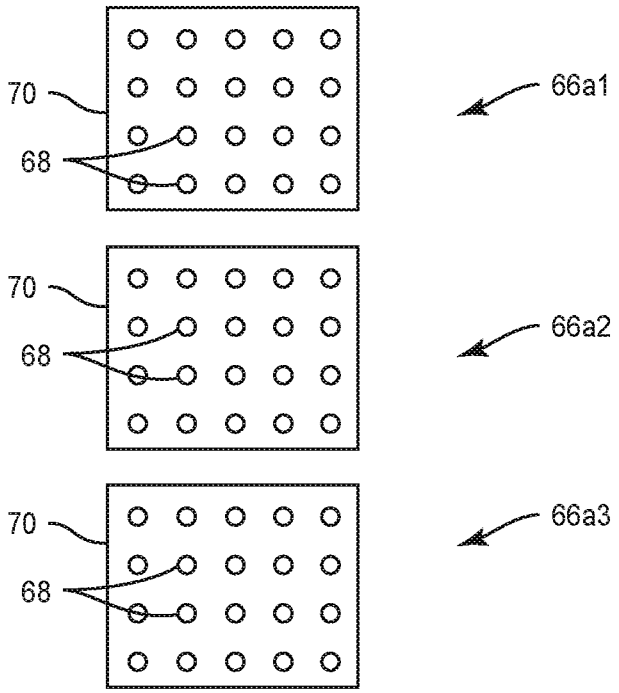
FIG. 18 is a top view, in part phantom, of the component of the mattress assembly shown in FIG. 17.
Figure 19:
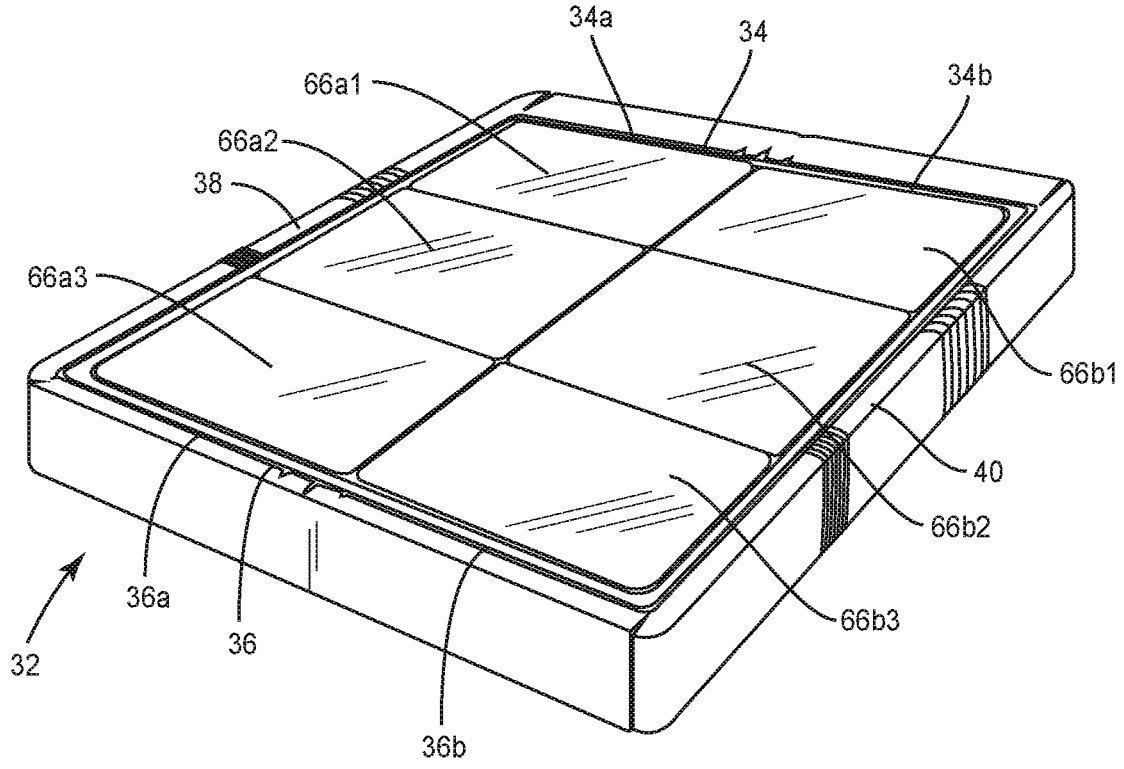
FIG. 19 is a perspective view of components of the mattress assembly shown in FIG. 17.

In some embodiments, at least one of spring packs 66*a*, 66*b* include a plurality of spring packs, as shown in FIGS. 17-19. For example, spring pack 66*a* may include a first spring pack 66*a*1, a second spring pack 66*a*2 and a third spring pack 66*a*3. Likewise, spring pack 66*b* may include a first spring pack 66*b*1, a second spring pack 66*b*2 and a third spring pack 66*b*3. Spring packs 66*a*1, 66*b*1 are configured to be positioned adjacent wall 34; spring packs 66*a*3, 66*b*3 are configured to be positioned adjacent wall 36; and spring packs 66*a*3, 66*b*3 are configured to be positioned between spring packs 66*a*1, 66*a*3 and between spring packs 66*b*1, 66*b*3, as shown in FIG. 19. Spring packs 66*a*1, 66*b*1 are each configured to support a sleeper's head and/or upper body; spring packs 66*a*2, 66*b*2 are each configured to support a sleeper's torso and/or core; and spring packs 66*a*3, 66*b*3 are each configured to support a sleeper's legs and/or lower body.

In some embodiments, spring pack 66*a*1 is identical to spring pack 66*a*2 and spring pack 66*a*3. In some embodiments, spring pack 66*a*1 includes springs 68 that are different than springs 68 of spring pack 66*a*2 and/or spring pack 66*a*3 such that spring pack 66*a*1 is more or less firm than spring pack 66*a*2 and/or spring pack 66*a*3. That is, spring packs 66*a*1, 66*a*2, 66*a*3 can all have the same firmness, or one of spring packs 66*a*1, 66*a*2, 66*a*3 can have a firmness that is different from at least one of spring packs 66*a*1, 66*a*2, 66*a*3. As such, spring packs 66*a*1, 66*a*2, 66*a*3 can each have a different firmness, if desired. This allows a sleeper to select a spring pack 66*a*1 that has the firmness he or she desires to support his or her head and/or upper body, a spring pack 66*a*2 that has a firmness he or she desires to support his or her torso and/or core and a spring pack 66*a*3 that has a firmness he or she desires to support his or her legs and/or lower body. In some embodiments, springs 68 of spring pack 66*a*1 may include more or less coils than springs 68 of spring pack 66*a*2 and/or spring pack 66*a*3. In some embodiments, springs 68 of spring pack 66*a*1 may include coils having a different gauge than the coils of springs 68 of spring pack 66*a*2 and/or spring pack 66*a*3.

In some embodiments, spring pack 66*b*1 is identical to spring pack 66*b*2 and spring pack 66*b*3. In some embodiments, spring pack 66*b*1 includes springs 68 that are different than springs 68 of spring pack 66*b*2 and/or spring pack 66*b*3 such that spring pack 66*b*1 is more or less firm than spring pack 66*b*2 and/or spring pack 66*b*3. That is, spring packs 66*b*1, 66*b*2, 66*b*3 can all have the same firmness, or one of spring packs 66*b*1, 66*b*2, 66*b*3 can have a firmness that is different from at least one of spring packs 66*b*1, 66*b*2, 66*b*3. As such, spring packs 66*b*1, 66*b*2, 66*b*3 can each have a different firmness, if desired. This allows a sleeper to select a spring pack 66*b*1 that has the firmness he or she desires to support his or her head and/or upper body, a spring pack 66*b*2 that has a firmness he or she desires to support his or her torso and/or core and a spring pack 66*b*3 that has a firmness he or she desires to support his or her legs and/or lower body. In some embodiments, springs 68 of spring pack 66*b*1 may include more or less coils than springs 68 of spring pack 66*b*2 and/or spring pack 66*b*3. In some embodiments, springs 68 of spring pack 66*b*1 may include coils having a different gauge than the coils of springs 68 of spring pack 66*b*2 and/or spring pack 66*b*3.

Providing a plurality of spring packs that can be selected based on desired firmness allows a sleeper that sleeps adjacent to sidewall 38 and a sleeper that sleeps adjacent to sidewall 40 to each select a spring pack that that has the firmness he or she desires to support his or her head and/or upper body, a spring pack that has a firmness he or she desires to support his or her torso and/or core and a spring pack that has a firmness he or she desires to support his or her legs and/or lower body, even if the preference(s) of one of the sleepers is different than the preference(s) of the other sleeper. Furthermore, providing a plurality of spring packs that can be selected based on desired firmness allows one or more of the spring packs to be replaced if one of the spring packs wears out or if a user's preference changes over time. For example, should a sleeper desire a spring pack that is less firm than previously thought, the sleeper may replace the firm spring pack with a spring pack that is less firm.

Figure 20:
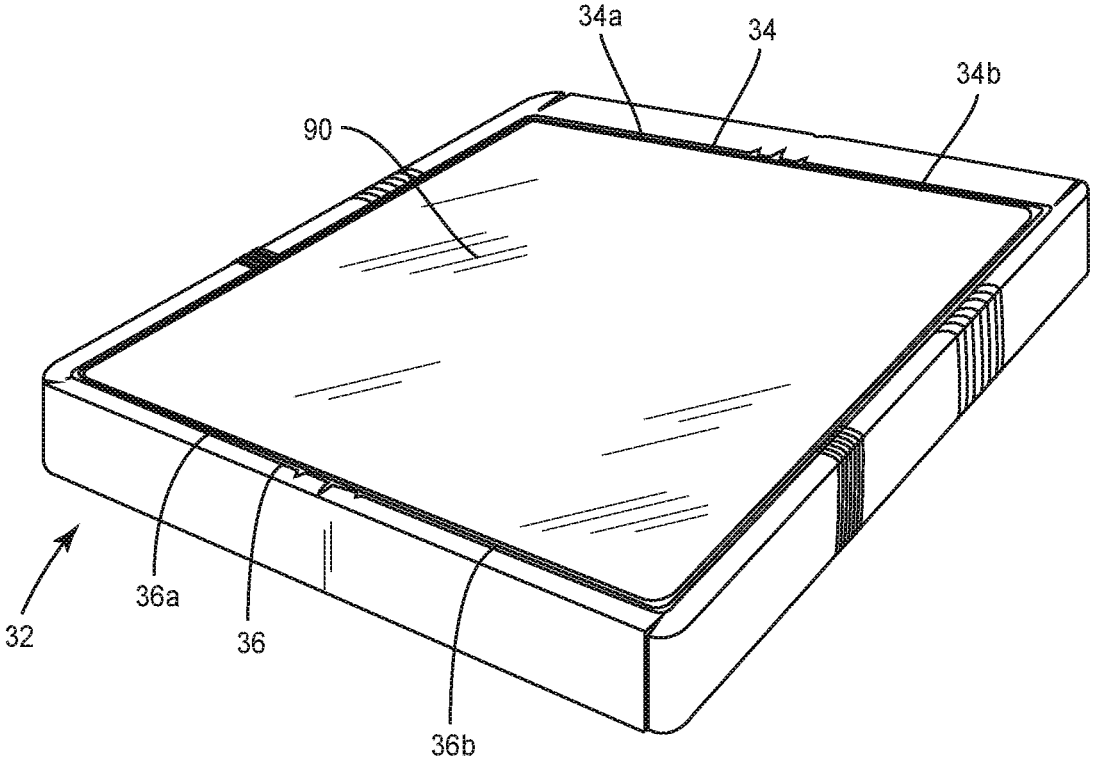
FIG. 20 is a perspective view of components of the mattress assembly shown in FIG. 1.
Figure 21:
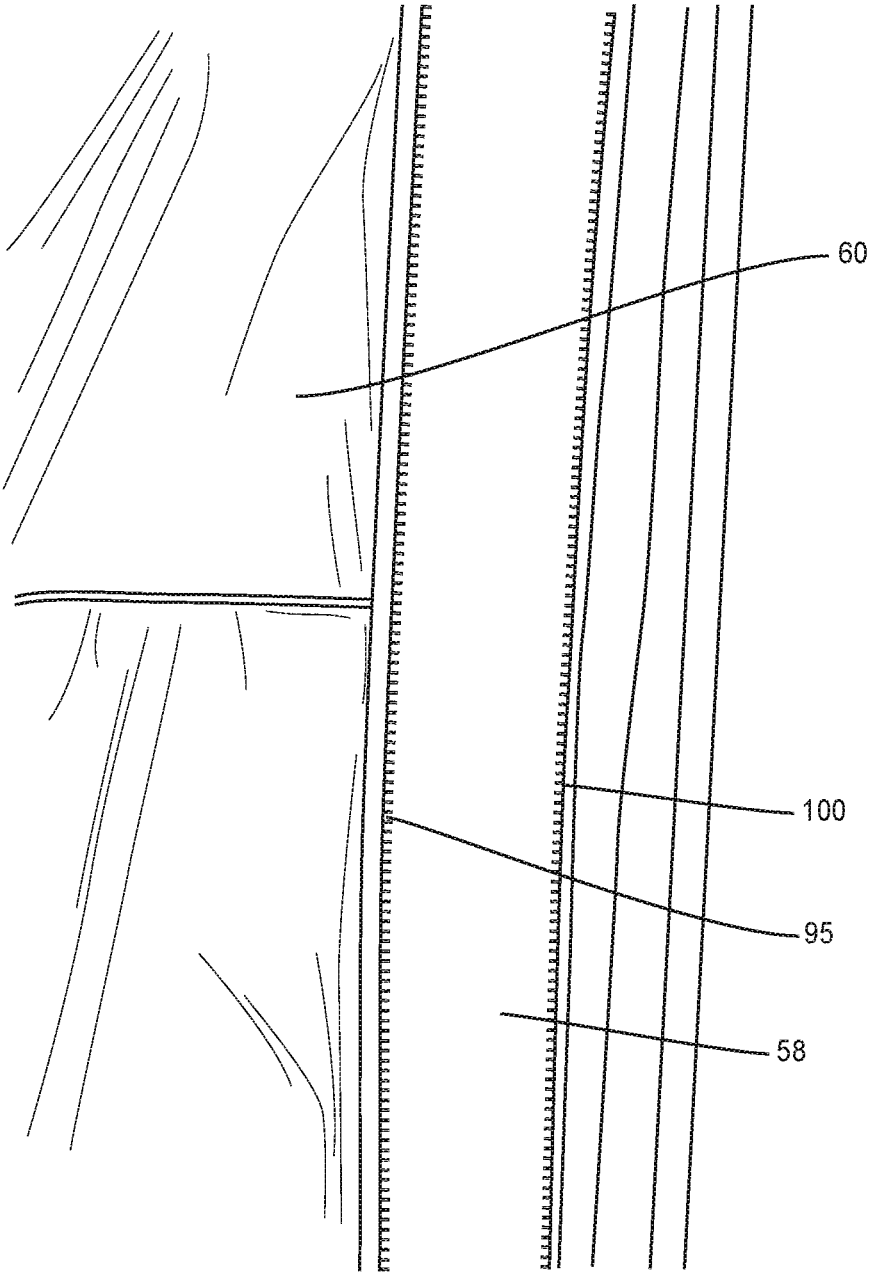
FIG. 21 is a top view of components of the mattress assembly shown in FIG. 1.

In some embodiments, mattress assembly 30 includes suspension fabric, such as, for example, a barrier layer 90 that covers spring pack 66, as shown in FIG. 20. Barrier layer 90 may be formed from one or more of the materials discussed herein. In some embodiments, barrier layer 90 is coupled to cover 58. In such embodiments, cover 58 may include an inner row of teeth 95 (FIG. 21) that mate and/or interlock with a row of teeth on a perimeter of barrier layer 90 such that inner row of teeth 95 and the teeth on the perimeter of barrier layer 90 form a zipper. The zipper may include a slider that is movable relative to inner row of teeth 95 and the teeth on the perimeter of barrier layer 90 to mesh together or separate inner row of teeth 95 and the teeth on the perimeter of barrier layer 90. In some embodiments, inner row of teeth 95 extends circumferentially about cover 58 such that the zipper formed by inner row of teeth 95 and the teeth on the perimeter of barrier layer 90 extends circumferentially about chassis 32.

Figure 22:
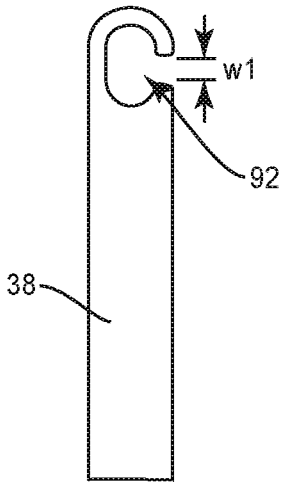
FIG. 22 is a side, cross sectional view of a component of the mattress assembly shown in FIG. 1.
Figure 23:
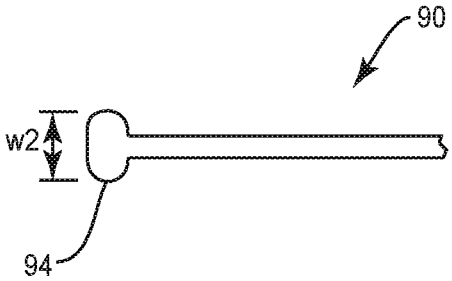
FIG. 23 is a side view of a component of the mattress assembly shown in FIG. 1.
Figure 24:
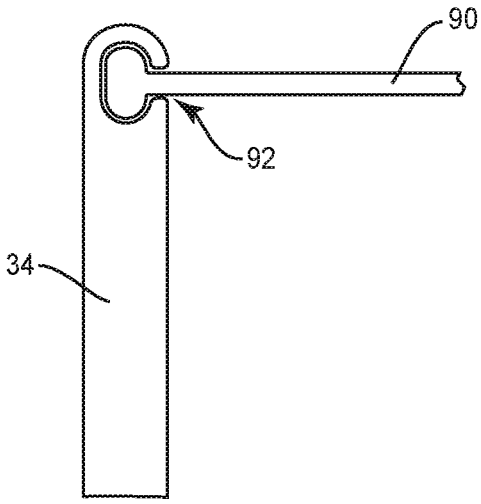
FIG. 24 is a side view, in part cross section, of components of the mattress assembly shown in FIG. 1.

In some embodiments, barrier layer 90 is coupled to chassis 32. In such embodiments, at least one of walls 34, 36, 38, 40 include a channel 92 and barrier layer 90 includes an enlarged edge portion 94 that is configured for disposal in channels 92, as shown in FIGS. 22-24. In some embodiments, edge portion 94 extends continuously about the entire perimeter of barrier layer 90. In some embodiments, channels 92 each extend the entire length of at least one of at least one of walls 34, 36, 38, 40. An opening 96 in at least one of walls 34, 36, 38, 40 is in communication with a respective one of channels 92 and has a width w1 that is less than a width w2 of edge portion 94 such that edge portion 94 cannot be removed from channels 92.

In some embodiments, a first section of barrier layer 90 includes edge portion 94 and only one of walls 34, 36, 38, 40 include a channel 92 and a second section of barrier layer 90 includes a row of teeth that extends along only a portion the perimeter of barrier layer 90. In such embodiments, cover 58 may include an inner row of teeth along the walls 34, 36, 38, 40 that do not include the channel 92. The teeth on cover 58 mate and/or interlock with the teeth along a portion the perimeter of barrier layer 90 such that the inner row of teeth on cover 58 and the teeth on the perimeter of barrier layer 90 form a zipper. The zipper may include a slider to open and close the zipper, as discussed herein. Edge portion 94 is threaded into channel 92 to fix barrier layer 90 to one of walls 34, 36, 38, 40. The slider is then moved along the zipper to close the zipper such that barrier layer 90 is fixed to the other ones of walls 34, 36, 38, 40.

Mattress assembly 30 includes a mattress topper 72 positioned on top of spring pack 66. In embodiments that include barrier layer 90, barrier layer 90 is positioned between spring pack 66 and topper 72. Topper 72 includes a cushion or cushioning material to provide cushioning to the sleeper(s) that lie on top of topper 72. Topper 72 may be removeably coupled to mattress assembly 30. In some embodiments, topper 72 is removeably coupled to spring pack 66. In some embodiments, topper 72 is removeably coupled to cover 58. In some embodiments, cover 58 includes a first part 58*c* of a zipper and topper 72 includes a second part of the zipper to allow topper 72 to be zipped and unzipped from cover 58. For example, first part 58 may include a first row of teeth of the zipper and the second part of the zipper may include a second row of teeth that engage and disengage the first row of teeth as the zipper is zipped and unzipped. Topper 72 can thus be removed for cleaning, etc., and then reattached to cover 58 after topper 72 is cleaned. Removeably coupling topper 72 to cover 58 also allows topper 72 to be replaced if topper 72 wears out and/or if a sleeper desires a topper that is more or less firm. For example, if the user desires a topper that is firmer, topper 72 can be removed by unzipping topper from cover 58. Topper 72 can then be replaced with a topper 72 that is firmer. In some embodiments, topper 72 can be a mat, a mattress topper or a mattress. It is envisioned that topper 72 can have various thicknesses. For example, topper 72 can have a thickness that is less than 1 inch, a thickness that is greater than 3 inches or any thickness between 0.1 inches and 12 inches.

Figure 25:
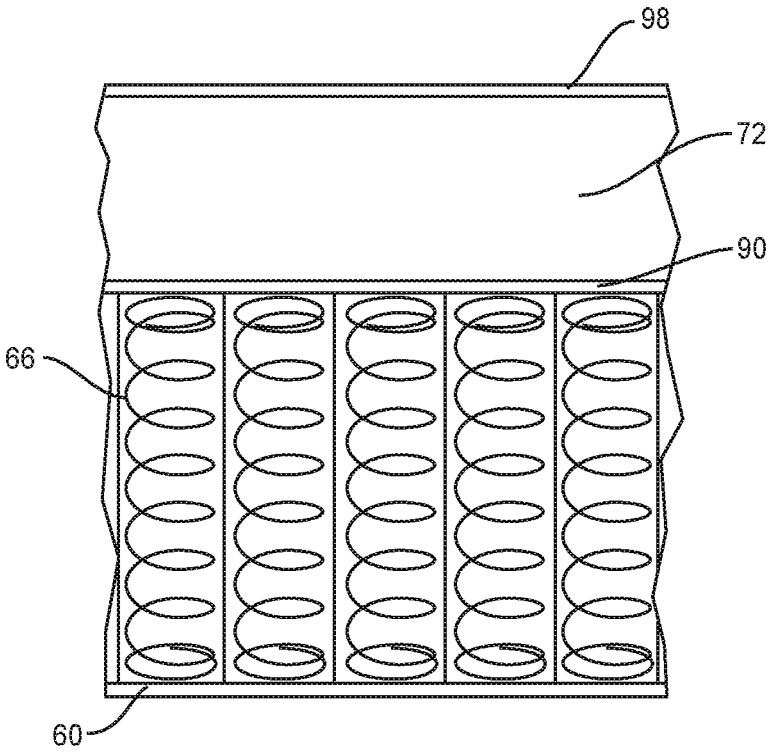
FIG. 25 is a side, cross sectional view of components of the mattress assembly shown in FIG. 1.

In some embodiments, mattress assembly 30 includes an outer layer 98 that covers topper 72 such that topper 72 is positioned between outer layer 98 and barrier layer 90, as shown in FIG. 25. Outer layer 98 is configured to couple topper 72 to chassis 32 such that topper 72 is prevented from shifting relative to chassis 32. In some embodiments, outer layer 98 is coupled to cover 58. In some embodiments, cover 58 includes an outer row of teeth 100 (FIG. 21) that mate and/or interlock with a row of teeth on a perimeter of outer layer 98 such that outer row of teeth 100 and the teeth on the perimeter of outer layer 98 form a zipper. The zipper may include a slider that is movable relative to outer row of teeth 100 and the teeth on the perimeter of outer layer 98 to mesh together or separate outer row of teeth 100 and the teeth on the perimeter of outer layer 98. In some embodiments, outer row of teeth 100 extends circumferentially about cover 58 such that the zipper formed by outer row of teeth 100 and the teeth on the perimeter of outer layer 98 extends circumferentially about chassis 32.

In some embodiments, chassis 32 includes one or more hinges 102 along sidewall 38 and/or sidewall 40, as shown in FIG. 2. Hinges 102 are configured to allow sidewalls 38, 40 to bend along a length thereof. In some embodiments, hinges 102 in sidewall 38 are aligned with hinges 102 in sidewall 40 such that sidewalls 38, 40 can each bend at the same point along their lengths. It is envisioned that hinges 102 may be used to selectively bend sidewalls 38, 40 such that wall 34 is positioned above wall 36 or wall 36 is positioned above wall 34. In some embodiments, hinge 102 is a hinge (e.g., hinge 30) that is described in U.S. Patent Application No. 62/443,260, filed Jan. 6, 2017, which is incorporated herein by reference, in its entirety. It is envisioned that hinges 102 can be positioned anywhere along sidewall 38 and/or sidewall 40. In some embodiments, hinges 102 can extend the entire length of sidewall 38 and/or sidewall 40. For example, one of hinges 102 can extend along sidewall 38 from wall 34 to wall 36 and/or one of hinges 102 can extend along sidewall 40 from wall 34 to wall 36. In such embodiments, hinges 102 can lock and/or unlock by turning hinge 102 or restricting rotation. In some embodiments, cover 58 covers at least one of hinges 102.

Figure 26:
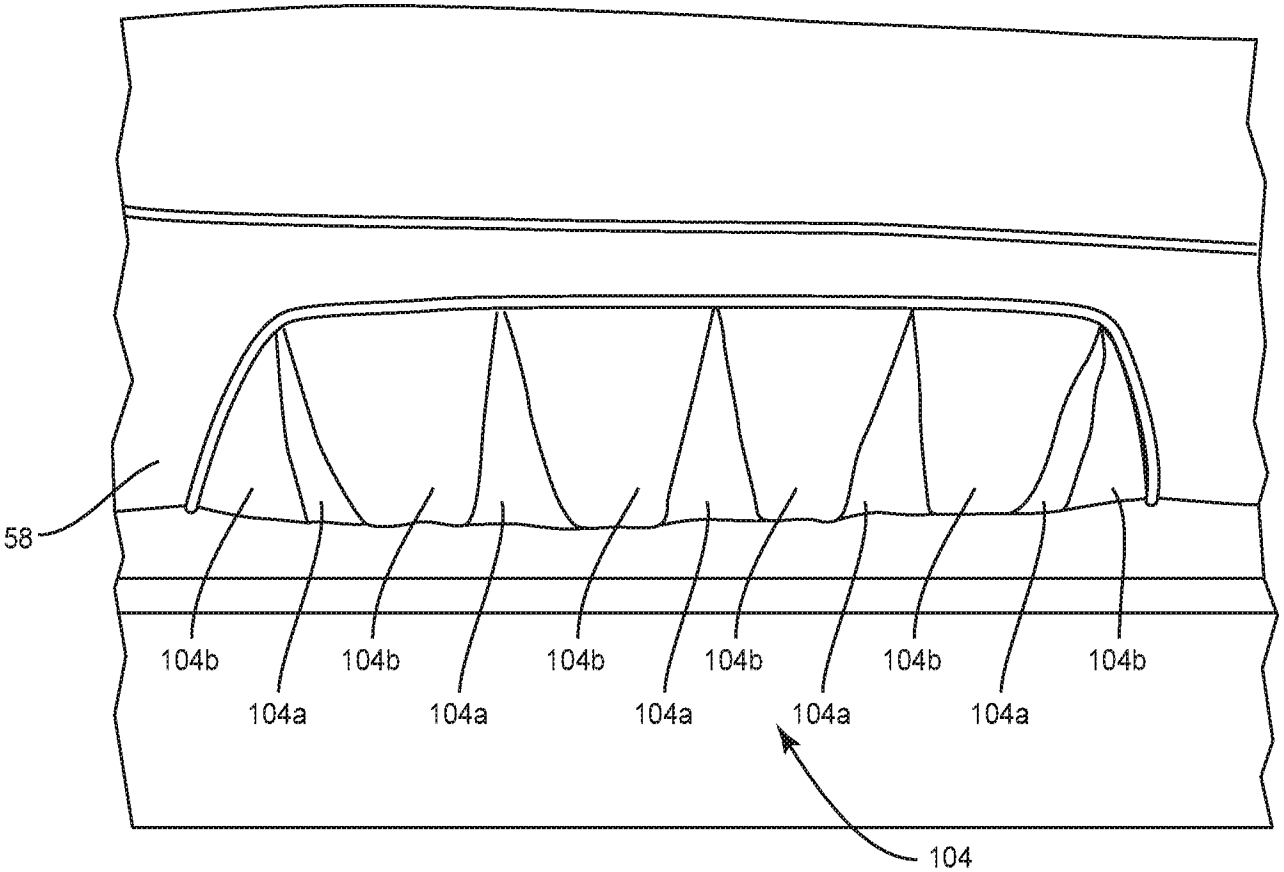
FIG. 26 is a side view of a component of the mattress assembly shown in FIG. 1.
Figure 27:
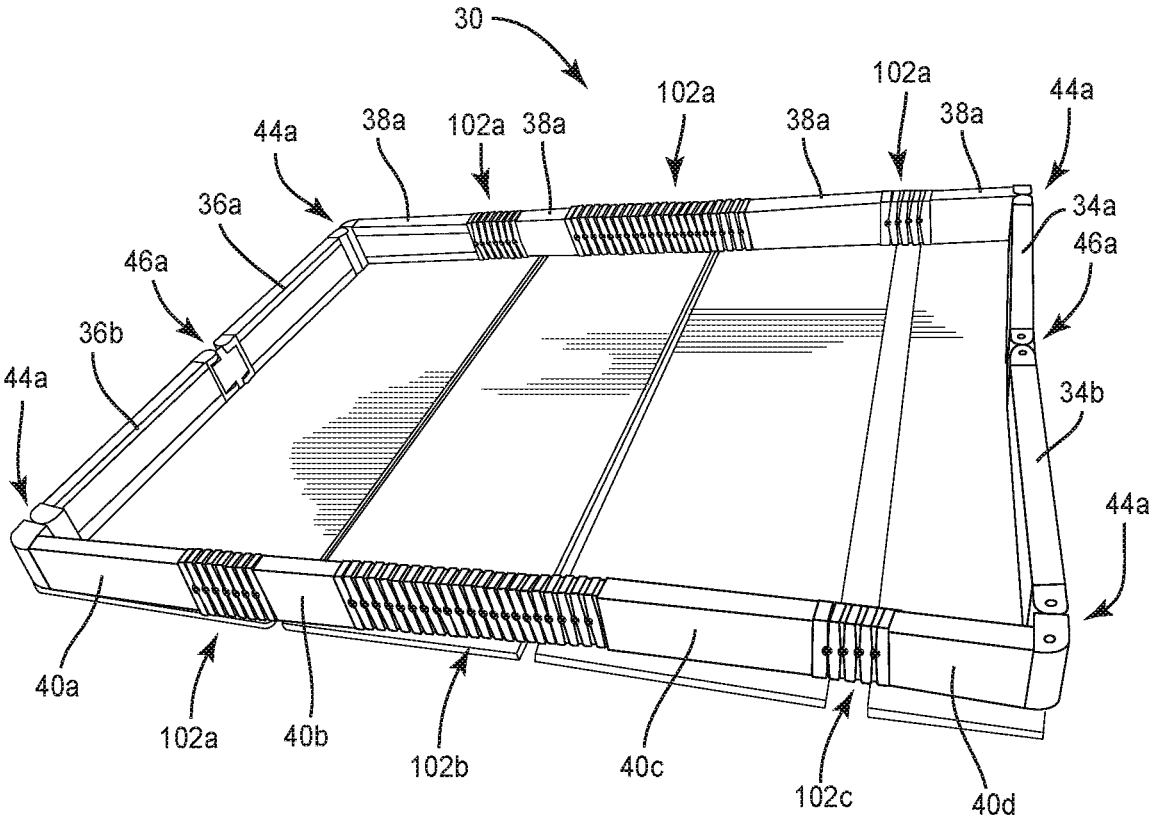
FIG. 27 is a perspective view of one embodiment of the mattress assembly shown in FIG. 1, in accordance with the principles of the present disclosure.

In some embodiments, cover 58 includes one or more joints 104, shown in FIG. 26, for example, that cover hinges 102 to allow cover 58 to bend with hinges 102 without bunching. Joints 104 each include one or a plurality of first sections 104*a* and one or a plurality of second sections 104*b*. Second sections 104*b* are each positioned between adjacent first sections 104*a*. First sections 104*a* are each made from a first material and second sections 104*b* are each made from a second material. The first material is more rigid than the second material such that first sections 104*a* will not bend as hinges 102 bend, but second sections 104*b* will bend as hinges 102 bend. This configuration allows joint 104 to bend in the same manner as hinge 102. That is, joint 104 will bend as hinge 102 bends. In some embodiments, joints 104 have a length that is equal or approximately equal to a length of hinges 102. It is envisioned that joint 104 may include one or a plurality of first sections 104*a* and one or a plurality of second sections 104*b*. In some embodiments, section 104*a* and/or section 104*b* is variously shaped, such as, for example, triangular, square, polygonal, irregular, uniform, non-uniform, offset, staggered, undulating, arcuate, variable and/or tapered.

In one embodiment, shown in FIGS. 27-31, mattress assembly 30 includes corner hinges 44*a* that are similar to hinges 44 discussed herein. In particular, mattress assembly 30 includes a first hinge 44*a* that connects first section 34*a* of top wall 34 with sidewall 38 to allow section 34*a* to pivot relative to sidewall 38. First hinge 44*a* is configured to move between a first orientation in which section 34*a* extends parallel to sidewall 38 and a second orientation in which section 34*a* extends perpendicular to sidewall 38. Mattress assembly 30 includes a second hinge 44*a* that connects second section 34*b* of top wall 34 with sidewall 40 to allow section 34*b* to pivot relative to sidewall 40. Second hinge 44*a* is configured to move between a first orientation in which section 34*b* extends parallel to sidewall 40 and a second orientation in which section 34*b* extends perpendicular to sidewall 40. Mattress assembly 30 includes a third hinge 44*a* that connects first section 36*a* of bottom wall 36 with sidewall 38 to allow section 36*a* to pivot relative to sidewall 38. Third hinge 44*a* is configured to move between a first orientation in which section 36*a* extends parallel to sidewall 38 and a second orientation in which section 36*a* extends perpendicular to sidewall 38. Mattress assembly 30 includes a fourth hinge 44*a* that connects second section 36*b* of bottom wall 36 with sidewall 40 to allow section 36*b* to pivot relative to sidewall 40. Fourth hinge 44*a* is configured to move between a first orientation in which section 36*b* extends parallel to sidewall 40 and a second orientation in which section 36*b* extends perpendicular to sidewall 40.

Mattress assembly 30 includes head/foot hinges 46*a* that are similar to hinges 46 discussed herein. In particular, mattress assembly 30 includes a first hinge 46*a* that connects first section 34*a* of top wall 34 with second section 34*b* of top wall 34 to allow section 34*a* to pivot relative to section 34*b*. First hinge 46*a* is configured to move between a first orientation in which section 34*a* extends perpendicular to section 34*b* and a second orientation in which section 34*a* extends parallel to section 34*b*. Mattress assembly 30 includes a second hinge 46*a* that connects first section 36*a* of bottom wall 36 with second section 36*b* of bottom wall 36 to allow section 36*a* to pivot relative to section 36*b*. Second hinge 46*a* is configured to move between a first orientation in which section 36*a* extends perpendicular to section 36*b* and a second orientation in which section 36*a* extends parallel to section 36*b*.

Figure 31:
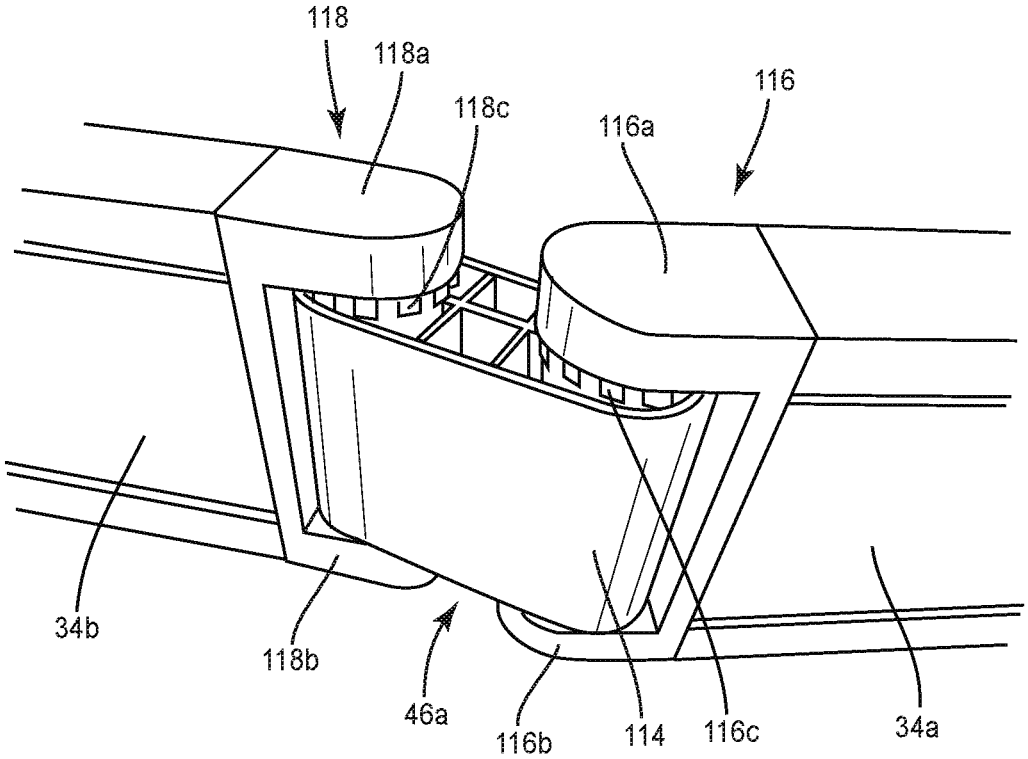
FIG. 31 is a perspective view of a component of the mattress assembly shown in FIG. 27.

Hinges 46*a* each include a body 114, a first end portion 116 and a second end portion 118. As shown in FIG. 31, end portion 116 is fixedly attached to first section 34*a* of top wall 34 and end portion 118 is fixedly attached to second section 34*b* of top wall 34. However, it is envisioned that end portion 116 may be fixedly attached to second section 34*b* of top wall 34 and end portion 118 may be fixedly attached to first section 34*a* of top wall 34. It is further envisioned that end portion 116 or end portion 118 may be fixedly attached to first section 36*a* of bottom wall 36 and end portion 116 or end portion 118 may be fixedly attached to second section 36*b* of bottom wall 36.

End portion 116 includes spaced apart flanges 116*a*, 116*b*. At least one of flanges 116*a*, 116*b* includes an extension 116*c* that is configured for disposal in a cavity of body 114 to allow end portion 116 to pivot relative to body 114. Likewise, end portion 118 includes spaced apart flanges 118*a*, 118*b*. At least one of flanges 118*a*, 118*b* includes an extension 118*c* that is configured for disposal in a cavity of body 114 to allow end portion 118 to pivot relative to body 114. When extensions 116*c*, 118*c* are disposed in the cavities of body 114, flange 116*a* is spaced apart from flange 118*a* and flange 116*b* is spaced apart from flange 118*b*, as shown in FIG. 31. This allows end portions 116, 118 to move relative to body 114 to move hinge 46*a* between the first and second orientations discussed herein. In some embodiments, extensions 116*c*, 118*c* each have a cylindrical configuration and are disposed in cylindrically shaped cavities in body 114. In some embodiments, all or only a portion of extension 116*c* and/or extension 118*c* may be variously configured and dimensioned, such as, for example, planar, concave, polygonal, irregular, uniform, non-uniform, staggered, tapered, consistent or variable, depending on the requirements of a particular application.

Mattress assembly 30 includes knee hinges 102*a* that are similar to hinges 102 discussed herein. In particular, mattress assembly 30 includes a first hinge 102*a* that connects a first section 38*a* of sidewall 38 with a second section 38*b* of sidewall 38 to allow section 38*a* to pivot relative to section 38*b*. First hinge 102*a* is configured to move between a first orientation in which section 38*a* extends parallel to section 38*b* and a second orientation in which section 38*a* extends transverse to section 38*b*. Mattress assembly 30 includes a second hinge 102*a* that connects a first section 40*a* of sidewall 40 with a second section 40*b* of sidewall 40 to allow section 40*a* to pivot relative to section 40*b*. Second hinge 102*a* is configured to move between a first orientation in which section 40*a* extends parallel to section 40*b* and a second orientation in which section 40*a* extends transverse to section 40*b*. In some embodiments, hinges 102*a* are similar to or identical to one or more of the hinges described in co-owned U.S. Patent Application No. 62/443,260, filed Jan. 6, 2017, which is expressly incorporated herein by reference, in its entirety.

Hinges 102*a* each include an end plate 120, an end plate 122 and one or more inner plates 124 between end plate 120 and end plate 122. End plate 120 is fixedly attached to first section 38*a* of sidewall 38 or first section 40*a* of sidewall 40 and end plate 122 is fixedly attached to second section 38*b* of sidewall 38 or second section 40*b* of sidewall 40.

End plate 120 includes a block 126 that extends from an inclined surface 128 of end plate 120 and a block 130 that extends from an inclined surface 132 of end plate 120. Blocks 126, 130 are configured for disposal within one of inner plates 124 to couple one of inner plates 124 to end plate 120, as discussed herein. End plate 120 includes a passageway positioned between blocks 126, 130.

A first inner plate 124*a* includes a body 134 having a surface 136 and a surface 138 opposite surface 136. Surface 136 includes convex extension 140 between inclined portions of surface 136. The first inner plate 124*a* includes an aperture 142 that extends through extension 140. An inner surface of body 134 defines a cavity configured for disposal of blocks 126, 130. In some embodiments, the cavity of body 134 may include a section configured for disposal of block 126 and a section configured for disposal of block 130. A pin 144 is positioned through the passageway in end plate 120 and aperture 142 to connect the first inner plate 124*a* to end plate 120 such that inner plate 124*a* is pivotable relative to end plate 120 about a pivot axis defined by pin 144. Blocks 126, 130 of end plate 120 move within the cavity of first inner plate 124*a* as inner plate 124*a* pivots relative to end plate 120.

End plate 122 includes a block 146 that extends from an inclined surface 148 of end plate 122 and a block 150 that extends from an inclined surface 152 of end plate 122. Blocks 146, 150 are configured for disposal within one of inner plates 124 to couple one of inner plates 124 to end plate 122, as discussed herein. End plate 122 includes a passageway 154 positioned between blocks 146, 150.

A second inner plate 124*b* includes a body 156 having a cavity configured for disposal of blocks 146, 150. Body 156 includes a concave portion 155 positioned between blocks 146, 150. Concave portion 155 includes an aperture. A pin 158 is positioned through passageway 154 and the aperture in body 156 to connect the second inner plate 124*b* to end plate 122 such that inner plate 124*b* is pivotable relative to end plate 122 about a pivot axis defined by pin 158. Blocks 146, 150 of end plate 122 move within the cavity of second inner plate 124*b* as inner plate 124*b* pivots relative to end plate 122.

Figure 28:
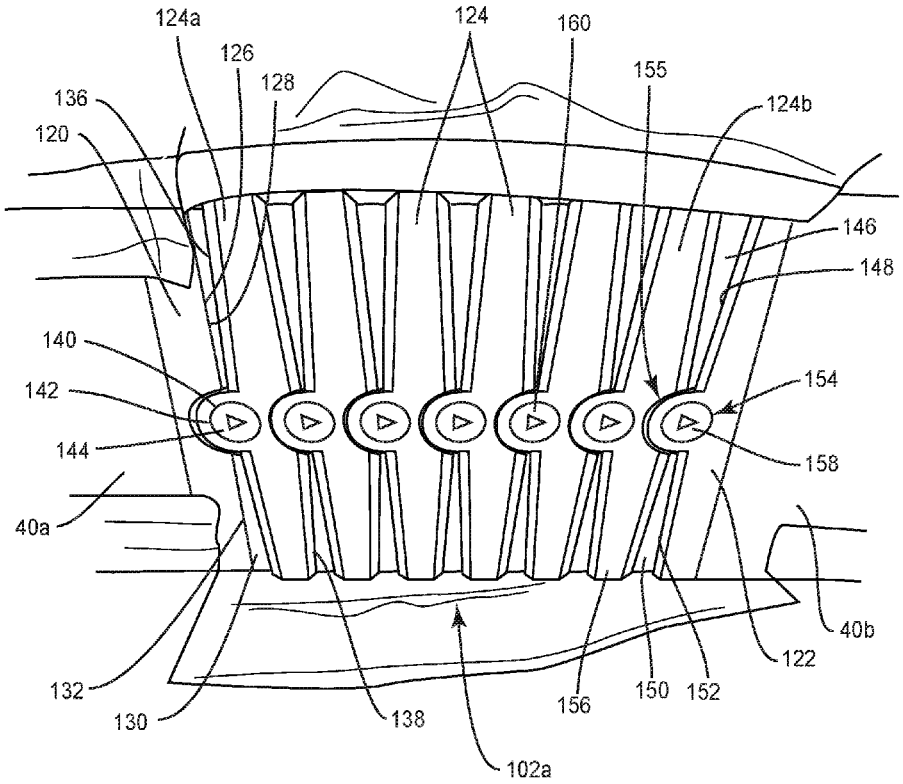
FIG. 28 is a side view of a component of the mattress assembly shown in FIG. 27.

In some embodiments, inner plate 124*a* may be connected directly to inner plate 124*b*. In some embodiments, hinge 102*a* includes additional inner plates 124 between inner plate 124*a* and inner plate 124*b*, as shown in FIG. 28, for example. While FIG. 28 shows four inner plates 124 between inner plate 124*a* and inner plate 124*b*, it is envisioned that hinge 102*a* may include one or a plurality of additional inner plates 124 between inner plate 124*a* and inner plate 124*b*. Hinges 124 may be connected to one another by positioning an extension 140 of a first one of hinges 124 within concave portion 155 of a second one of hinges 124 such that aperture 142 of the first one of hinges 124 is aligned with the aperture in concave portion 155 of the second one of hinges 124. A pin 160 is positioned through aperture 142 of the first one of hinges 124 and the aperture in concave portion 155 of the second one of hinges 124 to allow the first one of hinges 124 to pivot relative to the second one of hinges 124 about pin 160.

Mattress assembly 30 includes torso hinges 102*b* that are similar to hinges 102 discussed herein. In particular, mattress assembly 30 includes a first hinge 102*b* that connects second section 38*b* of sidewall 38 with a third section 38*c* of sidewall 38 to allow section 38*b* to pivot relative to section 38*c*. First hinge 102*b* is configured to move between a first orientation in which section 38*b* extends parallel to section 38*c* and a second orientation in which section 38*b* extends transverse to section 38*c*. Mattress assembly 30 includes a second hinge 102*b* that connects second section 40*b* of sidewall 40 with a third section 40*c* of sidewall 40 to allow section 40*b* to pivot relative to section 40*c*. Second hinge 102*b* is configured to move between a first orientation in which section 40*b* extends parallel to section 40*c* and a second orientation in which section 40*b* extends transverse to section 40*c*. In some embodiments, hinges 102*b* are similar to or identical to one or more of the hinges described in co-owned U.S. Patent Application No. 62/443,260, filed Jan. 6, 2017, which is expressly incorporated herein by reference, in its entirety.

Figure 29:
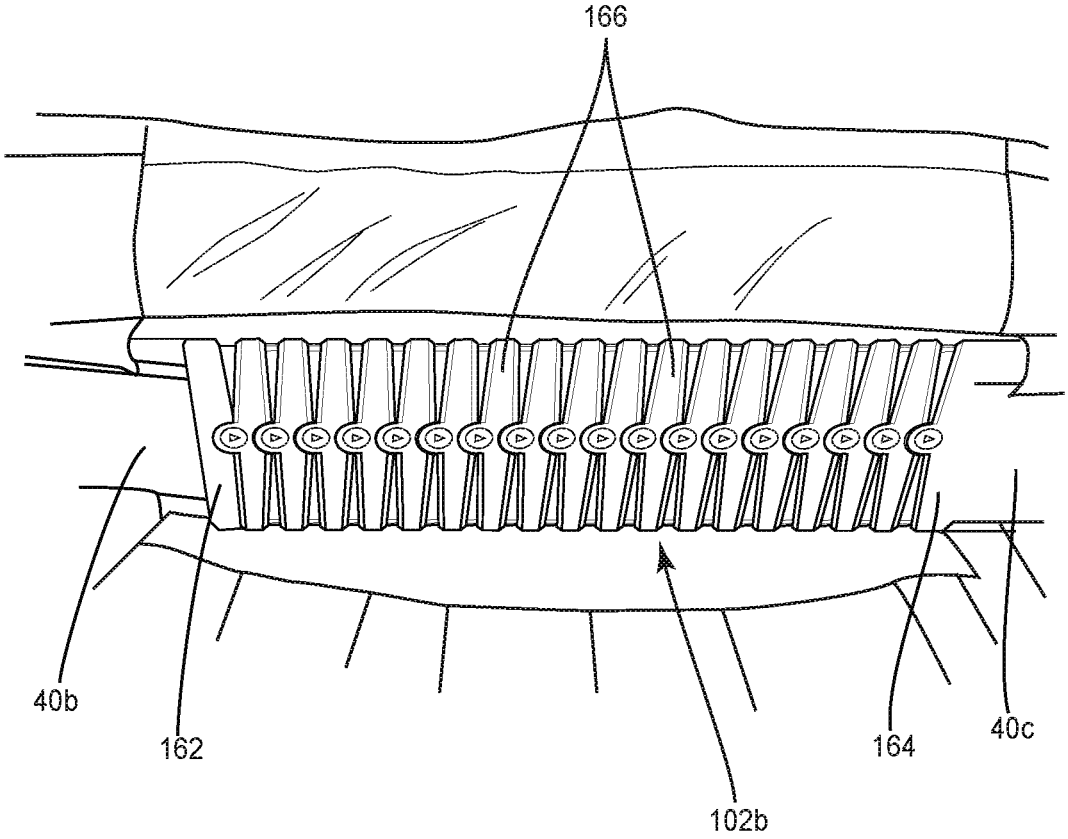
FIG. 29 is a side view of a component of the mattress assembly shown in FIG. 27.

Hinges 102*b* each include an end plate 162 that is similar or identical to end plate 120, an end plate 164 that is similar or identical to end plate 122 and one or more inner plates 166 between end plate 164 and end plate 164. End plate 162 is fixedly attached to second section 38*b* of sidewall 38 or second section 40*b* of sidewall 40 and end plate 164 is fixedly attached to third section 38*c* of sidewall 38 or third section 40*c* of sidewall 40. Inner plates 166 may similar or identical to inner plates 124. Accordingly, end plate 162 may be connected to one of inner plates 166 in the manner that end plate 120 is connected to one of inner plates 124 and end plate 164 may be connected to one of inner plates 166 in the manner that end plate 122 is connected to one of inner plates 124. While FIG. 29 shows seventeen inner plates 166 between end plate 162 and end plate 164, it is envisioned that hinge 102*b* may include one or a plurality of inner plates 166 between end plate 162 and end plate 164.

Mattress assembly 30 includes neck hinges 102*c* that are similar to hinges 102 discussed herein. In particular, mattress assembly 30 includes a first hinge 102*c* that connects third section 38*c* of sidewall 38 with a fourth section 38*d* of sidewall 38 to allow section 38*c* to pivot relative to section 38*d*. First hinge 102*c* is configured to move between a first orientation in which section 38*c* extends parallel to section 38*d* and a second orientation in which section 38*c* extends transverse to section 38*d*. Mattress assembly 30 includes a second hinge 102*c* that connects third section 40*c* of sidewall 40 with a fourth section 40*d* of sidewall 40 to allow section 40*c* to pivot relative to section 40*d*. Second hinge 102*c* is configured to move between a first orientation in which section 40*c* extends parallel to section 40*d* and a second orientation in which section 40*c* extends transverse to section 40*d*. In some embodiments, hinges 102*c* are similar to or identical to one or more of the hinges described in co-owned U.S. Patent Application No. 62/443,260, filed Jan. 6, 2017, which is expressly incorporated herein by reference, in its entirety.

Figure 30:
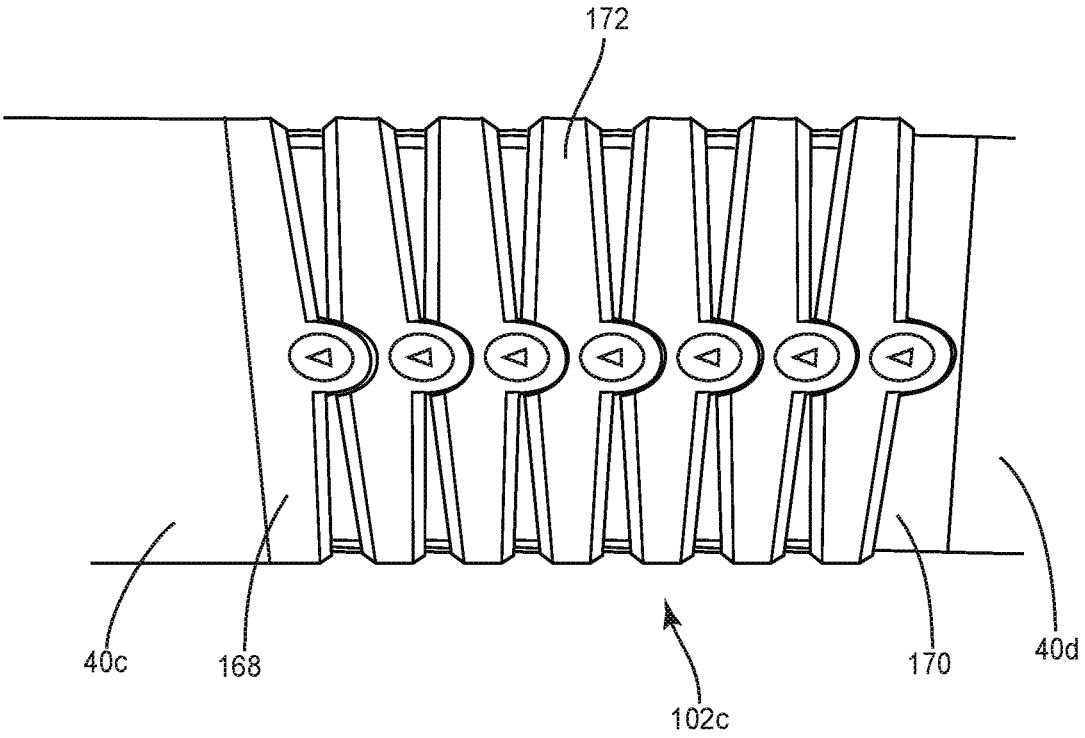
FIG. 30 is a side view of a component of the mattress assembly shown in FIG. 27.

Hinges 102*c* each include an end plate 168 that is similar or identical to end plate 120 and/or end plate 162, an end plate 170 that is similar or identical to end plate 122 and/or end plate 164 and one or more inner plates 172 between end plate 168 and end plate 170. End plate 168 is fixedly attached to third section 38*c* of sidewall 38 or third section 40*c* of sidewall 40 and end plate 170 is fixedly attached to fourth section 38*d* of sidewall 38 or fourth section 40*d* of sidewall 40. Inner plates 172 may similar or identical to inner plates 124 or inner plates 166. Accordingly, end plate 168 may be connected to one of inner plates 172 in the manner that end plate 120 is connected to one of inner plates 124 or in the manner that end plate 162 is connected to one of inner plates 166. Likewise, end plate 170 may be connected to one of inner plates 172 in the manner that end plate 122 is connected to one of inner plates 124 or in the manner that end plate 164 is connected to one of inner plates 166. While FIG. 30 shows six inner plates 172 between end plate 168 and end plate 170, it is envisioned that hinge 102*c* may include one or a plurality of inner plates 172 between end plate 168 and end plate 170.

Figure 32:
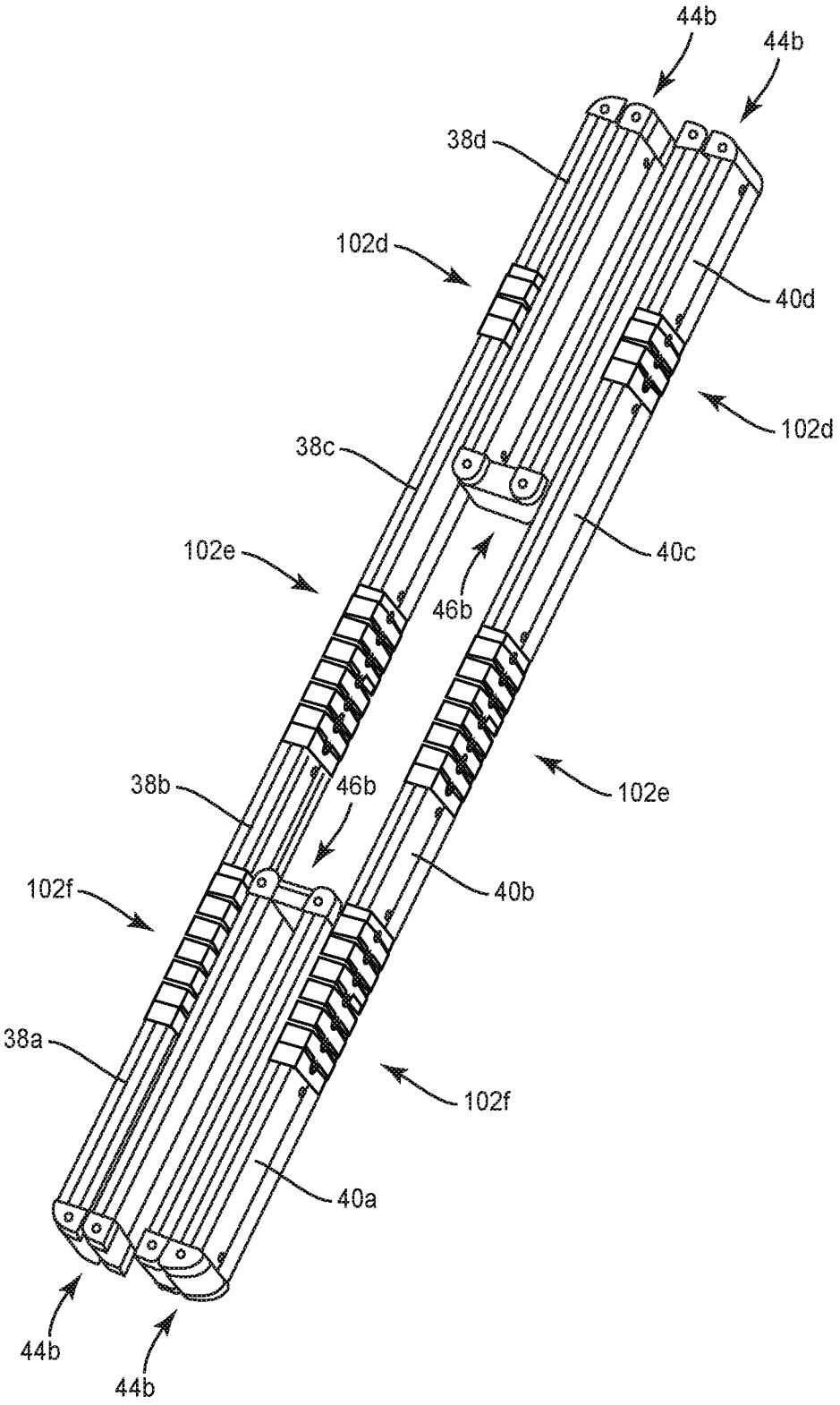
FIG. 32 is a perspective view of one embodiment of the mattress assembly shown in FIG. 1, in accordance with the principles of the present disclosure.
Figure 33:
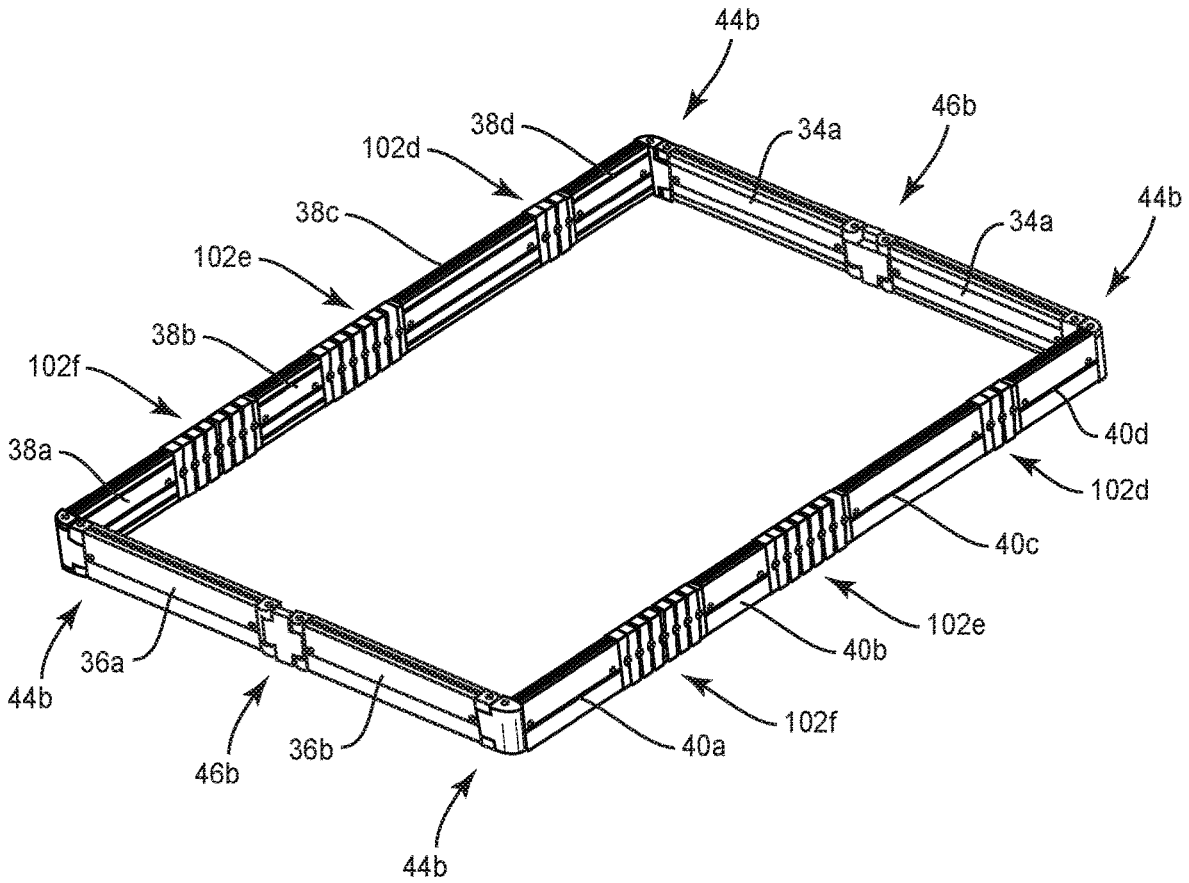
FIG. 33 is a perspective view of the mattress assembly shown in FIG. 32.
Figure 34:
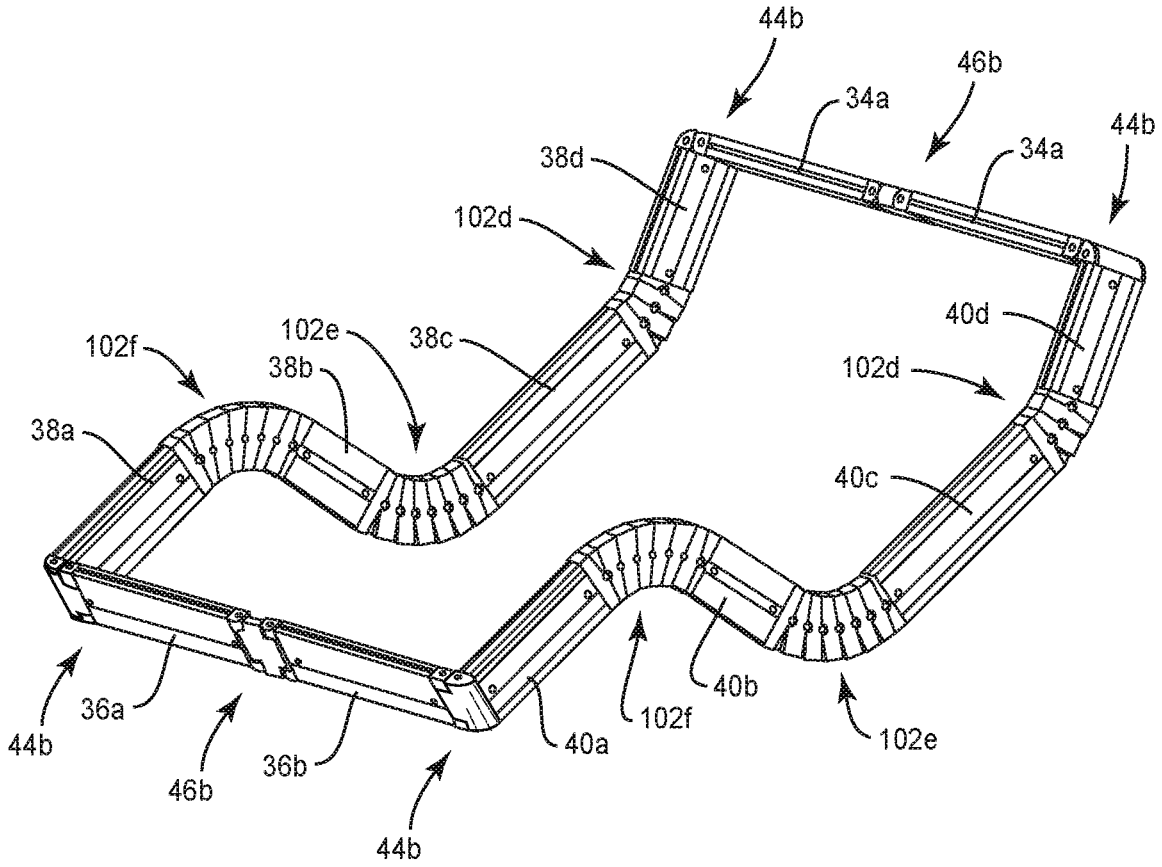
FIG. 34 is a perspective view of the mattress assembly shown in FIG. 32.
Figure 35:
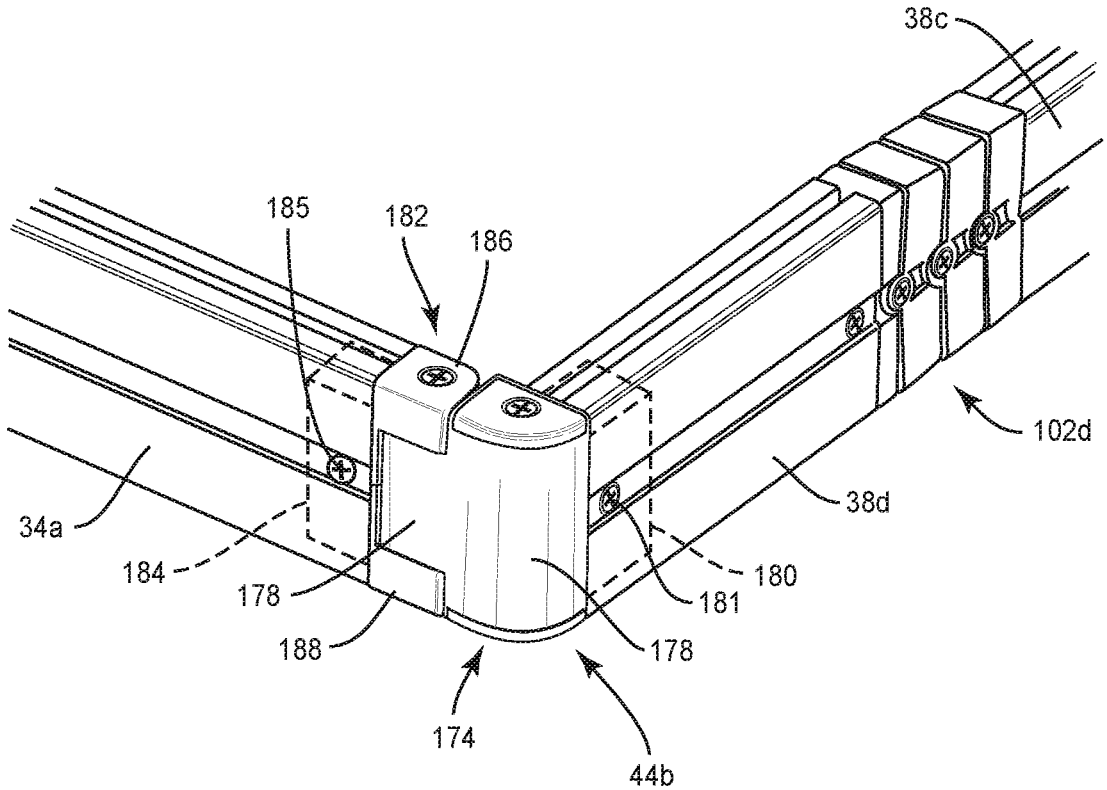
FIG. 35 is a perspective view of a component of the mattress assembly shown in FIG. 32.
Figure 36:
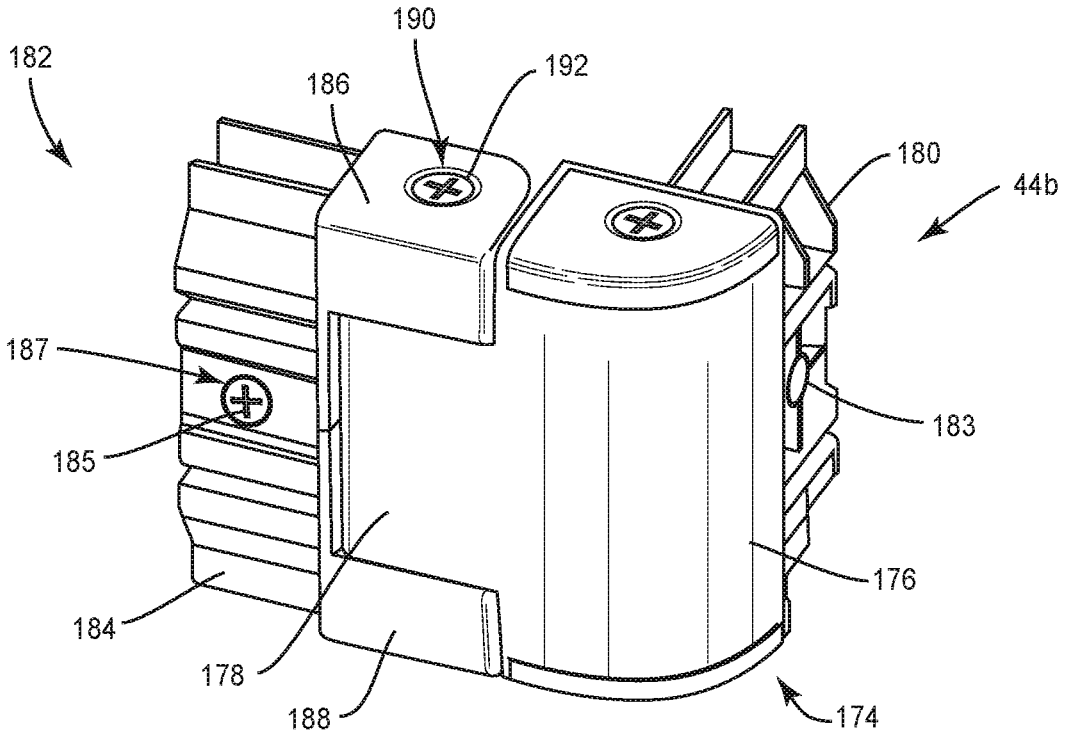
FIG. 36 is a perspective view of a component of the mattress assembly shown in FIG. 32.
Figure 37:
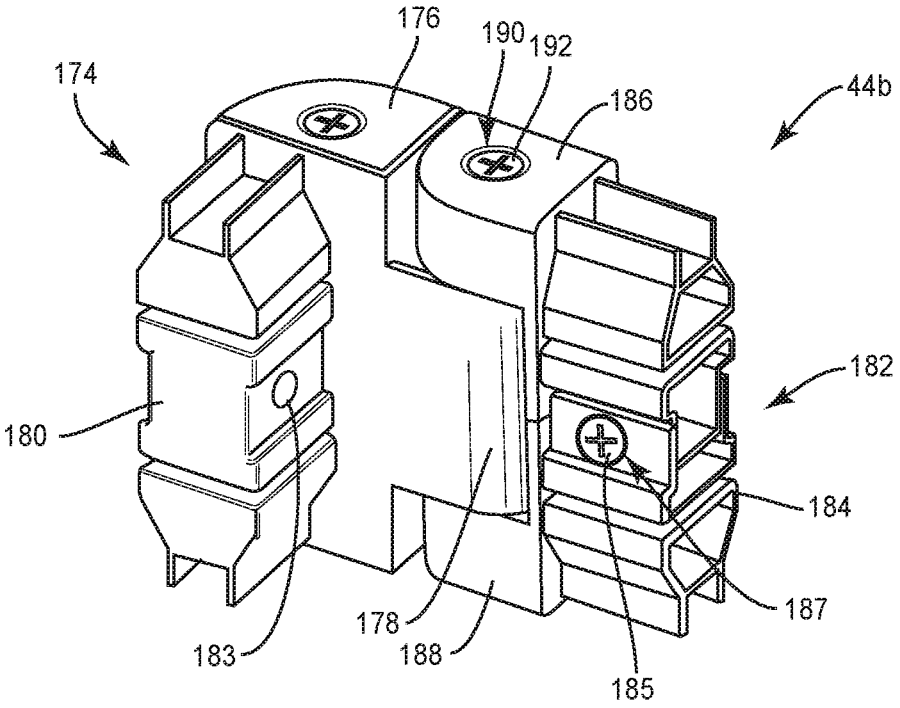
FIG. 37 is a perspective view of a component of the mattress assembly shown in FIG. 32.
Figure 38:
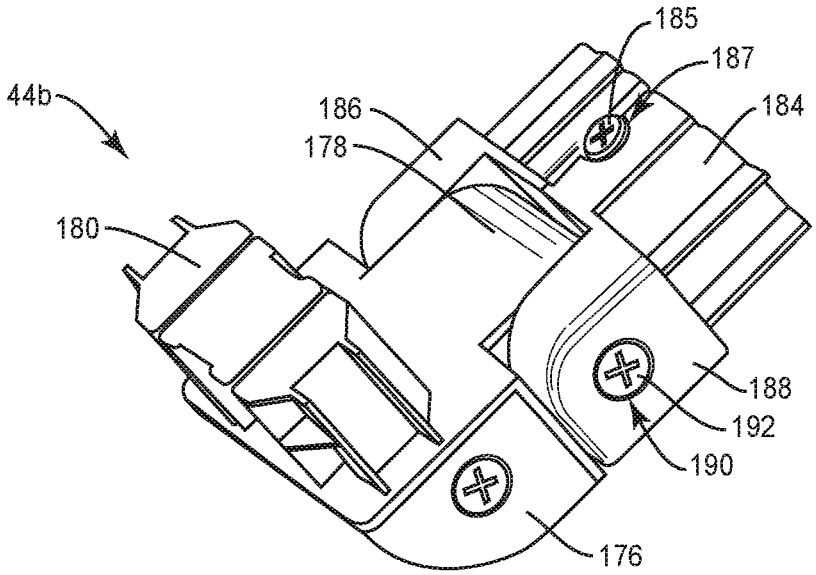
FIG. 38 is a perspective view of a component of the mattress assembly shown in FIG. 32.
Figure 39:
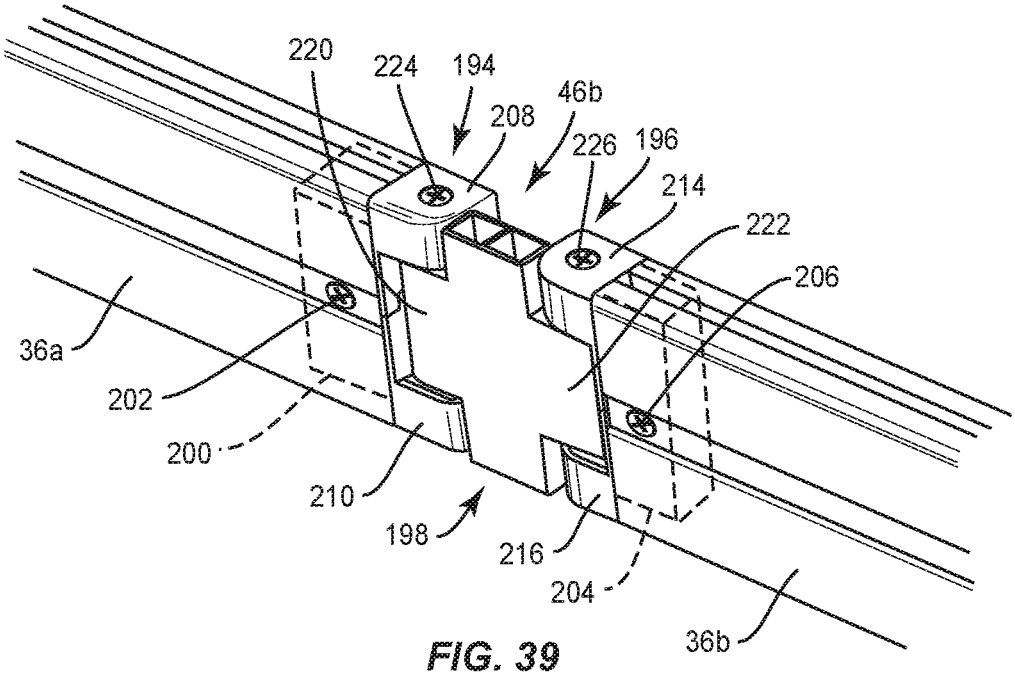
FIG. 39 is a perspective view of a component of the mattress assembly shown in FIG. 32.
Figure 40:
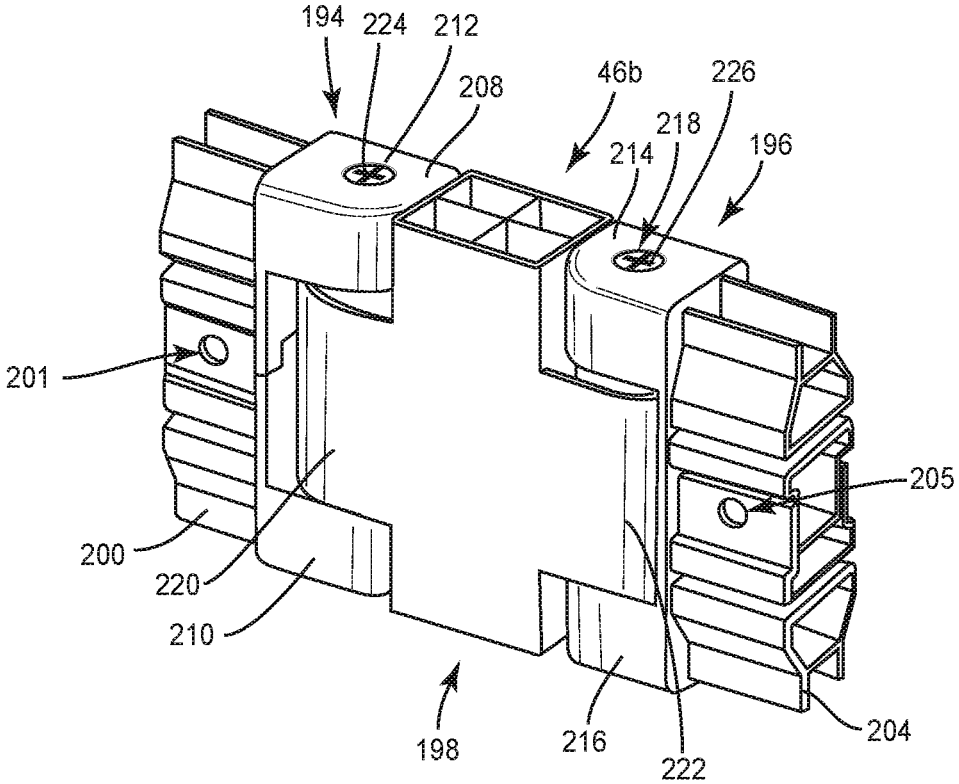
FIG. 40 is a perspective view of a component of the mattress assembly shown in FIG. 32.
Figure 41:
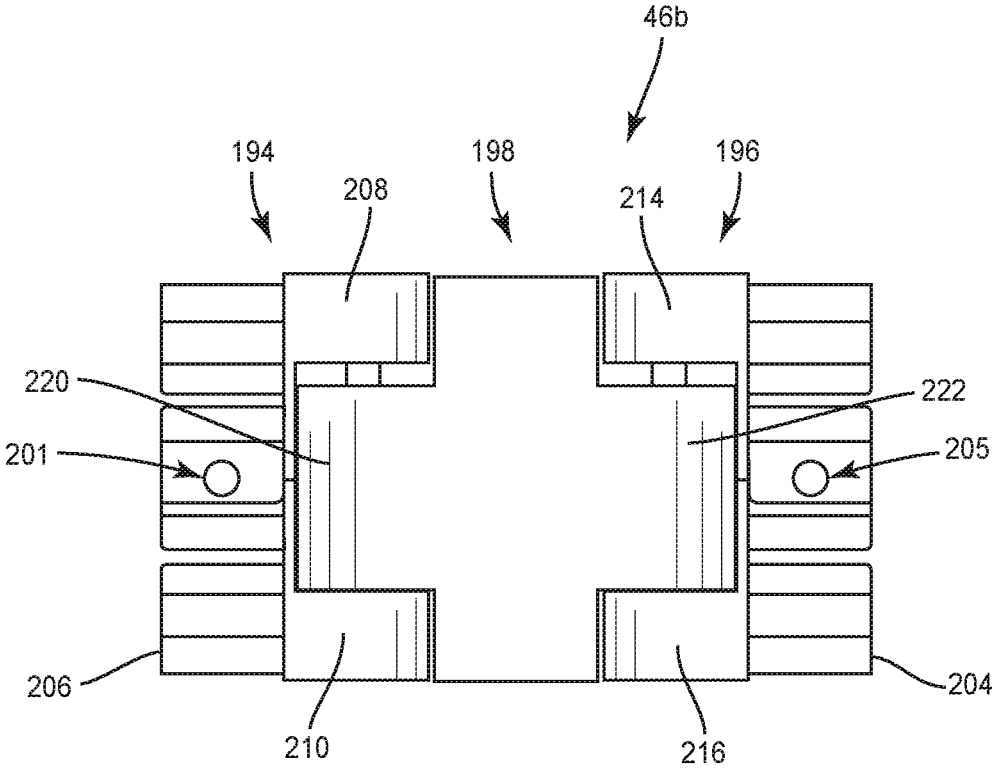
FIG. 41 is a side view of a component of the mattress assembly shown in FIG. 32.
Figure 42:
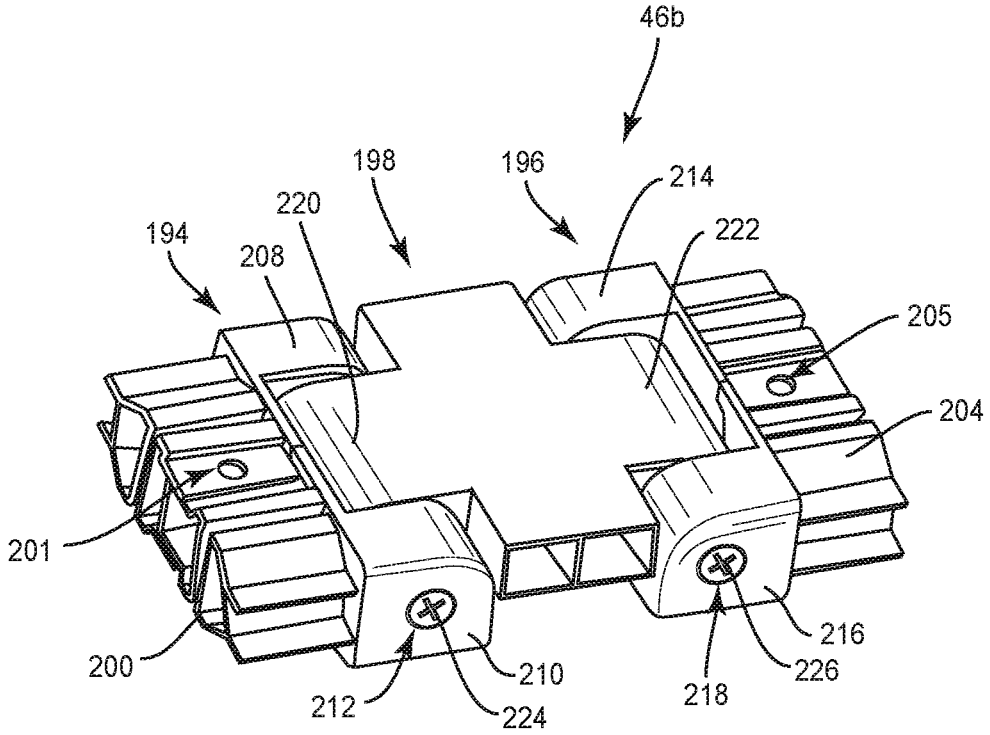
FIG. 42 is a perspective view of a component of the mattress assembly shown in FIG. 32.
Figure 43:
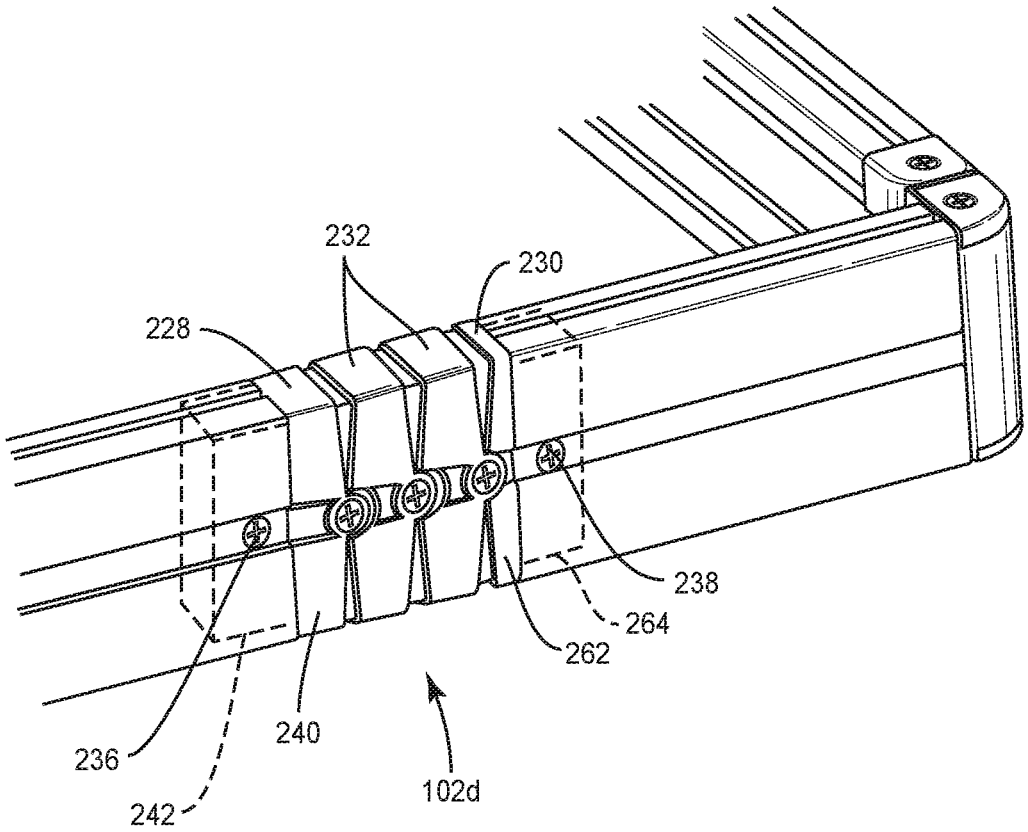
FIG. 43 is a perspective view of a component of the mattress assembly shown in FIG. 32.
Figure 44:
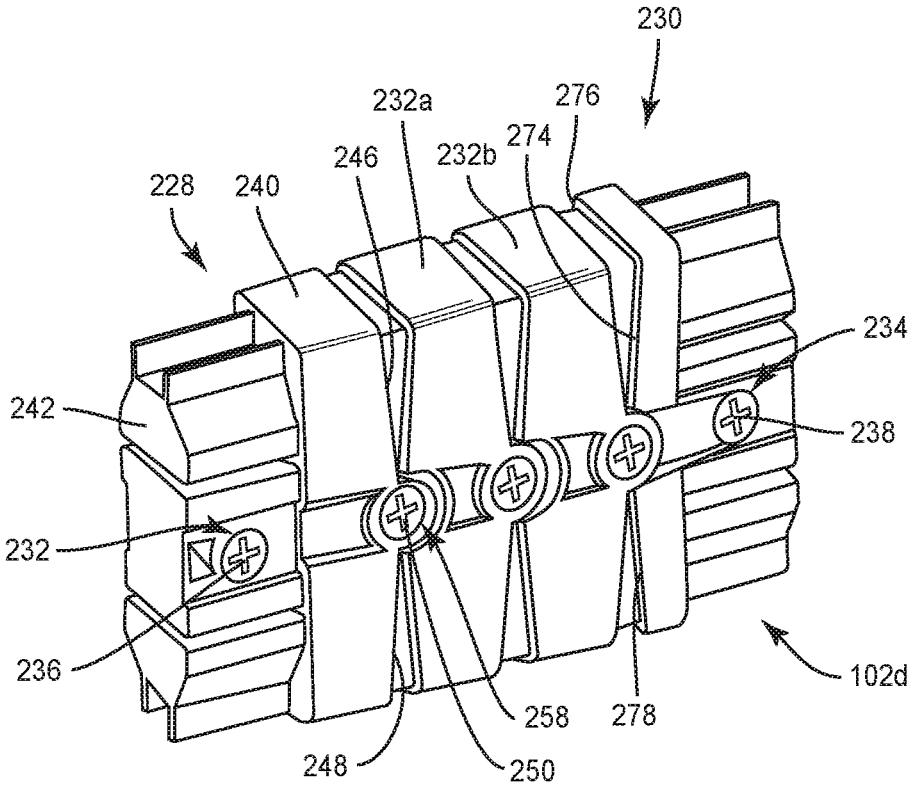
FIG. 44 is a perspective view of a component of the mattress assembly shown in FIG. 32.
Figure 45:
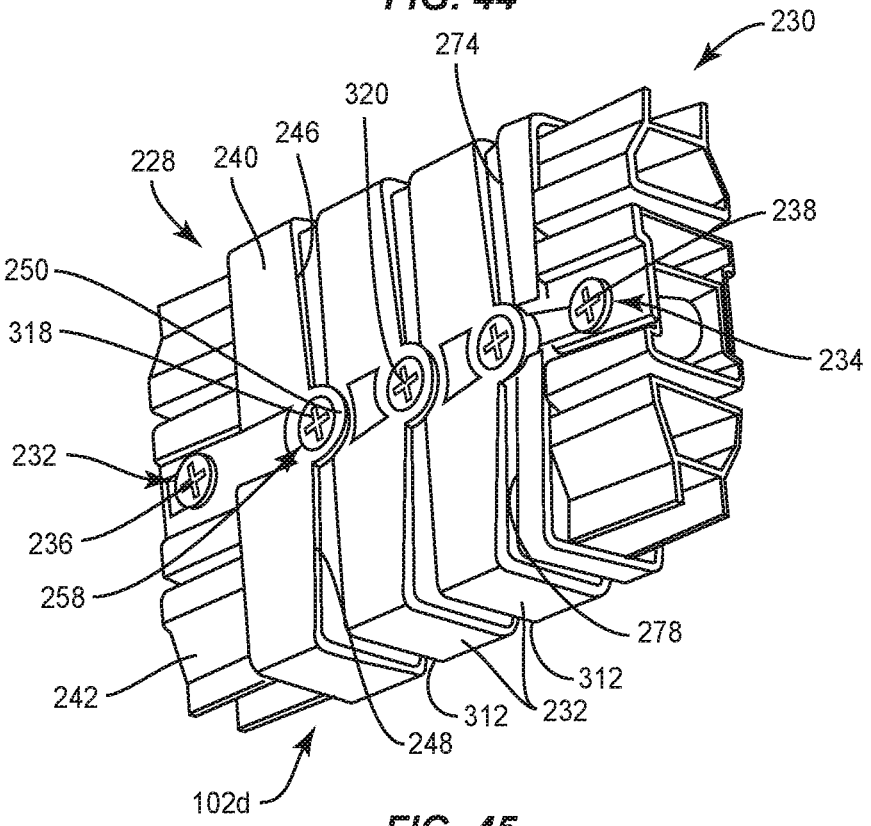
FIG. 45 is a perspective view of a component of the mattress assembly shown in FIG. 32.
Figure 46:
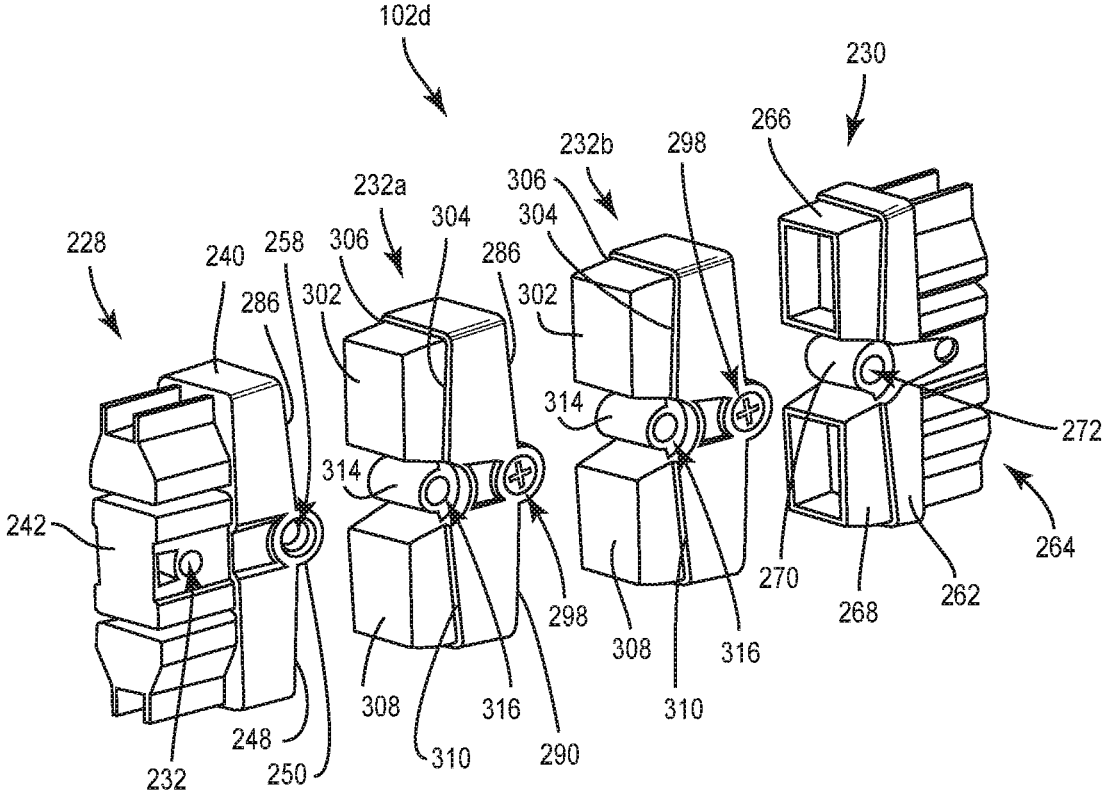
FIG. 46 is a perspective view of a component of the mattress assembly shown in FIG. 32, with parts separated.
Figure 47:
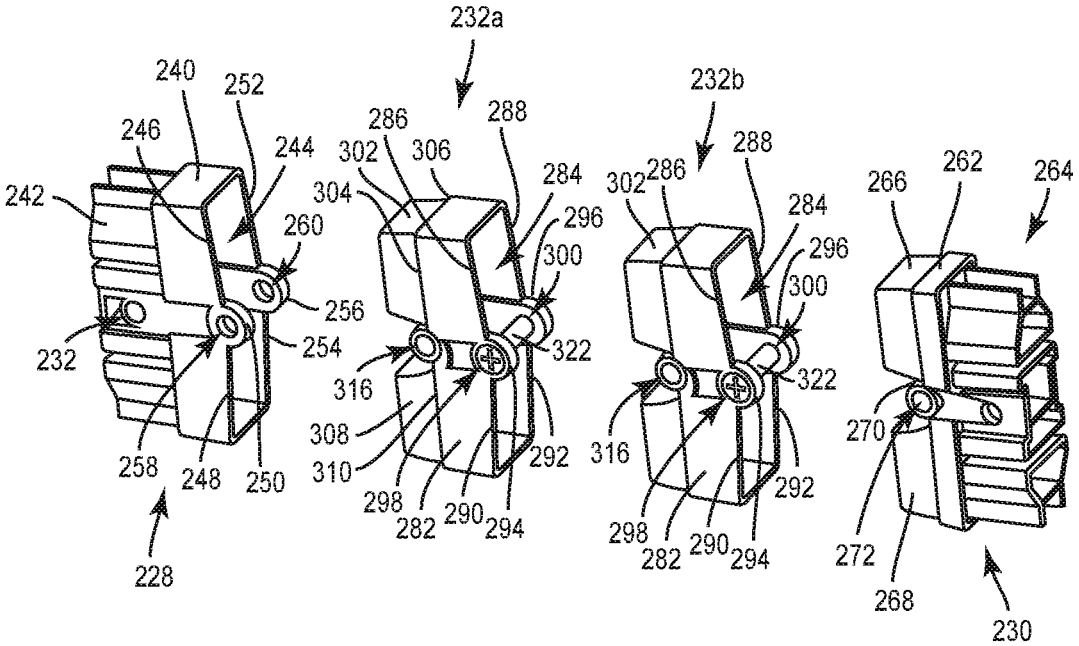
FIG. 47 is a perspective view of a component of the mattress assembly shown in FIG. 32, with parts separated.

In one embodiment, shown in FIGS. 32-45, mattress assembly 30 includes hinges configured to allow chassis 32 to move from a folded configuration, as shown in FIG. 32, to an unfolded configuration, as shown in FIG. 33. The hinges also allow chassis 32 to move from a planar orientation, as shown in FIG. 33, to an arcuate orientation, as shown in FIG. 34.

Mattress assembly 30 includes corner hinges 44*b* that are similar to hinges 44 and/or hinges 44*a* discussed herein. In particular, mattress assembly 30 includes a first hinge 44*b* that connects first section 34*a* of top wall 34 with sidewall 38 to allow section 34*a* to pivot relative to sidewall 38. First hinge 44*b* is configured to move between a first orientation in which section 34*a* extends parallel to sidewall 38 and a second orientation in which section 34*a* extends perpendicular to sidewall 38. Mattress assembly 30 includes a second hinge 44*b* that connects second section 34*b* of top wall 34 with sidewall 40 to allow section 34*b* to pivot relative to sidewall 40. Second hinge 44*b* is configured to move between a first orientation in which section 34*b* extends parallel to sidewall 40 and a second orientation in which section 34*b* extends perpendicular to sidewall 40. Mattress assembly 30 includes a third hinge 44*b* that connects first section 36*a* of bottom wall 36 with sidewall 38 to allow section 36*a* to pivot relative to sidewall 38. Third hinge 44*b* is configured to move between a first orientation in which section 36*a* extends parallel to sidewall 38 and a second orientation in which section 36*a* extends perpendicular to sidewall 38. Mattress assembly 30 includes a fourth hinge 44*b* that connects second section 36*b* of bottom wall 36 with sidewall 40 to allow section 36*b* to pivot relative to sidewall 40. Fourth hinge 44*b* is configured to move between a first orientation in which section 36*b* extends parallel to sidewall 40 and a second orientation in which section 36*b* extends perpendicular to sidewall 40.

As shown in FIGS. 35-38, hinges 44*b* each include a part 174 having a body 176. A first extension 178 extends from one side of body 176 and a second extension 180 extends from another side of body 176 such that extensions 178, 180 are spaced apart from one another. Extension 178 is configured for pivotal engagement with a part 182 of hinge 44*b*, as discussed herein. Extension 180 is configured for disposal in a cavity of one of top wall 34, bottom wall 36, sidewall 38, or sidewall 40 to fix body 176 to top wall 34, bottom wall 36, sidewall 38, or sidewall 40. In some embodiments, extension 180 has a configuration that mates with an inner surface that defines the cavity of top wall 34, bottom wall 36, sidewall 38, or sidewall 40. In some embodiments, a fastener, such as, for example, a screw 181 is inserted through an outer surface of top wall 34, bottom wall 36, sidewall 38, or sidewall 40 and into extension 180 to fix part 174 to top wall 34, bottom wall 36, sidewall 38, or sidewall 40. In some embodiments, extension 180 includes an opening 183 configured for disposal of screw 181.

Extension 178 includes a passageway that extends through a thickness of extension 178 to pivotally connect part 174 with part 182, as discussed herein. Extension 178 extends transverse to extension 180. In some embodiments, extension 178 extends perpendicular to extension 180. In some embodiments, extension 178 may be disposed at alternate orientations, relative to extension 180, such as, for example, other angular orientations such as acute or obtuse, co-axial and/or may be offset or staggered.

Part 182 includes an extension 184 and spaced apart flanges 186, 188 that extend from extension 184. Flanges 186, 188 each include an opening 190 that extends through a thickness of each of flanges 186, 188. Extension 178 of part 174 is positioned between flanges 186, 188 such that openings 190 are aligned with the passageway in extension 178. A pin 192 is positioned through openings 190 and the passageway in extension 178 to allow part 174 to pivot relative to part 182 about pin 192. In some embodiments, extension 184 has a configuration that mates with an inner surface that defines the cavity of top wall 34, bottom wall 36, sidewall 38, or sidewall 40. In some embodiments, a fastener, such as, for example, a screw 185 is inserted through an outer surface of top wall 34, bottom wall 36, sidewall 38, or sidewall 40 and into extension 180 to fix part 176 to top wall 34, bottom wall 36, sidewall 38, or sidewall 40. In some embodiments, extension 184 includes an opening 187 configured for disposal of screw 185.

Mattress assembly 30 includes head/foot hinges 46*b* that are similar to hinges 46 and/or hinges 46*a* discussed herein. In particular, mattress assembly 30 includes a first hinge 46*b* that connects first section 34*a* of top wall 34 with second section 34*b* of top wall 34 to allow section 34*a* to pivot relative to section 34*b*. First hinge 46*b* is configured to move between a first orientation in which section 34*a* extends perpendicular to section 34*b* and a second orientation in which section 34*a* extends parallel to section 34*b*. Mattress assembly 30 includes a second hinge 46*b* that connects first section 36*a* of bottom wall 36 with second section 36*b* of bottom wall 36 to allow section 36*a* to pivot relative to section 36*b*. Second hinge 46*b* is configured to move between a first orientation in which section 36*a* extends perpendicular to section 36*b* and a second orientation in which section 36*a* extends parallel to section 36*b*.

As shown in FIGS. 39-42, hinges 46*b* each include a part 194, a part 196 and a body 198 that is coupled to parts 194, 196 such that parts 194, 196 are pivotable relative to body 198. Part 194 includes an extension 200 configured for disposal in a cavity of one of sections 34*a*, 34*b*, 36*a*, 36*b* to fix part 194 to one of sections 34*a*, 34*b*, 36*a*, 36*b*. In some embodiments, extension 200 has a configuration that mates with an inner surface that defines the cavity of one of sections 34*a*, 34*b*, 36*a*, 36*b*. In some embodiments, a fastener, such as, for example, a screw 202 is inserted through an outer surface of one of sections 34*a*, 34*b*, 36*a*, 36*b* and into extension 200 to fix part 174 to one of sections 34*a*, 34*b*, 36*a*, 36*b*. In some embodiments, extension 200 includes an opening 201 configured for disposal of screw 202.

Part 196 includes an extension 204 configured for disposal in a cavity of one of sections 34*a*, 34*b*, 36*a*, 36*b* to fix part 196 to one of sections 34*a*, 34*b*, 36*a*, 36*b*. In some embodiments, extension 204 has a configuration that mates with an inner surface that defines the cavity of one of sections 34*a*, 34*b*, 36*a*, 36*b*. In some embodiments, a fastener, such as, for example, a screw 206 is inserted through an outer surface of one of sections 34*a*, 34*b*, 36*a*, 36*b* and into extension 200 to fix part 176 to one of sections 34*a*, 34*b*, 36*a*, 36*b*. In some embodiments, extension 204 includes an opening 205 configured for disposal of screw 206.

Part 194 includes spaced apart flanges 208, 210 that extend from extension 200. Flanges 208, 210 each include an opening 212 that extends through a thickness of flange 208 or flange 210. Part 196 includes spaced apart flanges 214, 216 that extend from extension 204. Flanges 214, 216 each include an opening 218 that extends through a thickness of flange 214 or flange 216. Flange 208 is aligned with flange 214 and flange 210 is aligned with flange 216.

Body 198 includes an arm 220 that extends from one side of body 198 and an arm 222 that extends from an opposite side of body 198. Arm 220 is positioned between flanges 208, 210 such that a passageway that extends through a thickness of arm 220 is aligned with openings 212. A pin 224 is inserted through openings 212 and the passageway of arm 200 to allow part 194 to pivot relative to body 198. Arm 222 is positioned between flanges 214, 216 such that a passageway that extends through a thickness of arm 222 is aligned with openings 218. A pin 226 is inserted through openings 218 and the passageway of arm 202 to allow part 196 to pivot relative to body 198.

Mattress assembly 30 includes neck hinges 102*d* that are similar to hinges 102, 102*a*, 102*b*, 102*c* discussed herein. In particular, mattress assembly 30 includes a first hinge 102*d* that connects section 38*d* of sidewall 38 with section 38*c* of sidewall 38 to allow section 38*d* to pivot relative to section 38*c*. First hinge 102*d* is configured to move between a first orientation in which section 38*d* extends parallel to section 38*c* and a second orientation in which section 38*d* extends transverse to section 38*c*. Mattress assembly 30 includes a second hinge 102*d* that connects section 40*d* of sidewall 40 with section 40*c* of sidewall 40 to allow section 40*d* to pivot relative to section 40*c*. Second hinge 102*d* is configured to move between a first orientation in which section 40*d* extends parallel to section 40*c* and a second orientation in which section 40*d* extends transverse to section 40*c*. In some embodiments, hinges 102*d* are similar to or identical to one or more of the hinges described in co-owned U.S. Patent Application No. 62/443,260, filed Jan. 6, 2017, which is expressly incorporated herein by reference, in its entirety.

Hinges 102*d* each include an end plate 228, an end plate 230 and one or more inner plates 232 between end plate 228 and end plate 230. End plate 228 is fixedly attached to section 38*c* of sidewall 38, section 38*d* of sidewall 38, section 40*c* of sidewall 40 or section 40*d* of sidewall 40 and end plate 122 is fixedly attached to section 38*c* of sidewall 38, section 38*d* of sidewall 38, section 40*c* of sidewall 40 or section 40*d* of sidewall 40. In some embodiments, end plate 228 includes an opening 232 and end plate 230 includes an opening 234. A pin 236 extends through sidewall 38 or sidewall 40 and into opening 232 to fix end plate 228 to sidewall 38 or sidewall 40 and a pin 238 extends through sidewall 38 or sidewall 40 and into opening 234 to fix end plate 230 to sidewall 38 or sidewall 40.

End plate 228 includes a body 240 and an extension 242 that extends from body 240. Opening 232 extends through extension 242. Extension 242 is configured for disposal in a cavity of sidewall 38 or sidewall 40. In some embodiments, extension 242 has a configuration that mates with an inner surface that defines the cavity of one of sidewall 38 or sidewall 40. Body 240 comprises an inner surface defining an aperture 244 configured for movable disposal of a portion of one of inner plates 232, as discussed herein. Body 240 includes inclined surfaces 246, 248 and a convex portion 250 between surfaces 246, 248. Body 240 includes inclined surfaces 252, 254 opposite inclined surfaces 246, 248 and a convex portion 256 between surfaces 252, 254. Convex portion 250 includes a hole 258 that is coaxial with a hole 260 of convex portion 256.

End plate 230 includes a body 262 and an extension 264 that extends from body 262. Opening 234 extends through extension 264. Extension 264 is configured for disposal in a cavity of sidewall 38 or sidewall 40. In some embodiments, extension 264 has a configuration that mates with an inner surface that defines the cavity of one of sidewall 38 or sidewall 40. Body 262 comprises a block 266, a block 268 and a cylindrical portion 270 between blocks 266, 268. Cylindrical portion 270 includes a passageway 272 that extends through a thickness of cylindrical portion 270. Block 266 extends from opposite inclined surfaces 274, 276 of body 262 and block 268 extends from opposite inclined surfaces 278, 280 of body 262. Cylindrical portion 270 is positioned between inclined surfaces 274, 276 and inclined surfaces 278, 280.

Inner plates 232 each include a body 282. An inner surface of body 282 defines an aperture 284 configured for disposal of a portion of another inner plate 232 or blocks 266, 268 of end plate 230, as discussed herein. Body 282 includes spaced apart inclined surfaces 286, 288 and spaced apart inclined surfaces 290, 292. A cylindrical portion 294 is positioned between inclined surfaces 286, 290 and a cylindrical portion 296 is positioned between inclined surfaces 288, 292. Portion 294 includes an opening 298 that extends through a thickness of portion 294 and portion 296 includes an opening 300 that extends through a thickness of portion 296. Inner plates 232 each include a block 302 that extends from spaced apart inclined surfaces 304, 306 of body 282 and a block 308 that extends from spaced apart inclined surfaces 310, 312 of body 282. A cylindrical portion 314 is positioned between block 302 and block 308. Cylindrical portion 314 includes a passageway 316 that extends through a thickness of cylindrical portion 314.

Blocks 302, 308 of a first inner plate 232*a* are positioned within aperture 244 of end plate 228 such that passageway 316 is aligned and/or coaxial with openings 258, 260 of first inner plate 232*a*. A pin 318 is positioned through openings 258, 260 and passageway 316 to allow first inner plate 232*a* to pivot relative to end plate 228 about pin 318. First inner plate 232*a* is pivotable relative to end plate 228 between a first orientation, a second orientation and a third orientation. In the first orientation, inclined surfaces 304, 306 of first inner plate 232*a* directly engage inclined surfaces 246, 252 of end plate 228 and inclined surfaces 310, 312 of first inner plate 232*a* are spaced apart from inclined surfaces 248, 254 of end plate 228. In the second orientation, inclined surfaces 304, 306 of first inner plate 232*a* are spaced apart from inclined surfaces 246, 252 of end plate 228 and inclined surfaces 310, 312 of first inner plate 232*a* are spaced apart from inclined surfaces 248, 254 of end plate 228. In the third orientation, inclined surfaces 304, 306 of first inner plate 232*a* are spaced apart from inclined surfaces 246, 252 of end plate 228 and inclined surfaces 310, 312 of first inner plate 232*a* directly engage inclined surfaces 248, 254 of end plate 228. Inclined surfaces 246, 248, 252, 254, 304, 306, 308, 310 thus define stops that limit the amount first inner plate 232*a* pivots relative to end plate 228.

Blocks 302, 308 of a second inner plate 232*b* are positioned within aperture 284 of first inner plate 232*a* such that passageway 316 of second inner plate 232*b* is aligned and/or coaxial with openings 298, 300 of first inner plate 232*a*. A pin 320 is positioned through openings 298, 300 of first inner plate 232*a* and passageway 316 of second inner plate 232*b* to allow first inner plate 232*a* to pivot relative to second inner plate 232*b* about pin 320. First inner plate 232*a* is pivotable relative to second inner plate 232*b* between a first orientation, a second orientation and a third orientation. In the first orientation, inclined surfaces 286, 288 of first inner plate 232*a* directly engage inclined surfaces 302, 304 of second inner plate 232*b* and inclined surfaces 310, 312 of first inner plate 232 are spaced apart from inclined surfaces 290, 292 of second inner plate 232*b*. In the second orientation, inclined surfaces 286, 288 of first inner plate 232*a* are spaced apart from inclined surfaces 302, 304 of second inner plate 232*b* and inclined surfaces 310, 312 of first inner plate 232 are spaced apart from inclined surfaces 290, 292 of second inner plate 232*b*. In the third orientation, inclined surfaces 286, 288 of first inner plate 232*a* are spaced apart from inclined surfaces 302, 304 of second inner plate 232*b* and inclined surfaces 310, 312 of first inner plate 232 directly engage inclined surfaces 290, 292 of second inner plate 232*b*. Inclined surfaces 286, 288, 290, 292, 304, 306, 308, 310 thus define stops that limit the amount first inner plate 232*a* pivots relative to second inner plate 232*b*.

Blocks 266, 268 of end plate 230 are positioned within aperture 284 of second inner plate 232*b* such that passageway 272 of end plate 230 is aligned and/or coaxial with openings 298, 300 of second inner plate 232*b*. A pin 322 is inserted through passageway 272 of end plate 230 and openings 298, 300 of second inner plate 232*b* such that of second inner plate 232*b* is pivotable relative to end plate 230 about pin 322. Second inner plate 232*b* is pivotable relative to end plate between a first orientation, a second orientation and a third orientation. In the first orientation, inclined surfaces 286, 288 of second inner plate 232*b* directly engage inclined surfaces 274, 276 of end plate 230 and inclined surfaces 310, 312 of second inner plate 232*b* are spaced apart from inclined surfaces 278, 280 of end plate 228. In the second orientation, inclined surfaces 286, 288 of second inner plate 232*b* are spaced apart from inclined surfaces 274, 276 of end plate 230 and inclined surfaces 310, 312 of second inner plate 232*b* are spaced apart from inclined surfaces 278, 280 of end plate 228. In the third orientation, inclined surfaces 286, 288 of second inner plate 232*b* are spaced apart from inclined surfaces 274, 276 of end plate 230 and inclined surfaces 310, 312 of second inner plate 232*b* directly engage inclined surfaces 278, 280 of end plate 228. Inclined surfaces 286, 288, 290, 290 of second inner plate 232*b* and inclined surfaces 274, 276, 278, 280 of end plate 230 thus define stops that limit the amount second inner plate 232*b* pivots relative to end plate 230.

Mattress assembly 30 includes torso hinges 102*e* that are similar to hinges 102, 102*a*, 102*b*, 102*c*, 102*d* discussed herein. In particular, mattress assembly 30 includes a first hinge 102*e* that connects section 38*c* of sidewall 38 with section 38*b* of sidewall 38 to allow section 38*c* to pivot relative to section 38*b*. First hinge 102*e* is configured to move between a first orientation in which section 38*c* extends parallel to section 38*b* and a second orientation in which section 38*c* extends transverse to section 38*b*. Mattress assembly 30 includes a second hinge 102*e* that connects section 40*d* of sidewall 40 with section 40*c* of sidewall 40 to allow section 40*d* to pivot relative to section 40*c*. Second hinge 102*e* is configured to move between a first orientation in which section 40*d* extends parallel to section 40*c* and a second orientation in which section 40*d* extends transverse to section 40*c*. In some embodiments, hinges 102*e* are similar to or identical to one or more of the hinges described in co-owned U.S. Patent Application No. 62/443,260, filed Jan. 6, 2017, which is expressly incorporated herein by reference, in its entirety.

Mattress assembly 30 includes knee hinges 102*f* that are similar to hinges 102, 102*a*, 102*b*, 102*c*, 102*d*, 102*e* discussed herein. In particular, mattress assembly 30 includes a first hinge 102*f* that connects section 38*b* of sidewall 38 with section 38*a* of sidewall 38 to allow section 38*b* to pivot relative to section 38*a*. First hinge 102*f* is configured to move between a first orientation in which section 38*b* extends parallel to section 38*a* and a second orientation in which section 38*b* extends transverse to section 38*a*. Mattress assembly 30 includes a second hinge 102*f* that connects section 40*b* of sidewall 40 with section 40*a* of sidewall 40 to allow section 40*b* to pivot relative to section 40*a*. Second hinge 102*f* is configured to move between a first orientation in which section 40*b* extends parallel to section 40*b* and a second orientation in which section 40*b* extends transverse to section 40*a*. In some embodiments, hinges 102*f* are similar to or identical to one or more of the hinges described in co-owned U.S. Patent Application No. 62/443,260, filed Jan. 6, 2017, which is expressly incorporated herein by reference, in its entirety.

Figure 48:
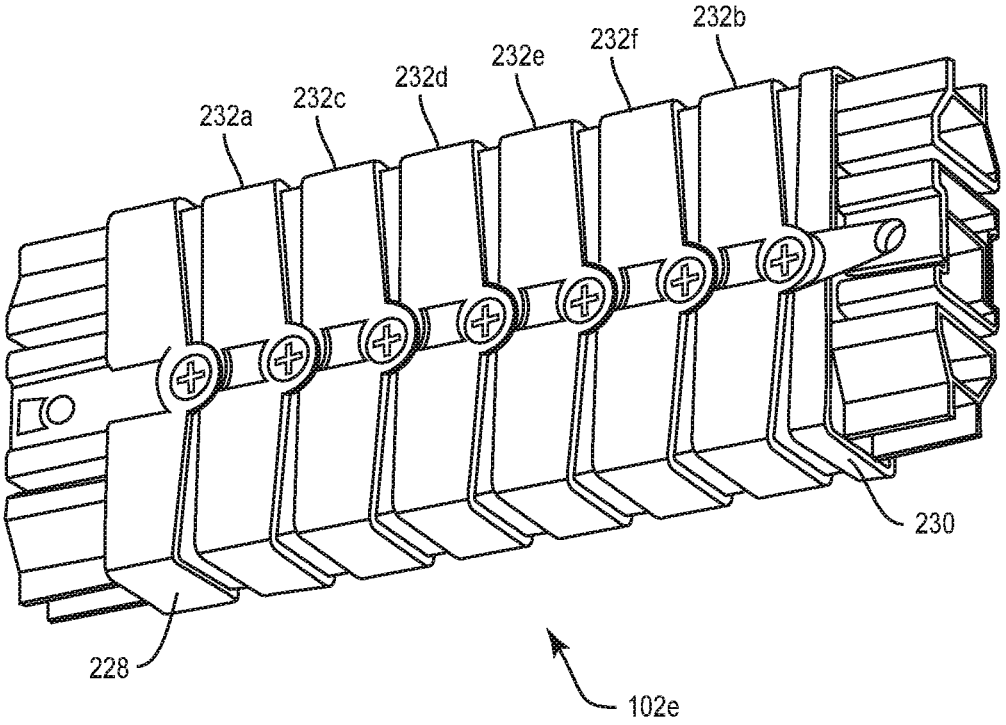
FIG. 48 is a perspective view of a component of the mattress assembly shown in FIG. 32.

Hinges 102*e*, 102*f* are similar to hinges 102*d*, except that hinges 102*e*, 102*f* include additional inner plates 232 between inner plate 232*a* and inner plate 232*b*. For example, hinges 102*e* may include inner plates 232*c*, 232*d*, 232*e*, 232*f* between inner plate 232*a* and inner plate 232*b*, as shown in FIG. 48. Inner plate 232*c* of hinge 102*e* is connected inner plate 232*a* of hinge 102*e* in the same manner as inner plate 232*a* of hinge 102*d* is connected to inner plate 232*b* of hinge 102*d*. Inner plate 232*d* of hinge 102*e* is connected inner plate 232*c* of hinge 102*e* in the same manner as inner plate 232*a* of hinge 102*d* is connected to inner plate 232*b* of hinge 102*d*. Inner plate 232*e* of hinge 102*e* is connected inner plate 232*d* of hinge 102*e* in the same manner as inner plate 232*a* of hinge 102*d* is connected to inner plate 232*b* of hinge 102*d*. Inner plate 232*f* of hinge 102*e* is connected inner plate 232*b* of hinge 102*e* in the same manner as inner plate 232*a* of hinge 102*d* is connected to inner plate 232*b* of hinge 102*d*. It is envisioned that hinges 102*e*, 102*f* may each include one or a plurality of inner plates 232 between end plate 228 and end plate 230.

Figure 49:
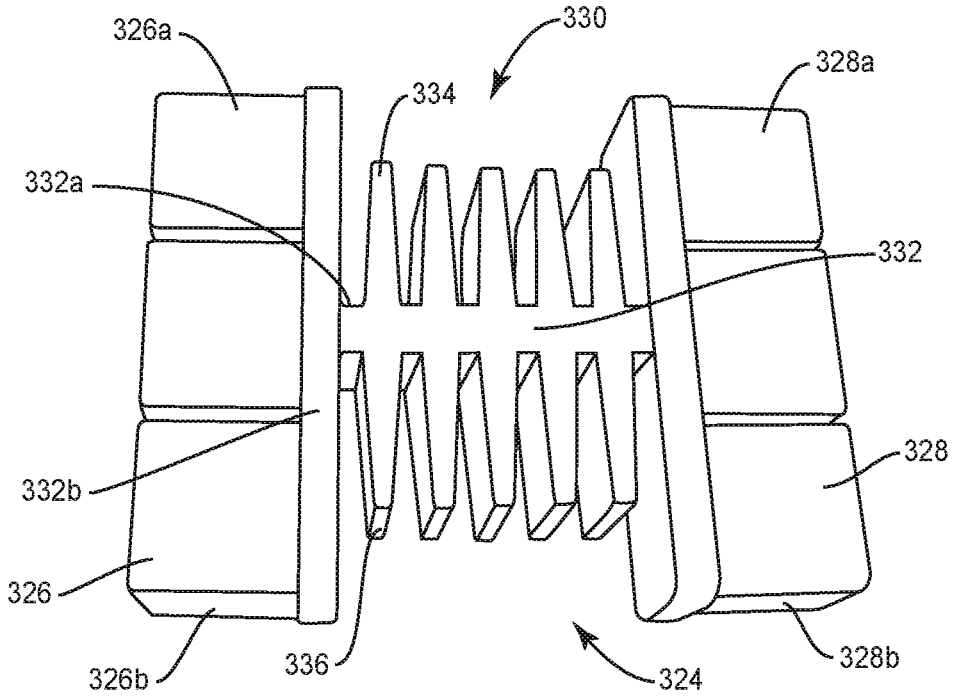
FIG. 49 is a perspective view of one embodiment of a component of the mattress assembly shown in FIG. 1, in accordance with the principles of the present disclosure.
Figure 50:
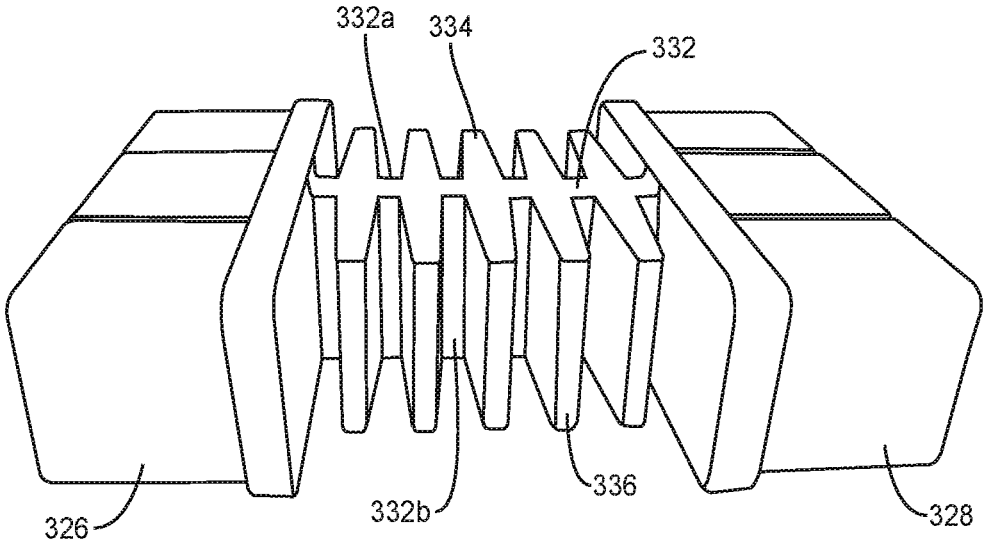
FIG. 50 is a perspective view of the component shown in FIG. 49.

In some embodiments, mattress assembly 30 may include a hinge 324, shown in FIGS. 49 and 50, in place of hinge 102*a*, hinge 102*b*, hinge 102*c*, hinge 102*d*, hinge 102*e*, and/or hinge 102*f* to allow a portion of sidewall 38 to pivot relative to another section of sidewall 38 and/or to allow a portion of sidewall 40 to pivot relative to another section of sidewall 40. Hinge 324 includes an extension 326, and extension 328 and a central portion 330 between extensions 326, 328. Extension 326 is configured for disposal in a first portion of sidewall 38 and/or sidewall 40 and extension 328 is configured for disposal in a second portion of sidewall 38 and/or sidewall 40. In some embodiments, extensions 326, 328 are configured for disposal in sidewall 38 and/or sidewall 40 such that extensions 326, 328 are fixed relative to sidewall 38 and/or sidewall 40. In some embodiments, extensions 326, 328 are deformable such that extensions 326, 328 are fixed relative to sidewall 38 and/or sidewall 40 when extensions 326, 328 are disposed in sidewall 38 and/or sidewall 40.

Central portion 330 includes a rib 332 that connects extension 326 with extension 328. Extensions 326, 328 are each deflectable relative to rib 332 to allow extension 326 to pivot relative to extension 328. Central portion 330 includes a plurality of spaced apart fins 334 that extend from a first side 332*a* of rib 332 and a plurality of spaced apart fins 336 that extend from a second side 332*b* of rib 332. As shown in FIGS. 49 and 50, each one of fins 334 is aligned with one of fins 336. Fins 334 are configured to directly engage extension 326, extension 328 or another one of fins 334 to limit the amount that extension 326 can pivot relative to extension 328. Likewise, fins 336 are configured to directly engage extension 326, extension 328 or another one of fins 336 to limit the amount that extension 326 can pivot relative to extension 328. For example, extension 326 may be pivoted relative to extension 328 such that first ends 326*a*, 328*a* of extensions 326, 328 are moved toward one another and opposite second ends 326*b*, 328*b* of extensions 326, 328 are moved away from one another. As first ends 326*a*, 328*a* of extensions 326, 328 are moved toward one another, the space between adjacent fins 336 increases and fins 334 engage another one of fins 334 and/or one of extensions 326, 328 to limit the amount that extension 326 pivots relative to extension 328. Extension 326 may be also pivoted relative to extension 328 such that first ends 326*a*, 328*a* of extensions 326, 328 are moved away from one another and second ends 326*b*, 328*b* of extensions 326, 328 are moved toward one another. As second ends 326*b*, 328*b* of extensions 326, 328 are moved toward one another, the space between adjacent fins 334 increases and fins 336 engage another one of fins 336 and/or one of extensions 326, 328 to limit the amount that extension 326 pivots relative to extension 328.

Figure 51:
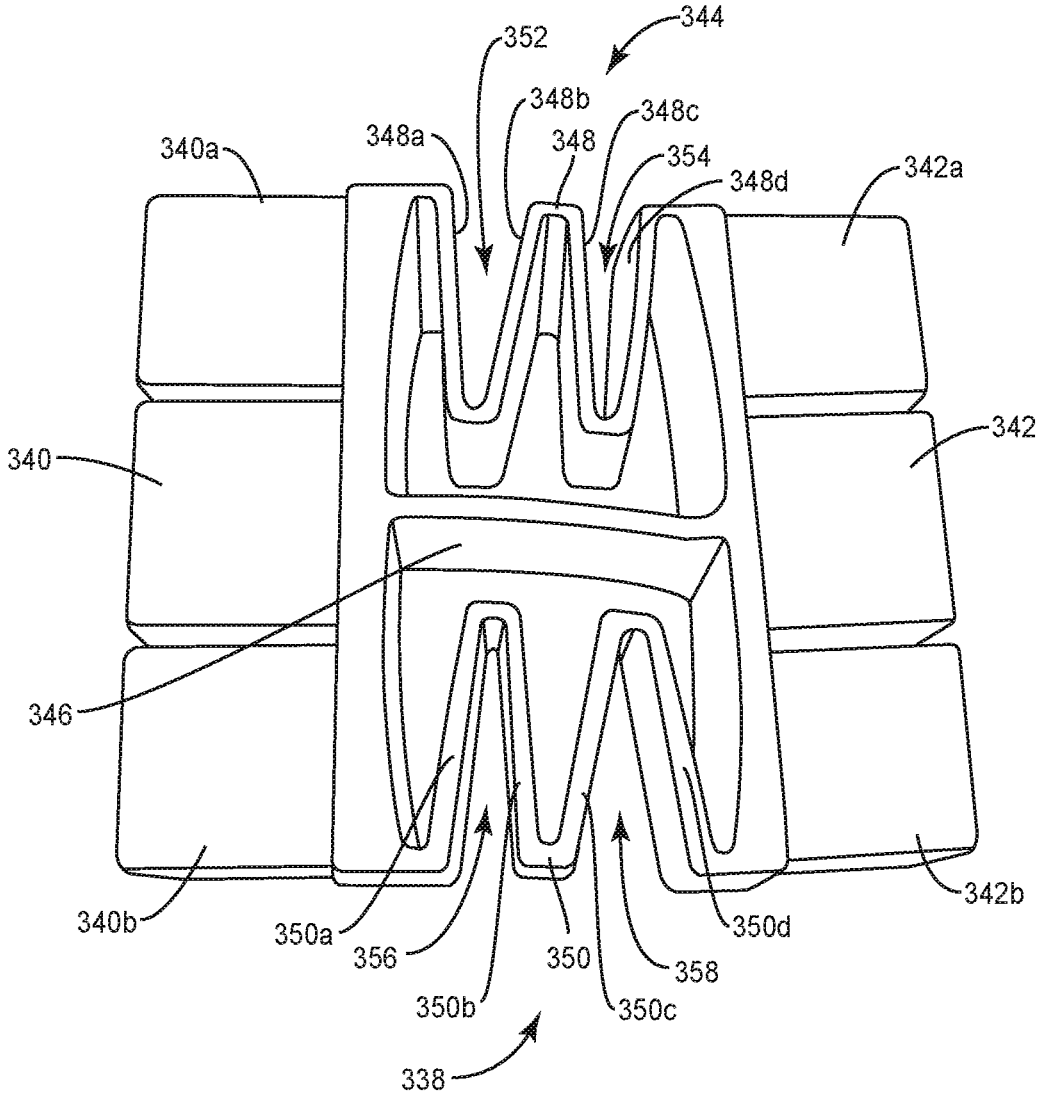
FIG. 51 is a perspective view of one embodiment of a component of the mattress assembly shown in FIG. 1, in accordance with the principles of the present disclosure.
Figure 52:
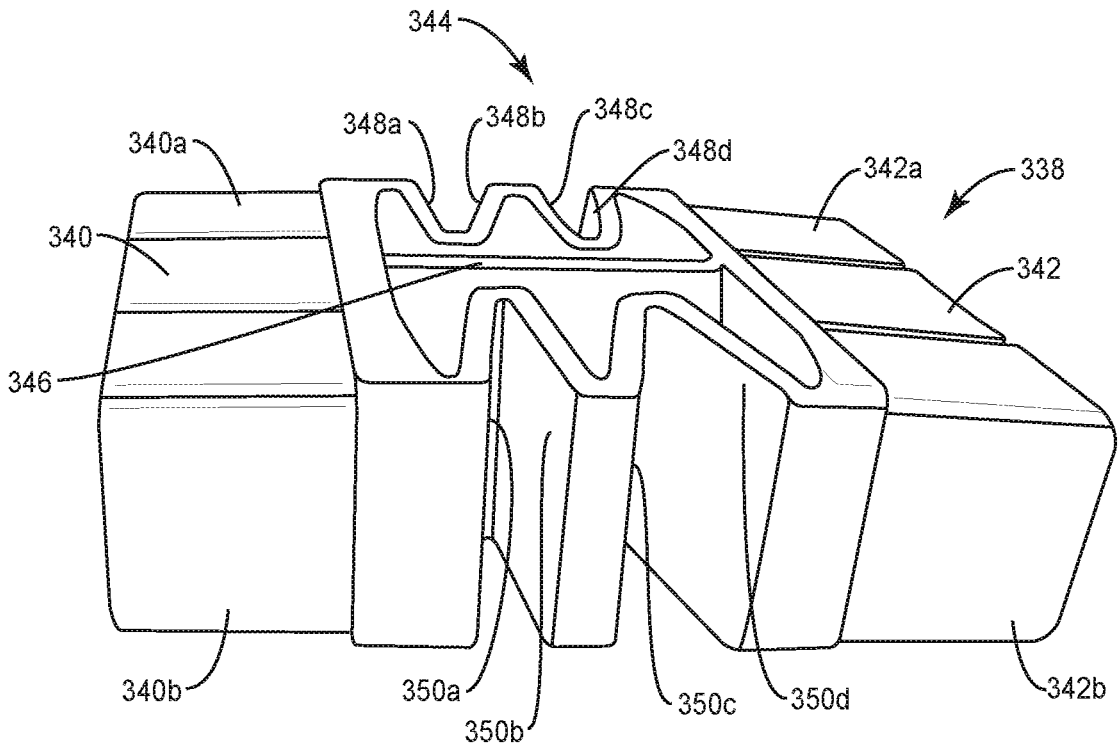
FIG. 52 is a perspective view of the component shown in FIG. 51.

In some embodiments, mattress assembly 30 may include a hinge 338, shown in FIGS. 51 and 52, in place of hinge 102*a*, hinge 102*b*, hinge 102*c*, hinge 102*d*, hinge 102*e*, and/or hinge 102*f* to allow a portion of sidewall 38 to pivot relative to another section of sidewall 38 and/or to allow a portion of sidewall 40 to pivot relative to another section of sidewall 40. Hinge 338 includes an extension 340, and extension 342 and a central portion 344 between extensions 340, 342. Extension 340 is configured for disposal in a first portion of sidewall 38 and/or sidewall 40 and extension 342 is configured for disposal in a second portion of sidewall 38 and/or sidewall 40. In some embodiments, extensions 340, 342 are configured for disposal in sidewall 38 and/or sidewall 40 such that extensions 340, 342 are fixed relative to sidewall 38 and/or sidewall 40. In some embodiments, extensions 340, 342 are deformable such that extensions 340, 342 are fixed relative to sidewall 38 and/or sidewall 40 when extensions 340, 342 are disposed in sidewall 38 and/or sidewall 40.

Central portion 344 includes a rib 346 that connects extension 340 with extension 342. Extensions 340, 342 are each deflectable relative to rib 346 to allow extension 340 to pivot relative to extension 342. Central portion 344 includes a wall 348 that connects a first end 340*a* of extension 340 with a first end 342*a* of extension 342 and a wall 350 that connects a second end 340*b* of extension 340 with a second end 342*b* of extension 342. Rib 346 is spaced apart from walls 348, 350. Wall 348 includes a section 348*a* that is connected to a section 348*b* of wall 348 to define a concave portion 352 of wall 348. Section 348*a* extends transverse to section 348*b*. Wall 348 includes a section 348*c* that is connected to a section 348*d* of wall 348 to define a concave portion 354 of wall 348. Section 348*c* extends transverse to section 348*d*. Section 348*a* is connected to extension 340 by a portion of wall 348 that extends transverse to sections 348*b*, 348*c*. Section 348*a* is connected to section 348*b* by a portion of wall 348 that extends transverse to sections 348*a*, 348*b*. Section 348*c* is connected to section 348*b* by a portion of wall 348 that extends transverse to sections 348*b*, 348*c*. Section 348*c* is connected to section 348*d* by a portion of wall 348 that extends transverse to sections 348*c*, 348*d*. Section 348*d* is connected to extension 342 by a portion of wall 348 that extends transverse to sections 348*b*, 348*c*.

Wall 350 includes a section 350*a* that is connected to a section 350*b* of wall 350 to define a concave portion 356 of wall 350. Section 350*a* extends transverse to section 350*b*. Wall 350 includes a section 350*c* that is connected to a section 350*d* of wall 350 to define a concave portion 358 of wall 348. Section 350*c* extends transverse to section 350*d*. Section 350*a* is connected to extension 340 by a portion of wall 350 that extends transverse to sections 350*b*, 350*c*. Section 350*a* is connected to section 350*b* by a portion of wall 350 that extends transverse to sections 350*a*, 350*b*. Section 350*c* is connected to section 350*b* by a portion of wall 350 that extends transverse to sections 350*b*, 350*c*. Section 350*c* is connected to section 350*d* by a portion of wall 350 that extends transverse to sections 350*c*, 350*d*. Section 350*d* is connected to extension 342 by a portion of wall 350 that extends transverse to sections 350*b*, 350*c*.

Sections 348*a*, 348*d* are configured to directly engage extension 340, extension 342 or one of sections 348*b*, 348*c* to limit the amount that extension 340 can pivot relative to extension 342. Likewise, sections 350*a*, 350*d* are configured to directly engage extension 340, extension 342 or one of sections 350*b*, 350*c* to limit the amount that extension 340 can pivot relative to extension 342. For example, extension 340 may be pivoted relative to extension 342 such that first ends 340*a*, 342*a* of extensions 340, 342 are moved toward one another and opposite second ends 340*b*, 342*b* of extensions 340, 342 are moved away from one another. As first ends 340*a*, 342*a* of extensions 340, 342 are moved toward one another, the space between extension 340 and section 348*a*, between section 348*a* and section 348*b*, between section 348*b* and section 348*c*, between section 348*c* and section 348*d*, and/or between section 348*d* and extension 342 decreases and the space between extension 340 and section 350*a*, between section 350*a* and section 350*b*, between section 350*b* and section 350*c*, between section 350*c* and section 350*d*, and/or between section 350*d* and extension 342 increases to limit the amount that extension 340 pivots relative to extension 342. Extension 340 may be also pivoted relative to extension 342 such that first ends 340*a*, 342*a* of extensions 340, 342 are moved away from one another and second ends 340*b*, 342*b* of extensions 340, 342 are moved toward one another. As second ends 340*b*, 342*b* of extensions 340, 342 are moved toward one another, the space between extension 340 and section 348*a*, between section 348*a* and section 348*b*, between section 348*b* and section 348*c*, between section 348*c* and section 348*d*, and/or between section 348*d* and extension 342 increases and the space between extension 340 and section 350*a*, between section 350*a* and section 350*b*, between section 350*b* and section 350*c*, between section 350*c* and section 350*d*, and/or between section 350*d* and extension 342 decreases to limit the amount that extension 340 pivots relative to extension 342.

Figure 53:
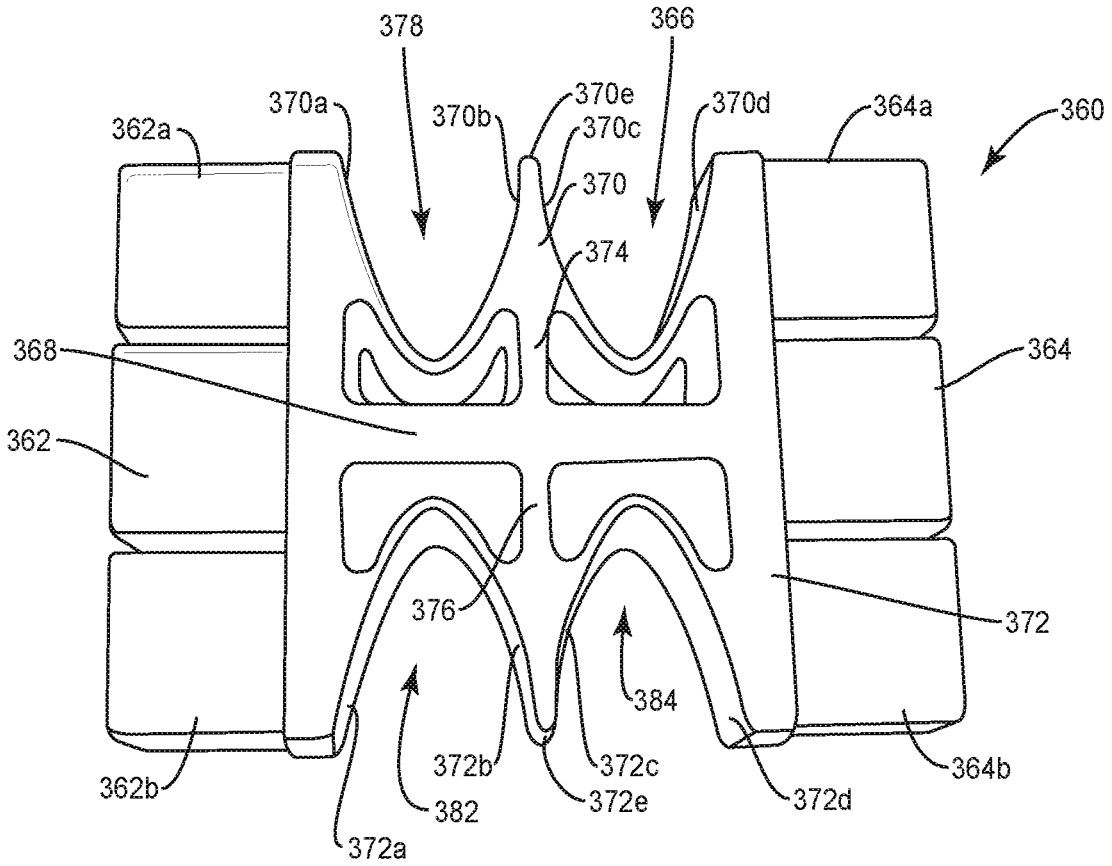
FIG. 53 is a perspective view of one embodiment of a component of the mattress assembly shown in FIG. 1, in accordance with the principles of the present disclosure.
Figure 54:
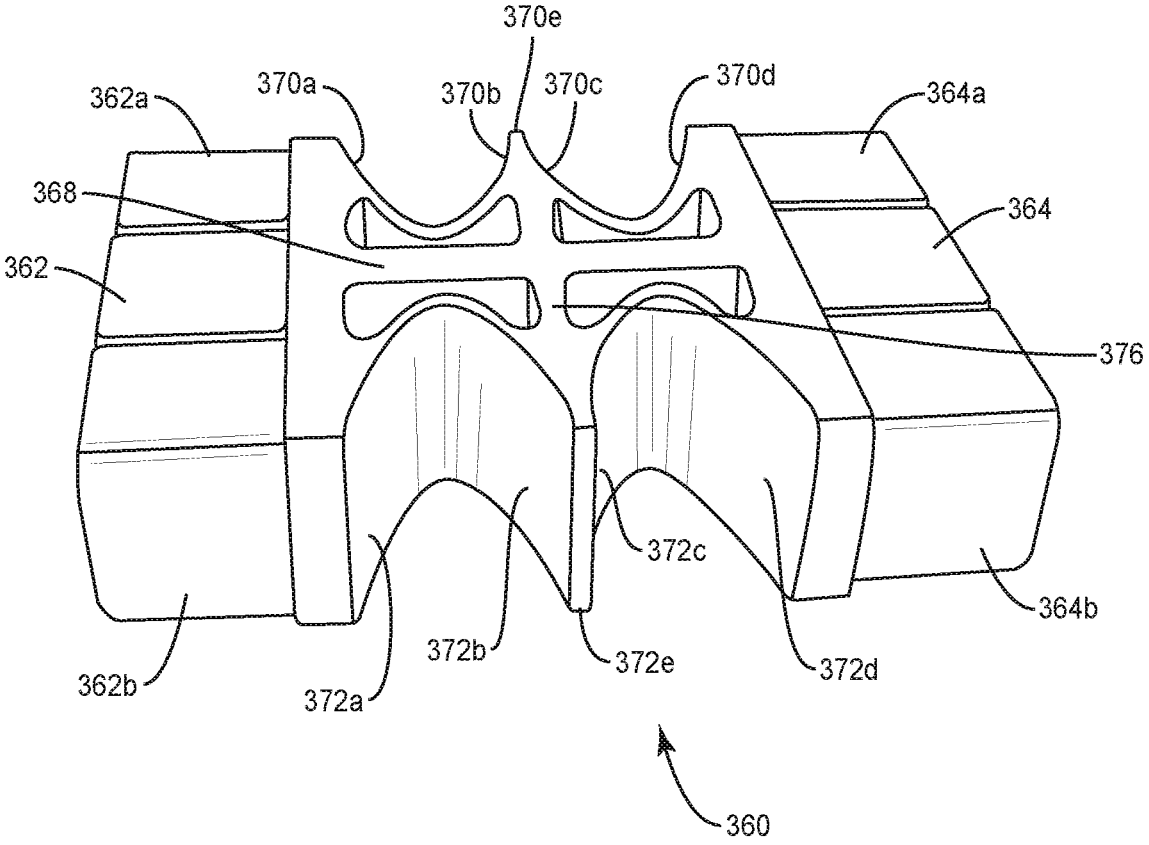
FIG. 54 is a perspective view of the component shown in FIG. 53.

In some embodiments, mattress assembly 30 may include a hinge 360, shown in FIGS. 53 and 54, in place of hinge 102*a*, hinge 102*b*, hinge 102*c*, hinge 102*d*, hinge 102*e*, and/or hinge 102*f* to allow a portion of sidewall 38 to pivot relative to another section of sidewall 38 and/or to allow a portion of sidewall 40 to pivot relative to another section of sidewall 40. Hinge 360 includes an extension 362, and extension 364 and a central portion 366 between extensions 362, 364. Extension 362 is configured for disposal in a first portion of sidewall 38 and/or sidewall 40 and extension 364 is configured for disposal in a second portion of sidewall 38 and/or sidewall 40. In some embodiments, extensions 362, 364 are configured for disposal in sidewall 38 and/or sidewall 40 such that extensions 362, 364 are fixed relative to sidewall 38 and/or sidewall 40. In some embodiments, extensions 362, 364 are deformable such that extensions 362, 364 are fixed relative to sidewall 38 and/or sidewall 40 when extensions 362, 364 are disposed in sidewall 38 and/or sidewall 40.

Central portion 366 includes a rib 368 that connects extension 362 with extension 364. Extensions 362, 364 are each deflectable relative to rib 368 to allow extension 362 to pivot relative to extension 364. Central portion 366 includes a wall 370 that connects a first end 362*a* of extension 362 with a first end 364*a* of extension 364 and a wall 372 that connects a second end 362*b* of extension 362 with a second end 364*b* of extension 364. Rib 368 is connected to wall 370 by an arm 374 and rib 368 is connected to wall 372 by an arm 376 that is aligned and/or coaxial with arm 374. Arms 374, 376 extend transverse to rib 368. In some embodiments, arms 374, 376 extend perpendicular to rib 368. Wall 370 includes an arcuate section 370*a* that is connected to an arcuate section 370*b* of wall 370 to define a concave portion 378 of wall 370. Wall 370 includes an arcuate section 370*c* that is connected to an arcuate section 370*d* of wall 370 to define a concave portion 380 of wall 370. Section 370*b* is connected to section 370*c* by a portion 370*e* of wall 370 that extends parallel to rib 368. Section 370*a* is continuously curved from extension 362 to section 370*b*. Section 370*b* is continuously curved from section 370*b* to portion 370*e*. Section 370*c* is continuously curved from portion 370*e* to section 370*d*. Section 370*d* is continuously curved from portion 370*c* to extension 364. Wall 370 is thus continuously curved from extension 362 to portion 370*e* and from portion 370*e* to extension 364. Wall 372 includes an arcuate section 372*a* that is connected to an arcuate section 372*b* of wall 372 to define a concave portion 382 of wall 372. Wall 372 includes an arcuate section 372*c* that is connected to an arcuate section 372*d* of wall 372 to define a concave portion 384 of wall 372. Section 372*b* is connected to section 372*c* by a portion 372*e* of wall 370 that extends parallel to rib 368. Section 372*a* is continuously curved from extension 362 to section 372*b*. Section 372*b* is continuously curved from section 372*b* to portion 372*e*. Section 372*c* is continuously curved from portion 370*e* to section 372*d*. Section 372*d* is continuously curved from portion 372*c* to extension 364. Wall 372 is thus continuously curved from extension 362 to portion 372*e* and from portion 372*e* to extension 364.

Extensions 362, 364 are configured to directly engage a section of wall adjunct to portion 370*e* to limit the amount that extensions 362, 364 can pivot relative to one another. Likewise, extensions 362, 364 are configured to directly engage a section of wall adjunct to portion 372*e* to limit the amount that extensions 362, 364 can pivot relative to one another. For example, extension 362 may be pivoted relative to extension 364 such that first ends 362*a*, 364*a* of extensions 362, 364 are moved toward one another and opposite second ends 362*b*, 364*b* of extensions 362, 364 are moved away from one another. As first ends 362*a*, 362*a* of extensions 362, 364 are moved toward one another, sections 370*a*,

370*d* of wall 370 move toward portion 370*e* of wall 370 and sections 372*a*, 372*d* of wall 372 move away from portion 372 of wall 372. In some embodiments, a junction between sections 370*a*, 370*b* of wall 370 moves toward rib 368 as first ends 362*a*, 362*a* of extensions 362, 364 are moved toward one another. In some embodiments, a junction between sections 370*c*, 370*d* of wall 370 moves toward rib 368 as first ends 362*a*, 362*a* of extensions 362, 364 are moved toward one another. In some embodiments, a junction between sections 372*a*, 372*b* of wall 372 moves away rib 368 as first ends 364*a*, 364*a* of extensions 362, 364 are moved toward one another. In some embodiments, a junction between sections 372*c*, 372*d* of wall 372 moves away from rib 368 as first ends 364*a*, 364*a* of extensions 362, 364 are moved toward one another.

Extension 362 may be also pivoted relative to extension 364 such that first ends 362*a*, 364*a* of extensions 362, 364 are moved away from one another and second ends 362*b*, 364*b* of extensions 362, 364 are moved toward one another. As second ends 362*b*, 364*b* of extensions 362, 364 are moved toward one another, sections 370*a*, 370*d* of wall 370 move away from portion 370*e* of wall 370 and sections 372*a*, 372*d* of wall 372 move toward portion 372 of wall 372. In some embodiments, the junction between sections 372*a*, 372*b* of wall 372 moves toward rib 368 as second ends 364*b*, 364*b* of extensions 362, 364 are moved toward one another. In some embodiments, the junction between sections 372*c*, 372*d* of wall 372 moves toward rib 368 as second ends 364*b*, 364*b* of extensions 362, 364 are moved toward one another. In some embodiments, the junction between sections 370*a*, 370*b* of wall 370 moves away rib 368 as second ends 364*b*, 364*b* of extensions 362, 364 are moved toward one another. In some embodiments, the junction between sections 370*c*, 370*d* of wall 370 moves away from rib 368 as second ends 364*b*, 364*b* of extensions 362, 364 are moved toward one another.

In operation and use, the components of mattress assembly 30 may be shipped to a destination, such as, for example, a residential home, in one or a plurality of containers, such as, for example, one or a plurality of boxes 62. It is envisioned that the components of mattress assembly 30 may be shipped to the destination via ground shipping. In some embodiments, the components of mattress assembly 30 are shipped to the destination via the U.S. postal system, United Parcel Service or Federal Express. Chassis 32 and cover 58 may be removed from one of the boxes and placed on top of a box spring. Chassis 32 is moved from the compacted configuration discussed herein to the expanded configuration discussed herein. Tambor 64, spring pack 66, topper 72, barrier layer 90 and/or outer layer 98 may be removed from the other box. Tambor 64 is positioned in interior cavity 42 in the manner discussed herein. Spring pack 66 is positioned on top of tambor 64, as discussed herein. Barrier layer 90 is positioned on top of spring pack 66, as discussed herein. Topper 72 is positioned on top of barrier layer 90, as discussed herein. Outer layer 98 is positioned on top of topper 72, as discussed herein. In embodiments wherein, mattress assembly 30 includes one or more of hinges 102, 102*a*, 102*b*, 102*c*, 102*d*, 102*e*, 102*f*, 324, 338 and/or 360 hinges 102, 102*a*, 102*b*, 102*c*, 102*d*, 102*e*, 102*f*, 324, 338 and/or 360 may be manipulated to move chassis 32 the planar orientation shown in FIG. 33 to the arcuate orientation shown in FIG. 34.

In some embodiments, a kit is provided that includes one or more of the components of mattress assembly 30 discussed herein. For example, the kit may include one or more chassis, such as, for example, chassis 32 discussed herein. It is envisioned that the chassis of the kit may vary with respect to size, shape and/or material. The kit may include one or more cover, such as, for example, cover 58 discussed herein. It is envisioned that the covers of the kit may vary with respect to size, shape and/or material. For example, the covers may include different fill materials and/or may have different firmnesses. The kit may include one or more tambor, such as, for example, tambor 64 discussed herein. It is envisioned that the tambors of the kit may vary with respect to size, shape and/or material. The kit may include one or more spring pack, such as, for example, spring pack 66 discussed herein. It is envisioned that the spring packs of the kit may vary with respect to size, shape and/or material. For example, the spring packs may include a plurality of spring packs having different firmnesses. The kit may include one or more mattress topper, such as, for example, topper 72 discussed herein. It is envisioned that the spring packs of the kit may vary with respect to size, shape and/or material.

The kit may also include packaging for the contents of the kit. For example, the kit may include a box, such as, for example, a box 62 discussed herein, for packaging chassis 32. The kit may also include a second container, such as, for example, a second box for packaging other contents of the kit. For example, the second box can be used to package the cover, the spring packs and/or the topper. It is envisioned that the second box may be shipped via ground delivery. That is, the second box need not be shipped as freight. The kit may include instructions for assembling a mattress assembly. In some embodiments, the instructions include directions for replacing one or more components of the mattress assembly. In some embodiments, the instructions include directions for cleaning one or more components of the mattress assembly. In some embodiments, the kit includes other bedding items. For example, the kit may include a box spring, bed sheets, pillows, pillow cases, a blanket or comforter, etc.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a chassis comprising a base layer, opposite first and second side walls and opposite first and second end walls each extending from the first side wall to the second side wall, the walls each being permanently joined with the base layer to define a cavity, the walls being movable relative to the base layer and one another;

a cover covering outer surfaces of the walls;

a spring pack positioned in the cavity;

a topper positioned over the spring pack; and an outer layer positioned over the topper, the outer layer being attached to the cover.

2. The bedding system recited in claim 1, wherein the outer layer is removably attached to the cover.

3. The bedding system recited in claim 1, wherein the outer layer is removably attached to the cover by a fastener.

4. The bedding system recited in claim 1, wherein the outer layer is removably attached to the cover by a zipper.

5. The bedding system recited in claim 4, wherein the cavity defines a perimeter, the zipper being positioned about the perimeter such that the zipper extends entirely around the perimeter.

6. The bedding system recited in claim 1, wherein the walls each extend upwardly from the base layer.

7. The bedding system recited in claim 1, wherein the base layer extends continuously from the top wall to the bottom wall and continuously from the first side wall to the second side wall.

8. The bedding system recited in claim 1, wherein the first side wall comprises a first end coupled to the first end wall and an opposite second end coupled to the second end wall, the second end being movable relative to the first end.

9. The bedding system recited in claim 1, wherein the first side wall comprises a first end coupled to the first end wall and an opposite second end coupled to the second end wall, the second end being rotatable relative to the first end.

10. The bedding system recited in claim 1, wherein the spring pack comprises first and second spring assemblies each extending continuously from the first end wall to the second end wall.

11. The bedding system recited in claim 10, wherein the first spring assembly is removable from the cavity independent of the second spring assembly.

12. The bedding system recited in claim 10, wherein the spring assemblies are identical.

13. The bedding system recited in claim 10, wherein the first spring assembly is firmer than the second spring assembly.

14. The bedding system recited in claim 10, wherein the spring assemblies each include a plurality of springs, the first spring assembly being different than the second spring assembly.

15. The bedding system recited in claim 14, wherein the spring assemblies each include a plurality of springs positioned within a pocket, the pockets being coupled to one another to form a string of pockets that each include one of springs therein.

16. The bedding system recited in claim 15, wherein the strings of pockets each include a slit between adjacent pockets to allow the springs to move independently of one another.

17. The bedding system recited in claim 16, wherein the slits extend through top surfaces of the strings of pockets between adjacent pockets.

18. A bedding system comprising:

a chassis comprising a base layer, opposite first and second side walls and opposite first and second end walls each extending from the first side wall to the second side wall, the walls each extending upwardly from the base layer, the walls each being permanently joined with the base layer, the base layer and the walls defining a cavity, the walls being movable relative to the base layer and one another;

a cover covering outer surfaces of the walls;

a spring pack positioned in the cavity;

a topper positioned over the spring pack; and an outer layer positioned over the topper, the outer layer being removably attached to the cover by a fastener.

19. A bedding system comprising:

a chassis comprising a base layer, opposite first and second side walls and opposite first and second end walls each extending from the first side wall to the second side wall, the walls each being permanently joined with the base layer to define a cavity, the first side wall comprising a first end extending to the first end wall and an opposite second end extending to the second end wall, the second end being movable relative to the first end;

a cover covering outer surfaces of the walls;

a spring pack positioned in the cavity;

a topper positioned over the spring pack; and an outer layer positioned over the topper, the outer layer being attached to the cover.

* * * * *